US007112402B2

(12) United States Patent
Yoshioka et al.

(10) Patent No.: US 7,112,402 B2
(45) Date of Patent: Sep. 26, 2006

(54) PHOTOTHERMOGRAPHIC MATERIAL

(75) Inventors: Yasuhiro Yoshioka, Kanagawa (JP); Yoshihisa Tsukada, Kanagawa (JP); Takayoshi Oyamada, Kanagawa (JP); Minoru Sakai, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 32 days.

(21) Appl. No.: 10/754,537

(22) Filed: Jan. 12, 2004

(65) Prior Publication Data

US 2004/0185389 A1 Sep. 23, 2004

(30) Foreign Application Priority Data

Jan. 16, 2003 (JP) ..... 2003-008015
Jan. 16, 2003 (JP) ..... 2003-008016

(51) Int. Cl.

| | |
|---|---|
| ***G03C 1/00*** | (2006.01) |
| ***G03C 1/005*** | (2006.01) |
| ***G03C 1/494*** | (2006.01) |
| ***G03C 5/16*** | (2006.01) |

(52) U.S. Cl. ..... 430/619; 430/620; 430/348; 430/350; 430/631

(58) Field of Classification Search ..... 430/350, 430/619, 620, 348, 631
See application file for complete search history.

(56) References Cited

U.S. PATENT DOCUMENTS

| | | | | |
|---|---|---|---|---|
| 6,524,776 | B1 * | 2/2003 | Goan | 430/350 |
| 2004/0033453 | A1 * | 2/2004 | Kobayashi | 430/619 |

* cited by examiner

*Primary Examiner*—Geraldine Letscher
(74) *Attorney, Agent, or Firm*—Margaret A. Burke; Sheldon J. Moss

(57) ABSTRACT

A photothermographic material of the present invention contains a slipping agent. One slipping agent is a liquid at a ordinary temperature, and an volatile rate of the slipping agent at 120° C. for one hour is 0.5% by mass or less as measured by a thermo-balance. The other slipping agent is that a permeating rate to the transportation rollers, when the transportation rollers are immersed in the slipping agent at 120° C. for 2 hours, is 6% by mass or less.

19 Claims, 1 Drawing Sheet

PHOTOTHERMOGRAPHIC MATERIAL

CROSS-REFERENCE TO RELATED APPLICATIONS

This application claims priority to Japanese patent application numbers 2003-8015 filed Jan. 16, 2003 and 2003-8016 filed Jan. 16, 2003, the disclosures of which are incorporated herein by reference.

BACKGROUND OF THE PRESENT INVENTION

1. Field of the Present Invention

The present invention concerns a photothermographic material and an image forming method by using the photothermographic material.

2. Description of the Related Art

In recent years, there has been a strong desire to decrease the volume of processing liquid wastes in the medical field from the view point of environmental protection and economy of space. In the field of medical diagnosis, photothermographic materials have been proposed. To use photosensitive photothermographic materials in medical diagnoses and photographic techniques, they must be capable of being exposed efficiently by laser image setters or laser imagers. Additionally, they must be capable of forming clear black images having high resolution and sharpness. With photosensitive photothermographic materials, thermal development processing systems can be supplied to customers that obviate the need for solution system processing chemicals, have a simple construction and are environmentally safe.

While such requirements also exist in the field of general imaging, images for medical use particularly require high image quality of excellent sharpness and graininess since delicate imaging characteristics is needed. Further, images of blue black image tone are preferred to facilitate easy diagnosis. At present, various kinds of hard copy systems that utilize pigments and dyes such as ink jet printers or electrophotography have been marketed as conventional image forming systems, but they are not satisfactory as image output systems for medical use.

Thermal image forming systems utilizing organic silver salts are described in the art. In general, a photothermographic material typically has an image forming layer and the image forming layer contains a catalytically active amount of photocatalyst (for example, silver halide), a reducing agent, a reducible silver salt (for example, organic silver salt) and, optionally, a color toning agent for controlling the color tone of silver dispersed in a binder matrix. The photothermographic material, when heated to a high temperature (for example, 80° C. or higher) after imagewise exposure, forms black silver images by oxidation/reduction reaction between a silver halide or reducible silver salt (functioning as an oxidizer) and a reducing agent. The oxidation/reduction reaction is promoted by the catalytic effect of latent images of the silver halide formed by exposure. Accordingly, black silver images are formed in an exposed region. Fuji Medical Dry Imager FM-DPL has been sold as a medical image forming system using photothermographic materials.

In photothermographic materials, it is a goal to provide the photosensitive material with a property to ease sliding of the material and thus improve the transportability during production and fabrication and accumulation property thereof. Suggested materials include liquid paraffin described in JP-A No. 10-69023, liquid lubricant such as silicone oil described in JP-A No. 2001-5138 and solid esters such as carnauba wax described in JP-A Nos. 2000-112062 and 2001-5137. Such materials for easing sliding of a photothermographic imaging material are known as "slipping agents" and are used preferably for the protection layer on the side of emulsion layer or the protection layer on the side of back surface and, particularly, they are generally used for the outermost layer.

However, the outermost layer is a portion in direct contact with a transportation apparatus, and accumulated material sometimes causes transportation failure and, further, can have undesired effects on the output images. Since they may also possibly cause failures in the plane of the photosensitive materials, selection of a material to ease sliding of the photothermographic material ("slipping agent") as an additive is an important subject. Accordingly, there is a need in the art for the development of improved slipping agents to ease sliding of photothermographic materials and development of photothermographic materials with such additives.

SUMMARY OF THE PRESENT INVENTION

Accordingly, the present invention at first intends to provide a photothermographic material excellent in transportability upon forming images on a photothermographic material and also excellent in photographic performance, as well as a method of forming images for the photothermographic material.

The present invention intends, secondarily, to provide a photothermographic material excellent in the planar property and photographic performance upon image formation in a photothermographic material and provide a method of forming images for the photothermographic material.

The subjects of the present invention can be attained by a photothermographic material to be described below.

1. The present invention relates to, as a first aspect, a photothermographic material comprising, on a support, an image forming layer containing a photosensitive silver halide, a non-photosensitive organic silver salt, a reducing agent and a binder, and a non-photosensitive layer, wherein: the non-photosensitive layer contains a slipping agent which is a liquid at a ordinary temperature; and an volatile rate of the slipping agent at 120° C. for one hour is 0.5% by mass or less as measured by a thermo-balance.

2. A photothermographic material according to the first aspect, wherein wherein the slipping agent is at least one selected from the group consisting of paraffin, isoparaffin, naphthene, fatty acid ester and silicone based oil.

3. A photothermographic material according to the second aspect, wherein the slipping agent is at least one selected from the group consistinf of liquid paraffin, a monovalent fatty acid esters of polyhydric alcohols and a polyvalent fatty acid esters of monohydric alcohols.

4. The present invention relates to, as a fourth aspect, a photothermographic material used in a heat development system having transportation rollers, the photothermographic material comprising, on a support, an image forming layer containing a photosensitive silver halide, a non-photosensitive organic silver salt, a reducing agent and a binder, and a non-photosensitive layer, wherein: the non-photosensitive layer contains a slipping agent; and a permeating rate of the slipping agent to the transportation rollers, when the transportation rollers are immersed in the slipping agent at 120° C. for 2 hours, is 6% by mass or less.

5. A photothermographic material according to fourth aspect, wherein the slipping agent contains at least one selected from the group consisting of paraffin, isoparaffin, naphthene, fatty acid ester and silicone based oil.

6. A photothermographic material according to fifth aspect, wherein the paraffin is liquid paraffin.

7. A photothermographic material according to fourth aspect, wherein the slipping agent is a liquid at ordinary temperature.

8. A photothermographic material according to fourth aspect, wherein the melting point of the slipping agent is from 40° C. or higher to 80° C. or lower.

9. A photothermographic material according to fourth aspect, wherein a surface material of the roller contains at least one of rubber and resin.

10. A photothermographic material according to fourth aspect, wherein a surface material of the roller contains at least one of silicone rubber and fluoro rubber.

11. A photothermographic material according to first aspect, wherein the slipping agent is at least one selected from the group consisting of compounds represented by the following general formulae (S-I), (S-II), and (S-III):

General formula (S-I)

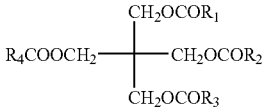

General formula (S-II)

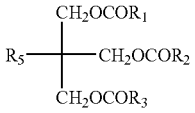

General formula (S-III)

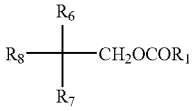

wherein $R_1$, $R_2$, and $R_3$ each independently represent an alkyl group, alkenyl group, alkynyl group, cycloalkyl group or aryl group having 6 to 30 carbon atoms; $R_5$ represents an alkyl group having 1 to 30 carbon atoms, and $R_6$, $R_7$, and $R_8$ each independently represent a methylol group or an alkyl group having 1 to 30 carbon atoms.

12. A photothermographic material according to fourth aspect, wherein the slipping agent is at least one selected from the group consisting of compounds represented by the following general formulae (S-I), (S-II), and (S-III):

General formula (S-I)

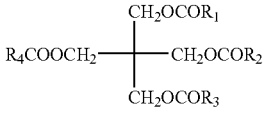

General formula (S-II)

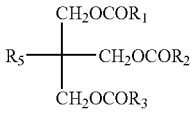

General formula (S-III)

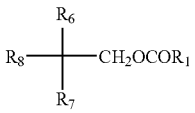

wherein $R_1$, $R_2$, and $R_3$ each independently represent an alkyl group, alkenyl group, alkynyl group, cycloalkyl group or aryl group having 6 to 30 carbon atoms; $R_5$ represents an alkyl group having 1 to 30 carbon atoms, and $R_6$, $R_7$, and $R_8$ each independently represent a methylol group or an alkyl group having 1 to 30 carbon atoms.

13. A photothermographic material according to first aspect, further containing a fluoro compound having a fluoro alkyl group having at least 2 carbon atoms and no more than 13 fluorine atoms.

14. A photothermographic material according to first aspect, further containing a fluoro compound having a fluoro alkyl group having at least 2 carbon atoms and no more than 12 fluorine atoms.

15. A photothermographic material according to fourteenth aspect, wherein the fluoro compound has a fluoro alkyl group represented by the following general formula (A):

-Rc-Re—W General formula (A)

wherein Rc represents an alkylene group having 1 to 4 carbon atoms; Re represents a perfluoro alkylene group having 2 to 6 carbon atoms; and W represents a hydrogen atom, fluorine atom or alkyl group.

16. A photothermographic material according to fifteenth aspect, wherein the fluoro compound has two or more fluoro alkyl groups represented by general formula (A) in one molecule.

17. A photothermographic material according to first aspect, wherein the non-photosensitive layer is an outermost layer.

18. A method of forming images using the photothermographic material according to first aspect, wherein the photothermographic material is heat developed under at least one condition selected from the group consisting of the following conditions (1) and (2):

(1) at a temperature from 100° C. to 140° C. for 18 sec or less, (2) at a linear developing speed of 23 mm/s or higher.

19. A method of forming images using the photothermographic material according to fourth aspect, wherein the photothermographic material is heat developed under at least one condition selected from the group consisting of the following conditions (1) and (2):

(1) at a temperature from 100° C. to 140° C. for 18 sec or less, (2) at a linear developing speed of 23 mm/s or higher.

DETAILED DESCRIPTION OF THE PRESENT INVENTION

Figure 1:
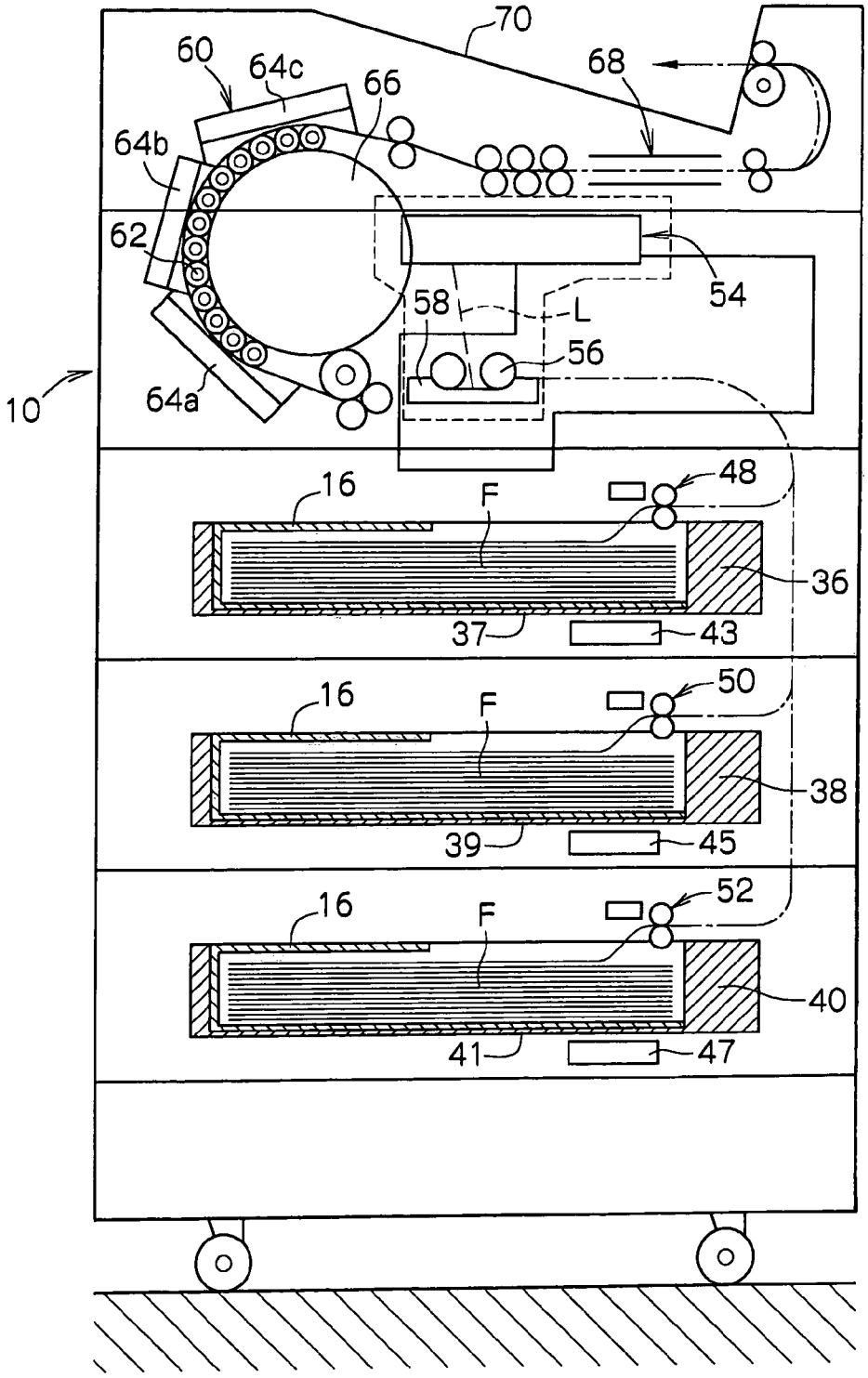
FIG. 1 is a schematic constitutional view of a thermal developing recording apparatus having a laser recording device according to the present invention mounting thereon.

In photothermographic materials, since all chemical substances required for development are incorporated in the sensitive material, all the chemical materials remain after the development. Since the remaining chemical substances affect the transportability or output images, selection of all additives is important in the development of any photothermographic material. The present inventors have particularly studied the effects of the slipping agent in the additives.

The liquid paraffin as a kind of slipping agents currently in use is a mixture of linear paraffin, branched paraffin and naphthene, and produced by purification of petroleum fractions. Products of different compositions and grades are sold from various companies. The liquid paraffin keeps a liquidus state since ingredients of different molecular weights are mixed. Accordingly, it includes low molecular weight ingredients to some extent and the content is different depending on the products of each company and the respective places of production and ways of purification of crude oils as starting materials. It has been found that the heat development involves a problem in that the low molecular weight ingredients evaporate little by little during long periods of use to contaminate the periphery of the heat developed regions thereby worsening the transportability and a problem that they contaminate the periphery of the heat developed region, particularly, transportation rollers thereby causing planar failure for the photosensitive material. However, it has not yet been recognized so far in the art that the problem is caused by the liquid paraffin.

On the other hand, ester type lubricants are prepared usually by melting those in a solidus state at high temperature and dispersing the same using a great amount of a surface active agent and it has been found that use of the lubricant in the photothermographic material brings about a problem such as increase in fogging or fluctuation of sensitivity during storage of the sensitive material. It has not been recognized also that the problem is caused by the surface active agent contained in the lubricant.

It has been desired to have lubricant capable of preparing a stable dispersion by the use of a small amount of a surface active agent under the presence of a protection colloid such as gelatin in liquid paraffin at ordinary temperature free from the problem of volatile.

As a result of studies of the problems described above, the present inventors have accomplished the present invention of the first feature.

The present inventors have made further studies to attain the second object.

In the photothermographic material, since all chemical substances required for development are incorporated in the photosensitive material as described above, all the chemical substances remain also after the development. The remaining chemical substances deposit as contaminants to the transportation rollers and the like and also give undesired effects on the transportability and output images. The present inventors have noted, particularly, on the slipping agent in the additives and have made studies. As a result, it has been found that a slipping agent with high permeating ratio to transportation rollers swells the transportation rollers and, eventually, causes planar failure in the photosensitive material. In view of the above, parameters of "permeating ratio" is set and means for judging the frequency for the occurrence of planar failures in the sensitive material by measuring the same. Particularly, the parameter is useful for providing a photothermographic material containing a slipping agent suitable to a heat developing machine in a case where the machine uses transportation rollers. A favorable photothermographic material with no planar failures in the photosensitive material suitable to a heat developing machine having transportation rollers can now be provided by the measurement of the permeating ratio with no requirement for determination whether the transportation failure is caused due to the presence of low molecular weight ingredients or impurities or due to the substances other than those described above.

The photothermographic material of the present invention for attaining the first object has a feature in that the non-photosensitive layer contains a slipping agent which is a liquid at ordinary temperature and the volatile ratio of the slipping agent at 120° C. for one hour is 0.5% by mass or less as measured by a thermo-balance, with no other particular restrictions.

Further, the photothermographic material of the present invention for attaining the second object has a feature in that the non-photosensitive layer contains a slipping agent and that the permeating ratio to the transportation roller is 6% by mass or less, with no other particular restrictions <Slipping Agent for Attaining the First Object>

The slipping agent for attaining the first object (hereinafter referred to as "first slipping agent") may have any structure so long as it is a liquid at a ordinary temperature and the reduction ratio thereof when the weight change at 120° C. for one hour is 0.5% by mass or less as measured by a thermo-balance. For example, the agent can include paraffin, isoparaffin, naphthene, fatty acid ester and silicon type oils and, among them, liquid paraffin, monovalent fatty acid ester of polyhydric alcohol and polyvalent fatty acid ester of monohydric alcohol are preferred.

In the present invention, the definition for "liquid at ordinary temperature" means that the material has a fluidity at 25° C. The present invention also includes a case where a compound which is solid at a ordinary temperature is used as a liquid in admixture with a compound of a similar structure so that it is liquid at a ordinary temperature.

The measuring method of the weight change at 120° C. for one hour by a thermo-balance can be conducted by elevating temperature from 30° C. to 120° C. at a rate of 5° C./min in a nitrogen gas stream of 200 ml/min by using a marketed thermo-balance device (TG/GTA 220 measuring device manufactured by Seiko Instrument Co.), then maintaining the specimen at 120° C., and then the weight decreased with lapse of one hour can be measured as a percentage relative to the weight of an original specimen (about 10 mg weighted amount).

1) Specific Example

Specific examples of slipping agents having a reduction ratio of 0.5% by mass or less when the change of weight at 120° C. for one hour is measured by a thermo-balance are shown below but they are not restrictive.

| | | Volatile amount (120° C. - 1 h) |
|---|---|---|
| Comparative Compound | | |
| R-1 | KEIDOL WHITE MINERAL OIL manufactured by Witco Co. | 0.64% by mass |
| Compound of the present invention | | |
| S-1 | From R-1 3.9% by mass was distilled off by vacuum distillation | 0.40% by mass |
| S-2 | From R-1 12.6% by mass was distilled off by vacuum distillation | 0.23% by mass |
| S-3 | From R-1 16.3% by mass was distilled off by vacuum distillation | 0.13% by mass |
| S-4 | MOLESCO WHITE P-350P by Matsumura Petroleum Institute | 0.12% by mass |
| S-5 | MOLESCO WHITE P-500 by Matsumura Petroleum Institute | 0.01% by mass |
| S-6 | Liquid paraffin 260-S by Sanko Chemical Industry | 0.11% by mass |

-continued

| | | Volatile amount (120° C. - 1 h) |
|---|---|---|
| S-7 | Liquid paraffin 380-S by Sanko Chemical Industry | 0.04% by mass |
| S-8 | TRIALAN 308 by Nikko Chemicals | 0.16% by mass |
| S-9 | TRIALAN 318H by Nikko Chemicals | 0.002% by mass |
| S-10 | YUNISTAR H-381R by Nippon Yushi | 0.03% by mass |
| S-11 | YUNISTAR H-481R by Nippon Yushi | 0.04% by mass |
| S-12 | PIONIN E-5310 by Takemoto Yushi | 0.12% by mass |
| S-13 | PIONIN E-5312 by Takemoto Yushi | 0.09% by mass |
| S-14 | NS-408 by Nippon Seika Kogyo | 0.02% by mass |
| S-15 | NS-318S by Nippon Seika Kogyo | 0.00% by mass |
| S-16 | CRODAMOL PTIS by CRODA | 0.05% by mass |
| S-17 | SALACOS 6318 by Nisshin Oilio | 0.02% by mass |
| S-18 | SALACOS 6318R by Nisshin Oilio | 0.01% by mass |
| S-19 | KAK PTI by Kokyu Alcohol Kogyo | 0.17% by mass |
| S-20 | KAK TTI by Kokyu Alcohol Kogyo | 0.04% by mass |

2) Preferred Structure

A preferred structure of the slipping agent which is a liquid at a ordinary temperature in the present invention is represented by the following general formula (S-I), (S-II) or (S-III).

General formula (S-I)

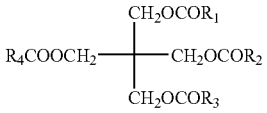

General formula (S-II)

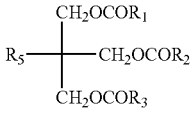

General formula (S-III)

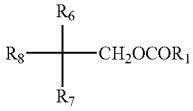

In the general formulae (S-I), (S-II) and (S-III), $R_1$, $R_2$, and $R_3$ each represents independently an alkyl group, alkenyl group, alkynyl group, cycloalkyl group or aryl group 6 to 30 carbon atoms.

$R_5$ represents an alkyl group of 1 to 30 carbon atoms. $R_6$, $R_7$, and $R_8$ each represents independently a methylol group or an alkyl group of 1 to 30 carbon atoms. The groups described above may be substituted with an ester group.

It is preferred that the group represented by $R_1$ to $R_3$ has a double bond or branched structure in order that the compound represented by the general formulae (S-I), (S-II) and (S-III) is a liquid at ordinary temperature. Further, in the same meaning, it is also preferred that the alkyl group represented by $R_6$ to $R_8$ has a double bond or branched structure. Substitution of the group $R_6$ to $R_8$ with an ester group is a preferred structure so that the compound is liquid at a ordinary temperature.

In the general formulae (S-I) to (S-III), $R_1$ to $R_3$ is each preferably a branched alkyl group or alkenyl group of 6 to 30 carbon atoms, more preferably, 8 to 24 carbon atoms and, further preferably, 12 to 20 carbon atoms. Specifically, they include, for example, 1-ethylpentyl group, heptyl group, undecyl group, 2-hexylnonyl group, 15-methylhexadecyl group, and 8-heptadecenyl group. Among them, 15-methylhexadcyl group and 8-heptadecenyl group are preferred.

$R_5$ is preferably alkyl group of 1 to 30 carbon atoms, more preferably, an alkyl group of 1 to 8 carbon atoms, further preferably, 1 to 3 carbon atoms. They include specifically, for example, methyl group, ethyl group, propyl group, butyl group, octyl group and hexadecyl group. Among them, methyl group or ethyl group is preferred, with ethyl group being most preferred.

$R_6$ to $R_8$ each preferably a methylol group or an alkyl group of 1 to 30 carbon atoms which may be substituted with an ester group. An alkyl group substituted with a methylol group or ester group is more preferred.

Specific structures of preferred compound for the slipping agent in the present invention are shown below but the present invention is not restricted to such structures.

(S-21)

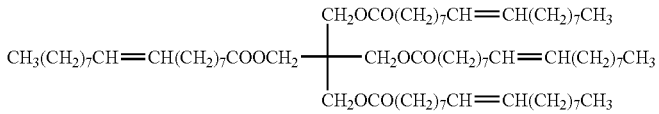

(S-22)

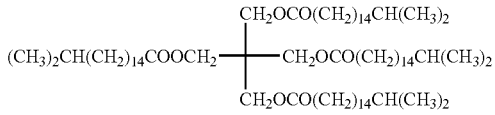

(S-23)

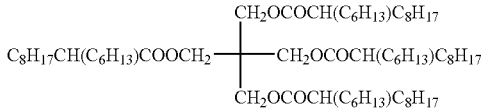

-continued (S-24)

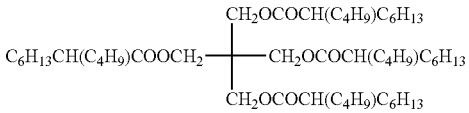

(S-25)

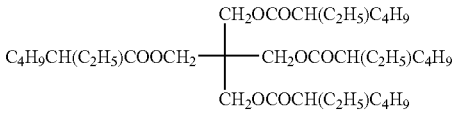

(S-26)

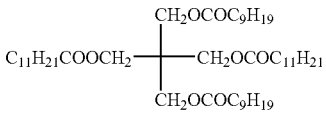

(S-27)

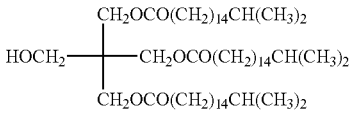

(S-28)

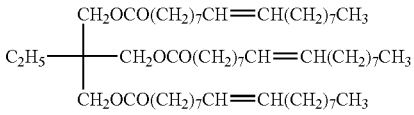

(S-29)

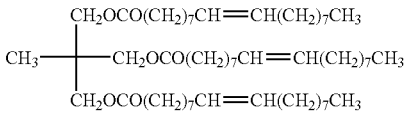

(S-30)

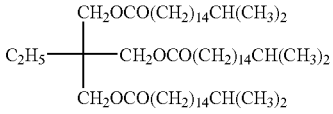

(S-31)

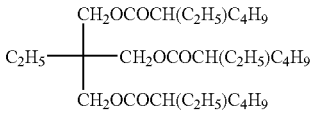

(S-32)

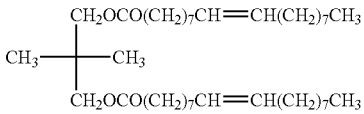

(S-33)

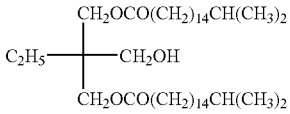

3) Method of Use

The slipping agent in the present invention can be used by adding, into a coating solution, an emulsified dispersion formed by emulsifying and dispersing the agent in an aqueous gelatin solution by using an anionic surface active agent such as sodium docecyl benzene sulfonate and sodium oleoyl methyl taurine. The emulsified dispersion can be prepared by a known method using, for example, a homogenizer, dissolver, or Manton-Goulin emulsifying machine. In the emulsification dispersion, additives such as an auxiliary solvent and corrosion inhibitor may be used in addition to the surface active agent. In the present invention, it is preferred to emulsify without using the auxiliary solvent. The slipping agent in the present invention is liquid and can be emulsified and dispersed without using the auxiliary solvent. Use of the liquidus form with no auxiliary solvent can avoid problems such as fluctuation of particle size, and worsening of filterability due to formation of coarse particles and deposition of crystals which often cause problems for the aging stability of emulsification products.

The slipping agent in the present invention can be added to the surface protection layer for the back surface and the image forming layer surface. The slipping agent is more preferably added to the outermost layer for the back surface and the image forming layer surface. Further, while it may be added to the surface protection layer for either one of the back surface or the image forming layer surface, it is preferred to add the agent to the surface protection layers for both of the surfaces.

A preferred addition amount for each of the image forming layer surface and the back surface is 1.0 mg/m$^2$ or more and 200 mg/m$^2$ or less and, more preferably, 10 mg/m$^2$ or more and 100 mg/m$^2$ or less.

Further, the slipping agent according to the present invention may be used alone or two or more of them may be used together.

<Slipping Agent for Attaining the Second Object>

The slipping agent for attaining the second object (hereinafter referred to as "second slipping agent") may have any structure so long as it contains at least one material having a permeating ratio to the transportation roller of 6% by mass or less.

The permeating ratio to the transportation roller is measured herein as described below. At first, for the length× width surface portion of a transportation roller used in a heat development system, a member of a size: 1 cm length×1 cm width×0.2 cm thickness is cut out of the transportation roller. The roller member is dipped in a slipping agent solution (100%) heated to 120° C. for 2 hours and then deposited slipping agent is wiped off cleanly and the weight is measured. The increased weight is evaluated by the percentage based on the weight of the original specimen.

When the material of the transportation roller used in the heat development system varies, the permeating ratio naturally varies even when an identical slipping agent is used. That is, when the permeating ratio is determined, a slipping agent suitable to the heat development system used can be selected previously and the frequency for the occurrence of transportation failure is remarkably decreased in a photothermographic material using the slipping agent.

In the present invention, the permeating ratio of the slipping agent is 6% by mass or less, preferably, 4% by mass or less and, more preferably, 2% by mass or less.

Further, as described above, while there is no particular restriction on the structure of the second slipping agent, paraffin, isoparaffin, naphthene, fatty acid ester or silicone based oil can be used as a slipping agent. Among them, liquid paraffin is preferred as paraffin and monovalent fatty acid ester and polyvalent fatty acid ester of polyhydric alcohol are preferred as the fatty acid ester. Most preferred second slipping agent is a polyvalent fatty acid ester.

The second slipping agent in the present invention can be added to the surface protection layer for the back surface and the image forming layer surface. The second slipping agent is more preferably added to the outermost layer for the back surface and the image forming layer surface. Further, while it may be added to the surface protection layer for either one of the back surface or the image forming layer surface, it is preferred to add the agent to the surface protection layers for both of the surfaces.

A preferred addition amount for each of the image forming layer surface and the back surface is 1.0 mg/m$^2$ or more and 200 mg/m$^2$ or less and, more preferably, 10 mg/m$^2$ or more and 100 mg/m$^2$ or less.

Further, the second slipping agent according to the present invention may be used alone or two or more of them may be used together.

(1) Slipping Agent which is Liquid at Ordinary Temperature

The second slipping agent in the present invention is preferably a slipping agent which is a liquid at ordinary temperature. In the present invention, the definition "liquid at ordinary temperature" means that the material has a fluidity at 25° C. The present invention also includes a case where a compound which is solid at a ordinary temperature is used as a liquid in admixture with a compound of a similar structure so that it is liquid at a ordinary temperature.

1) Specific Examples

Specific examples of the slipping agent having a permeating ratio to the transportation roller of 6% by mass or less and which is liquid at a ordinary temperature are shown below together with comparative examples with no particular restriction thereto.

| | | Manufactured by Kensetsu Rubber Co. Permeating ratio against KSI-6000 |
|---|---|---|
| Comparative Compound | | |
| R-1 | KEIDOL WHITE MINERAL OIL manufactured by Witco Co. | 8.0% by mass |
| S-1 | From R-1 3.9% by mass was distilled off by vacuum distillation | 7.5% by mass |
| S-2 | From R-1 12.6% by mass was distilled off by vacuum distillation | 7.2% by mass |
| S-3 | From R-1 16.3% by mass was distilled off by vacuum distillation | 6.8% by mass |
| S-8 | TRIALAN 308 by Nikko Chemicals | 18.3% by mass |
| S-14 | NS-408 by Nippon Seika Kogyo | 12.1% by mass |
| Compound of the present invention | | |
| S-4 | MOLESCO WHITE P-350P by Matsumura Petroleum Institute | 3.9% by mass |
| S-5 | MOLESCO WHITE P-500 by Matsumura Petroleum Institute | 3.3% by mass |
| S-6 | Liquid paraffin 260-S by Sanko Chemical Industry | 4.5% by mass |
| S-7 | Liquid paraffin 380-S by Sanko Chemical Industry | 4.0% by mass |
| S-9 | TRIALAN 318H by Nikko Chemicals | 0.3% by mass |
| S-10 | YUNISTAR H-381R by Nippon Yushi | 1.0% by mass |
| S-11 | YUNISTAR H-481R by Nippon Yushi | −0.2% by mass |
| S-12 | PIONIN E-5310 by Takemoto Yushi | 3.9% by mass |
| S-13 | PIONIN E-5312 by Takemoto Yushi | 2.2% by mass |
| S-15 | NS-318S by Nippon Seika Kogyo | 0.29% by mass |
| S-16 | CRODAMOL PTIS by CRODA | 1.0% by mass |
| S-17 | SALACOS 6318 by Nisshin Oilio | 0.8% by mass |
| S-18 | SALACOS 6318R by Nisshin Oilio | 0.9% by mass |
| S-19 | KAK PTI by Kokyu Alcohol Kogyo | 0.05% by mass |
| S-20 | KAK TTI by Kokyu Alcohol Kogyo | 0.54% by mass |

KSI-6000 is a transpiration roller made of silicone rubber.

2) Preferred Structure

A preferred structure of the slipping agent which is a liquid at ordinary temperature in the present invention is represented by the following general formula (S-I), (S-II) or (S-III).

General formula (S-I)

General formula (S-I)

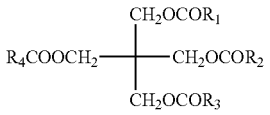

-continued

General formula (S-II)

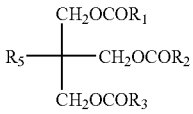

General formula (S-III)

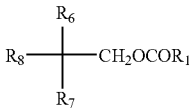

In the general formulae (S-I), (S-II) and (S-III), $R_1$, $R_2$, and $R_3$ each represents independently an alkyl group, alkenyl group, alkynyl group, cycloalkyl group or aryl group of 6 to 30 carbon atoms.

$R_5$ represents an alkyl group of 1 to 30 carbon atoms. $R_6$, $R_7$, and $R_8$ each represents independently a methylol group or an alkyl group of 1 to 30 carbon atoms. The groups described above may be substituted with an ester group.

It is preferred that the group represented by $R_1$ to $R_3$ has a double bond or branched structure in order that the compound represented by the general formulae (S-I), (S-II) and (S-III) is a liquid at ordinary temperature. Further, in the same meaning, it is also preferred that the alkyl group represented by $R_6$ to $R_8$ has a double bond or branched structure. Substitution of the group $R_6$ to $R_8$ with the ester group is a preferred structure so that the compound is liquid at a ordinary temperature.

In the general formulae (S-I) to (S-III) $R_1$ to $R_3$ is each preferably a branched alkyl group or alkenyl group of 6 to 30 carbon atoms, more preferably, 8 to 24 carbon atoms and, further preferably, 12 to 20 carbon atoms. Specifically, they include, for example, 1-ethylpentyl group, heptyl group, undecyl group, 2-hexylnonyl group, 15-methylhexadecyl group, and 8-heptadecenyl group. Among them, 15-methylhexadecyl group and 8-heptadecenyl group are more preferred.

$R_5$ is preferably alkyl group of 1 to 30 carbon atoms, more preferably, an alkyl group of 1 to 8 carbon atoms, further preferably, 1 to 3 carbon atoms. They include specifically, for example, methyl group, ethyl group, propyl group, butyl group, octyl group and hexadecyl group. Among them, methyl group or ethyl group is preferred, with ethyl group being most preferred.

$R_6$ to $R_8$ each is preferably a methylol group or an alkyl group of 1 to 30 carbon atoms which may be substituted with an ester group. An alkyl group substituted with a methylol group or ester group is more preferred.

Specific structures of preferred compound for the slipping agent which is a liquid at ordinary temperature in the present invention are shown below but the present invention is not restricted to such structures.

(S-21)

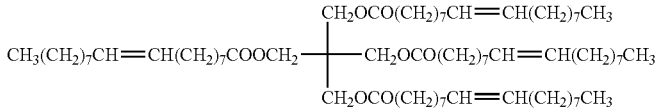

(S-22)

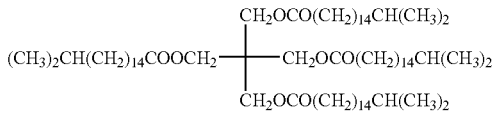

(S-23)

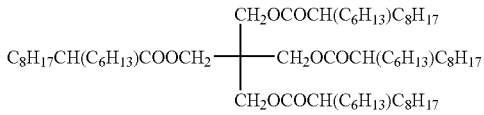

(S-24)

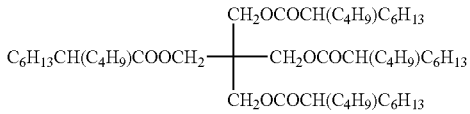

(S-25)

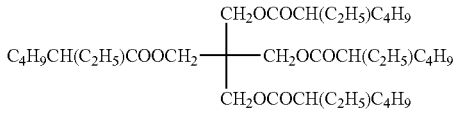

(S-26)

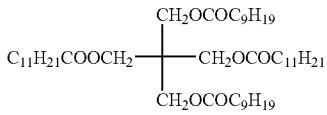

(S-27)

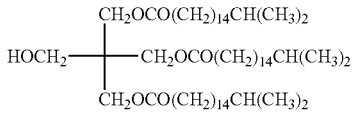

-continued (S-28)

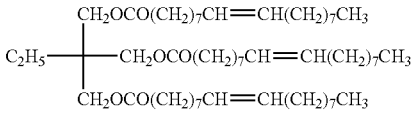

(S-29)

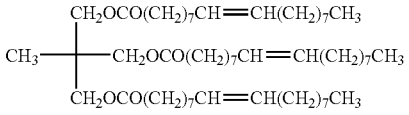

(S-30)

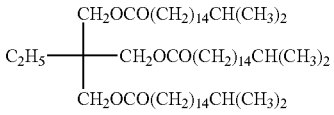

(S-31)

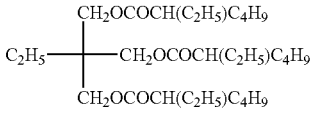

(S-32)

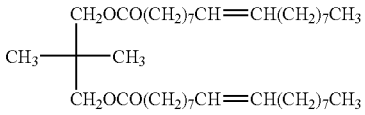

(S-33)

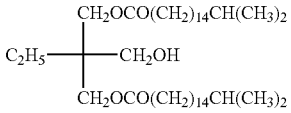

3) Method of Use

The slipping agent which is a liquid at ordinary temperature in the present invention can be used by adding, into a coating solution, an emulsified dispersion formed by emulsifying and dispersing the agent in an aqueous gelatin solution by using an anionic surface active agent such as sodium docecyl benzene sulfonate and sodium oleoyl methyl taurine. The emulsified dispersion can be prepared by a known method using, for example, a homogenizer, dissolver, or Manton-Goulin emulsifying machine. In the emulsification dispersion, additives such as an auxiliary solvent and corrosion inhibitor may be used in addition to the surface active agent. In the present invention, it is preferred to emulsify without using the auxiliary solvent. The slipping agents are liquid and can be emulsified and dispersed without using the auxiliary solvent. Use of the liquidus form with no auxiliary solvent can avoid problems such as fluctuation of particle size, and worsening of filterability due to formation of coarse particles and deposition of crystals which often cause problems for the aging stability of emulsification products.

(2) Slipping Agent with a Melting Point of 40° C. to 80° C.

The second slipping agent in the present invention preferably has a melting point from 40° C. to 80° C. Such a slipping agent has a feature of forming a liquid of low viscosity at a temperature higher by 5° C. or more than the melting point and capable of easily being dispersed in an aqueous solution containing a protection colloid such as gelatin of a temperature at 85° C. or lower and also excellent in the stability of the dispersion. Since it has no requirement for using a great amount of dispersant and surface active agent as in the case of solid esters in the prior art, the slipping agent is excellent giving less effect on the output images.

The slipping agent which is solid at ordinary temperature and melting at 40 to 80° C. preferably contains at least one material selected from the group consisting of paraffin and fatty acid ester. Among them, liquid paraffin is preferred for paraffin, and monovalent fatty acid ester of monohydric alcohol and polyvalent fatty acid ester of monovalent alcohol are preferred for the fatty acid ester. Most preferred slipping agent is a monovalent fatty acid ester of polyhydric alcohol and polyvalent fatty acid ester of monohydric alcohol.

Preferred melting point is 43° C. or higher and 75° C. or lower and, more preferably, 45° C. or higher and 70° C. or lower and, further preferably, 50° C. or higher and 65° C. or lower.

1) Specific Example

Specific examples of the slipping agent having a permeating ratio to the transportation roller of 6% by mass or less and a melting point of 40 to 80° C. are shown below together with comparative examples with no particular restriction thereto.

| Comparative Compound | | Manufactured by Kensetsu Rubber Co. Permeating ratio against KSI-6000 |
|---|---|---|
| R-2 | KEIDOL WHITE MINERAL OIL manufactured by Witco Co. | 8.0% by mass |

Compound of the Present Invention

| | | |
|---|---|---|
| S-34 | Paraffin manufactured by Wako Junyaku mp 68–70° C. | 4.0% by mass |
| S-35 | $C_{15}H_{31}COOC_{18}H_{37}$ | 5.4% by mass |
| S-36 | $C_{17}H_{35}COOC_{18}H_{37}$ | 4.0% by mass or lower |
| S-37 | $C_{21}H_{43}COOC_{22}H_{45}$ | 4.0% by mass or lower |
| S-38 | $C_{16}H_{33}OCOCH_2CH_2COOC_{16}H_{33}$ | 4.0% by mass or lower |
| S-39 | $C_{16}H_{35}OCOCH_2CH_2COOC_{17}H_{35}$ | 4.0% by mass or lower |
| S-40 | 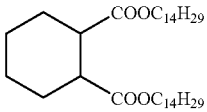 | 2.0% by mass or lower |
| S-41 | 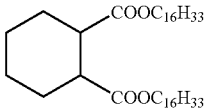 | 2.0% by mass or lower |
| S-42 | 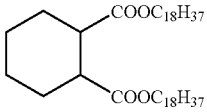 | 2.0% by mass or lower |
| S-43 | 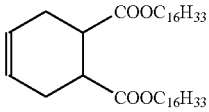 | 2.0% by mass or lower |
| S-44 | 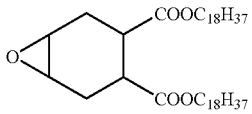 | 2.0% by mass or lower |
| S-45 | $CH_2—OCOC_{11}H_{21}$<br>\|<br>$CH—OCOC_{11}H_{21}$<br>\|<br>$CH_2—OCOC_{11}H_{21}$ | 2.0% by mass or lower |
| S-46 | $CH_2—OCOC_{17}H_{35}$<br>\|<br>$CH—OCOC_{17}H_{35}$<br>\|<br>$CH_2—OCOC_{17}H_{35}$ | 2.0% by mass or lower |
| S-47 | $CH_2—OCOC_{17}H_{35}$<br>\|<br>$HOCH_2—C—CH_2OH$<br>\|<br>$CH_2—OCOC_{17}H_{35}$ | 2.0% by mass or lower |
| S-48 | $CH_2—OCOC_{17}H_{35}$<br>\|<br>$C_{17}H_{35}COOCH_2—C—CH_2OCOC_{17}H_{35}$<br>\|<br>$CH_2—OCOC_{17}H_{35}$ | 2.0% by mass or lower |

The slipping agent having a melting point of 40 to 80° C. in the present invention can be used by adding, into a coating solution, an emulsified dispersion by emulsifying and dispersing the agent in an aqueous gelatin solution by using an anionic surface active agent such as sodium docecyl benzene sulfonate and sodium oleoyl methyl taurine. The emulsified dispersion can be prepared by a known method using, for example, homogenizer, dissolver, or Manton-Goulin emulsifying machine. In the emulsification dispersion, additives such as an auxiliary solvent and corrosion inhibitor may be used in addition to the surface active agent. In the present invention, it is preferred to emulsify without using the auxiliary solvent. The compound of the present invention has a low melting point and can be dispersed emulsification without using an auxiliary solvent at a temperature higher by 5° C. or more than the melting point. A preferred emulsification temperature in the present invention is within a range from a temperature higher by 5° C. or more than the melting point of the slipping agent to 85° C. The temperature is more preferably, within a range higher by 7° C. or more than the melting point and 75° C. or lower, further preferably, a temperature higher by 10° C. or more than the melting point and 65° C. or lower. As the compound of the present invention has a low melting point, and when an auxiliary solvent is not used, it can avoid problems such as fluctuation of particle size and formation of coarse particles which often causes problem for the aging stability of emulsification products.

<Fluoro Compound>

The photothermographic material according to the present invention preferably contains a fluoro compound having two or more of carbon atoms and having a fluoro alkyl group with a number of fluorine atoms of 13 or less. The fluoro compound of the present invention can be used as a surface active agent.

The fluoro compound used in the present invention may have any structure so long as it has the fluoro alkyl group as described above (alkyl group substituted with fluorine atom is hereinafter referred to as "Rf"), further, the fluoro compound may have at least one or more Rf and also have two or more of them.

Specific examples for Rf can include the following groups with no particular restriction thereto.

—$C_2F_5$ group, —$C_3F_7$ group, —$C_4F_9$ group, —$C_5F_{11}$ group, —$CH_2$—$C_4F_9$ group, —$C_4F_8$—H group, —$C_2H_4$—$C_4F_9$ group, —$C_4H_8$—$C_4F_9$ group, —$C_6H_{12}$—$C_4F_9$ group, —$C_8H_{16}$—$C_4F_9$ group, —$C_4H_8$—$C_2F_5$ group, —$C_4H_8$—$C_3F_7$ group, —$C_4H_8$—$C_5F_{11}$ group, —$C_8H_{16}$—$C_2F_5$ group, —$C_2H_4$—$C_4F_8$—H group, —$C_4H_8$—$C_4F_8$—H group, —$C_6H_{12}$—$C_4F_8$—H group, —$C_6H_{12}$—$C_2F_4$—H group, —$C_8H_{16}$—$C_2F_4$—H group, —$C_6H_{12}$—$C_4F_8$—$CH_3$ group, —$C_4H_4$—$C_3F_7$ group, —$C_2H_4$—$C_5F_{11}$ group, —$_4H_8$—$CF(CF_3)_2$ group, —$CH_2CF_3$ group, —$C_4H_8$—$CH(C_2F_5)_2$ group, —$C_4H_8$—$CH(CF_3)_2$ group, —$C_4H_8$—$C(CF_3)_3$ group, —$CH_2$—$C_4F_8$—H group, —$CH_2$—$C_6F_{12}$—H group, —$CH_2$—$C_6F_{13}$ group, —$C_2H_4$—$C_6F_{13}$ group, —$C_4H_8$—$C_6F_{13}$ group, —$C_6H_{12}$—$C_6F_{13}$ group, and —$C_8H_{16}$—$C_6F_{13}$ group, Rf has a number of fluorine atoms with a range of 13 or less, preferably, 12 or less and, more preferably, 3 to 11 and, further preferably, in a range from 5 to 9. Further, the number of carbon atoms is within a range of two or more, preferably, 4 to 16, more preferably, 5 to 12.

There is no particular restriction on the structure of Rf so long as it has two or more carbon atoms and 13 or less of fluorine atom and, it is preferably a group represented by the following general formula (A).

-Rc-Re—W General formula (A)

The fluoro compound according to the present invention more preferably has two or more fluoro alkyl group represented by the general formula (A).

Rc in the general formula (A) represents an alkylene group of 1 to 4 carbon atoms, preferably, within a range of carbon atoms of 1 to 3, more preferably, within a range of 1 to 2. The alkylene group represented by Rc may be linear or branched.

Re represents a perfluoro alkylene group of 2 to 6 carbon atoms, more preferably, a perfluoro alkylene group having 2 to 4 carbon atoms. The perfluoro alkylene group means alkylene groups where all of hydrogen atoms on the alkylene group are substituted with fluorine atoms. The perfluro alkylene group may be linear or, branched or have a cyclic structure.

W represents a hydrogen atom, fluorine atom or alkyl group, preferably, a hydrogen atom or fluoro atom. Fluorine atoms are particularly preferred.

The fluoro compound according to the present invention may also may have a cationic hydrophylic group.

The cationic hydrophilic group is those forming cations when dissolved in water. Specifically, it can include, for example, quaternary ammonium, alkyl pyridium, alkyl imidazolium and primary to tertiary aliphatic amines.

Preferred cations are organic cationic substituent, more preferably, organic cationic groups containing nitrogen or phosphorus atom. Further preferred are pyridium cation or ammonium cation.

Anion species forming salts may be inorganic anion or organic anion. Preferred inorganic anion is iodo ion, bromo ion and fluoro ion. Preferred organic anion can include, for example, p-toelenesulfonic acid ion, benzene sulfonic acid ion, methane sulfonic acid ion and trifluoromethane sulfonic acid ion.

Preferred cationic fluoro compound in the present invention is represented by the following general formula (1).

General formula (1)

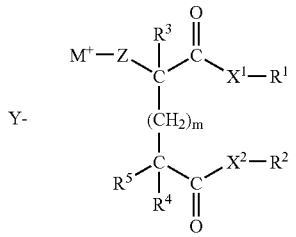

In the formula, $R^1$ and $R^2$ each represents independently a substituted or unsubstituted alkyl group, and at least one of $R^1$ and $R^2$ is the fluoro alkyl group (Rf) described above. It is preferred that both of $R^1$ and $R^2$ are Rf. $R^3$, $R^4$, and $R^5$ each represents independently a hydrogen atom or a substituent, $X^1$, $X^2$ and Z each represents independently a bivalent connection group or single bond, and $M^+$ represents a cationic substituent. $Y^-$ represents a pair anion but $Y^-$ may be saved in a case where static charges are 0 in the molecule. m is 0 or 1.

In the general formula (1), in a case where $R^1$ and $R^2$ each represents independently a substituted or unsubstituted alkyl group other than Rf, the alkyl group has one or more carbon atoms and may be in a linear, branched or cyclic structure. The substituent can include, for example, halogen atom, alkenyl group, aryl group, alkoxyl group, halogen atom other than fluorine, carbonate ester group, carbonamide group, carbamoyl group, oxycarbonyl group and phosphate ester group.

In a case where $R^1$ or $R^2$ represents an alkyl group other than Rf, that is, an alkyl group not substituted with a fluorine atom, the alkyl group is a substituted or unsubstituted alkyl group of 1 to 24 carbon atoms, more preferably, a substituted or unsubstituted alkyl group with a number of carbon atoms of 6 to 24. Preferred examples of the non-substituted alkyl group having 6 to 24 carbon atoms can include, for example, n-hexyl group, n-heptyl group, n-octyl group, tert-octyl group, 2-ethylhexyl group, n-nonyl group, 1,1,3-trimethylhexyl group, n-decyl group, n-dodecyl group, cetyl group, hexadecyl group, 2-hexyldecyl group, octadecyl group, eicosyl group, 2-octyldodecyl group, docosyl group, tetracosyl group, 2-decyltetradecyl group, tricosyl group, cyclohexyl group, and cycloheptyl group. Further, preferred examples of the alkyl group having a substituent with the number of total carbon atoms of 6 to 24 can include, for example, 2-hecenyl group, oleyl group, linoleyl group, linolenyl group, benzyl group, β-phenetyl group, 2-methoxyethyl group, 4-phenylbutyl group, 4-acetoxyethyl group, 6-phenoxyhexyl group, 12-phenyldodecyl group, 18-phenyloctadecyl group, 12-(p-chlorophenyl)dodecyl group and 2-(diphenyl phosphate) ethyl group.

The alkyl group other than Rf represented independently in $R^1$ and $R^2$ is, further preferably, a substituted or unsubstituted alkyl group of 6 to 18 carbon atoms. Preferred examples of the unsubstituted alkyl group of 6 to 18 carbon atoms can include, for example, n-hexyl group, cyclohexyl group, n-heptyl group, n-octyl group, 2-ethylhexyl group, n-nonyl group, 1,1,3-trimethylhexyl group, n-decyl group, n-dodecyl group, cetyl group, hexadecyl group, 2-hexyldecyl group, octadecyl group, and 4-tert-butylcyclohexyl group. Further, preferred examples of the substituted alkyl group having substituent of 6 to 18 carbon atoms in total can include, for example, phenetyl group, 6-phenoxyhexyl group, 12-phenyldodecyl group, oleyl group, linoleyl group, and linolenyl group.

The alkyl group other than Rf represented by each of $R^1$ and $R^2$ is, particularly preferably, n-hexyl group, cyclohexyl group, n-heptyl group, n-octyl group, 2-ethylhexyl group, n-nonyl group, 1,1,3-trimethylhexyl group, n-decyl group, n-dodecyl group, cetyl group, hexadecyl group, 2-hexyldecyl group, octadecyl group, oleyl group, linoleyl group and linolenyl group and, most preferably, linear, cyclic or branched unsubstituted alkyl group with 8 to 16 carbon atoms.

In the general formula (1), $R^3$, $R^4$ and $R^5$ each represents independently a hydrogen atom or a substituent. The substituent is, for example, an alkyl group (alkyl group preferably of 1 to 20 carbon atoms, more preferably, 1 to 12 carbon atoms and, particularly preferably, 1 to 8 carbon atoms, for example, methyl group, ethyl group, isopropyl group, tert-butyl group, n-octyl group, n-decyl group, n-hexadecyl group, cyclopropyl group, cyclopentyl group and cyclohexyl group), alkenyl group (preferably alkenyl group of 2 to 20 carbon atoms, more preferably, 2 to 12 carbon atoms and, particularly preferably, 2 to 8 carbon atoms and can include, for example, vinyl group, allyl group, 2-butenyl group, and 3-pentenyl group), alkynyl group (alkynyl group preferably of 2 to 20 carbon atoms, more preferably, of 2 to 12 carbon atoms and, particularly preferably, 2 to 8 carbon atoms and can include, for example, propalgyl group and 3-pentynyl group, aryl group (aryl group preferably having 6 to 30 carbon atoms, more preferably, 6 to 20 carbon atoms and, particularly preferably, 6 to 12 carbon atoms and can include, for example, phenyl group, p-methylphenyl group, and naphthyl group), substituted or unsubstituted amino group (preferably, amino group of 0 to 20 carbon atoms, more preferably, 0 to 10 carbon atoms, particularly preferably 0 to 6 carbon atom and can include, for example, unsubstituted amino group, methylamino group, dimethylamino group, diethylamino group, and dibenzylamino group), alkoxy group (alkoxy group of preferably 1 to 20 carbon atoms, more preferably, 1 to 12 carbon atoms and, particularly preferably, 1 to 8 carbon atoms and can include, for example, methoxy group, ethoxy group, and butoxy group), aryloxy group (preferably, aryloxy group of 6 to 20 carbon atoms, more preferably, 6 to 16 carbon atoms and, particularly preferably, 6 to 12 aryloxy group, for example, phenyloxy group, and 2-naphthyloxy group), acyl group (acyl group preferably of 1 to 20 carbon atoms, more preferably, 1 to 16 carbon atoms and, particularly preferably, 1 to 12 carbon atoms, and can include, for example, acetyl group, benzoyl group, hormyl group, and pivaloyl group), alkoxycarbonyl group (alkoxycarbonyl group preferably of 2 to 20 carbon atoms, more preferably, 2 to 16 carbon atoms, and, particularly preferably, 2 to 12 carbon atoms, and can include, for example methoxycarbonyl group, and ethoxycarbonyl group), aryloxycarbonyl group (aryloxycarbonyl group preferably of 7 to 20 carbon atoms, more preferably, 7 to 16 carbon atoms, and particularly preferably, 7 to 10 carbon atoms and can include, for example, phenyloxycarbonyl group), and acyloxy group (acyloxy group of 2 to 20 carbon atoms, more preferably, 2 to 16 carbon atoms and, particularly preferably, of 2 to 10 carbon atoms and can include, for example, acetoxy group and benzoyloxy group), acylamino group (acylamino group preferably of 2 to 20 carbon atoms, more preferably, 2 to 16 carbon atoms and, particularly preferably, 2 to 10 carbon atoms and can include, for example, acetylamino group and benzoylamino group), alkoxycarbonylamino group (alkoxycarbonylamino group of preferably 2 to 20 carbon atoms, more preferably, 2 to 16 carbon atoms, and particularly preferably, 2 to 12 carbon atoms and can include, for example, methoxycarbonylamino group), aryloxycarbonylamino group (aryloxycarbonylamino group preferably of 7 to 20 carbon atoms, more preferably, of 7 to 16 carbon atoms and, particularly preferably, of 7 to 12 carbon atoms and can include, for example, phenyloxy carbonyl amino group), sulfonylamino group (sulfonylamino group, preferably, of 1 to 20 carbon atoms, more preferably, 1 to 16 carbon atoms, particularly preferably, 1 to 12 carbon atoms and can include, for example, methanesulfonylamino group, and benzenesulfonylamino group), sulfamoyl group (sulfamoyl group preferably of 0 to 20 carbon atoms, more preferably, 0 to 16 carbon atoms, particularly preferably, 0 to 12 carbon atoms and can include, for example, sulfamoyl group, methylsulfamoyl group, dimethylsulfamoyl group and phenylsulfamoyl group), carbamoyl group (carbamoyl group, preferably, 1 to 20 carbon atoms, more preferably, 1 to 16 carbon atoms, particularly preferably, of 1 to 12 carbon atoms and can include, for example, unsubstituted carbamoyl group, methylcarbamoyl group, diethylcarbamoyl group and phenylcarbamoyl group), alkylthio group (alkylthio group of preferably 1 to 20 carbon atoms, more preferably, 1 to 16 carbon atoms and, particularly preferably, 1 to 12 carbon atoms, for example, methylthio group, and ethylthio group), arylthio group (arylthio group of preferably 6 to 20 carbon atoms, more preferably, 6 to 16 carbon atoms and, particularly preferably 6 to 12 carbon atoms, for example, phenylthio group), sulfonyl group (preferably of 1 to 20 carbon atoms, more preferably, 1 to 16 carbon atoms, and particularly preferably, 1 to 12 carbon atoms, for example, mesyl group and tosyl group), sulfinyl group (sulfinyl group of preferably 1 to 20 carbon atoms, more preferably, 1 to 16 carbon atoms and, particularly preferably, 1 to 12 carbon atoms, for example, methane sulfinyl group and benzene sulfinyl group), ureido group (ureido group of preferably 1 to 20 carbon atoms, more preferably, 1 to 16 carbon atoms and, particularly preferably, 1 to 12 carbon atoms, for example, unsubstituted ureido group, methylureido group and phenylureido group), phosphoric amide group (phosphoric amide group of preferably 1 to 20 carbon atoms, more preferably, 1 to 16 carbon atoms and particularly preferably, 1 to 12 carbon atoms, for example, diethylphosphoric amide group, and phenylphosphoric amide group), hydroxy group, mercapto group, halogen atom (for example, fluorine atom, chlorine atom, bromine atom, and iodine atom), cyano group, sulfo group, carboxyl group, nitro group, hydroxamic acid group, sulfino group, hydrazino group, imino group, heterocyclic group (preferably heterocyclic group preferably of 1 to 30 carbon atoms and, more preferably, 1 to 12 carbon atoms, for example, heterocyclic group having hetero atom such as nitrogen atom, oxygen atom, sulfur atom, for example, imidazolyl group, pyridyl group, quinolyl group, furyl group, piperizyl group, morpholino group, benzooxazolyl group, benzimidazolyl group, and benzthiazolyl group), silyl group (silyl group of preferably 3 to 40 carbon atoms, more preferably, 3 to 30 carbon atoms and, particularly preferably, 3 to 24 carbon atoms, for example, trimethylsilyl group and triphenylsilyl group). The substituents described above may further be substituted. In a case where there are two or more substituents, they may be identical or different with each other. Further, they may be optionally bonded to form a ring.

$R^3$, $R^4$ and $R^5$ is each preferably alkyl group or hydrogen atom and, further preferably, a hydrogen atom.

In the formula, $X^1$ and $X^2$ each represents independently a bivalent connecting group or single bond. There is no particular restriction on the bivalent connection group, and it represents, preferably, an arylene group, —O—, —S—, or —$NR^{31}$— ($R^{31}$ represents a hydrogen atom or a substituent, and the substituent is identical with that of the example for the substituent represented by each of $R^3$, $R^4$ and $R^5$. $R^{31}$ is, preferably, an alkyl group, Rf described above or a hydrogen atom, the hydrogen atom being further preferred) each alone or a combination of them and, more preferably, —O—, —S—, or —$NR^3$—. $X^1$ and $X^2$ each is more preferably —O— or —$NR^{31}$— and, further preferably, —O— or —NH— and, particularly preferably, —O—.

In the formula, Z represents a bivalent connection group or single bond. There is no particular restriction on the bivalent connection group and it represents preferably an alkylene group, arylene group, —C(═O)—, —O—, —S—, —S(═O)—, —$S(=O)_2$— or —$NR^{32}$— ($R^{32}$ represents a hydrogen atom or a substituent and the substituent is identical with the example for the substituent represented by $R^3$, $R^4$ and $R^5$, $R^{32}$ is, preferably, an alkyl group or hydrogen atom and, more preferably, hydrogen atom) alone or as a combination of them, more preferably, alkylene group of 1 to 12 carbon atoms, arylene group of 6 to 12 carbon atoms, —C(=O)—, —O—, —S—, —S(=O)—, —S(=O)$_2$— or —NR$^{32}$— alone or as a combination of them. Z is more preferably, an alkylene group of 1 to 8 carbon atoms, —C(=O)—, —O—, —S—, —S(=O)—, —S(=O)$_2$— or —NR$^{32}$— alone or as a combination thereof and can include, for example,

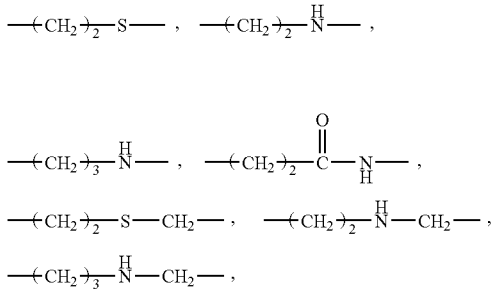

In the formula, M$^+$ represents a cationic substituent, and M$^+$ is preferably an organic cationic substituent, and more preferably, an organic cationic group containing nitrogen or phosphorus atom. It is further preferably, pyridinium cation or ammonium cation and, further preferably, a trialkyl ammonium cation represented by the following general formula (2).

General formula (2)

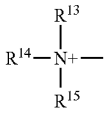

In the general formula, R$^{13}$, R$^{14}$ and R$^{15}$ each represents independently a substituted or unsubstituted alkyl group. As the substituent, those mentioned as the substituent for R$^3$, R$^4$ and R$^5$ can be applied. Further, R$^{13}$, R$^{14}$ and R$^{15}$ may be optionally bonded to each other to form a ring. R$^{13}$, R$^{14}$ and R$^{15}$ each represents preferably an alkyl group of 1 to 12 carbon atoms, more preferably, an alkyl group of 1 to 6 carbon atoms and, further preferably, methyl group, ethyl group or methylcarboxyl group and, particularly preferably, methyl group.

In the formula, Y$^-$ represents a pair anion which may be an inorganic anion or organic anion. Further, in a case where electric charges in the molecule are zero, Y$^-$ may be saved. The inorganic anion can include, preferably, iodo ion, bromo ion and chlorine ion. The organic anion can include, preferably, p-toluene sulfonic acid ion, benzene sulfonic acid ion, methane sulfonic acid ion, and trifluoro methane sulfonic acid ion. Y$^-$ is more preferably, iodo ion, p-toluene sulfonic acid ion, benzene sulfonic acid ion and, more preferably, p-toluene sulfonic acid ion.

In the formula, m is 0 or 1, and, preferably 0.

Among the compounds represented by the general formula (1) above, compounds represented by the following general formula (1-a) are preferred.

General formula (1-a)

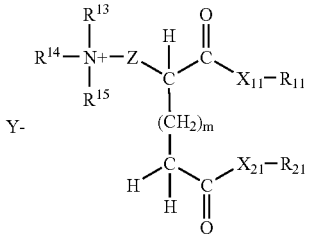

In the formula, R$^{11}$ and R$^{21}$ each represents independently a substituted or unsubstituted alkyl group in which at least one of R$^{11}$ and R$^{21}$ represents Rf described above and the total for the number of carbon atoms in R$^{11}$ and R$^{21}$ is 19 or less. R$^{13}$, R$^{14}$ and R$^{15}$ each represents independently a substituted or unsubstituted alkyl group which may be bonded to each other to form a ring. X$^{11}$ and X$^{21}$ each represents independently —O—, —S— or —NR$^{31}$— in which R$^{31}$ represents a hydrogen atom or a substituent, and Z represents a bivalent connection group or a single bond. While Y$^-$ represents a pair anion, Y$^-$ may not be present in a case where electric charges in the molecule are zero.

m is 0 or 1. In the formula, Z and Y$^-$ each has independently the same meanings as those in the general formula (1) above and a preferred range is also identical. R$^{13}$, R$^{14}$, R$^{15}$ and m each has the same meanings as those in the general formula (1), and a preferred range is also identical.

In the formula, X$^{11}$ and X$^{12}$ each represents independently —O—, —S— or —NR$^{31}$— (R$^{31}$ represents a hydrogen atom or a substituent. As the substituent, those mentioned as the substituent for R$^3$, R$^4$ and R$^5$ can be applied. R$^{31}$ is, preferably, an alkyl group, Rf described above, or hydrogen atom and, more preferably, a hydrogen atom. X$^{11}$ and X$^{21}$ are, more preferably, —O—, —NH— and, further preferably, —O—.

In the formula, R$^{11}$, and R$^{21}$ each has independently the same meanings as those for R$^1$ and R$^2$ in the general formula (1) and a preferred range is also identical. The total number of the carbon atoms in R$^{11}$ and R$^{21}$ is 19 or less. m is 0 or 1.

Specific examples for the compound represented by the general formula (1) above are described below but the present invention is not restricted at all by the following specific examples. In the expression for the structure of the compounds exemplified below, alkyl group and perfluoro alkyl group means each a linear structure unless otherwise specified particularly. Further, among the abbreviations in the expression, 2EH means 2-ethylhexyl.

FS-1

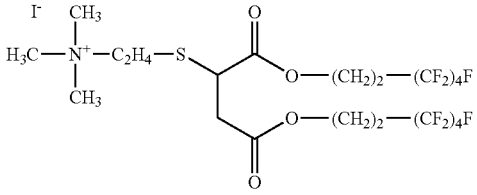

-continued
FS-2
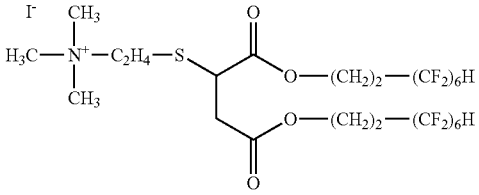
FS-3
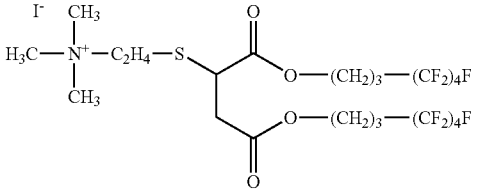
FS-4
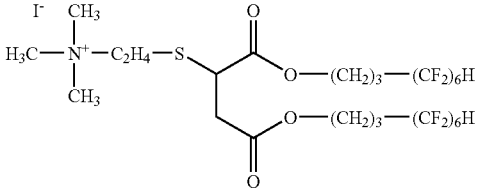
FS-5
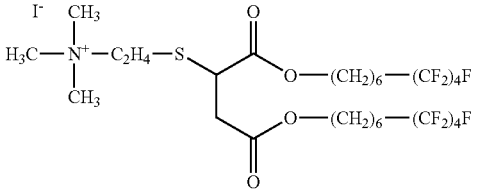
FS-6
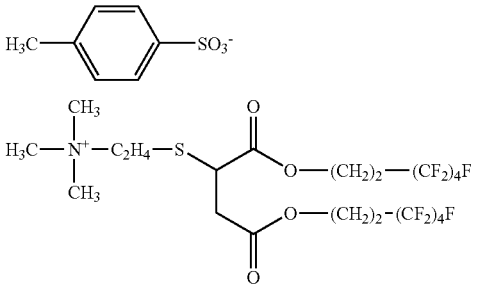
FS-7
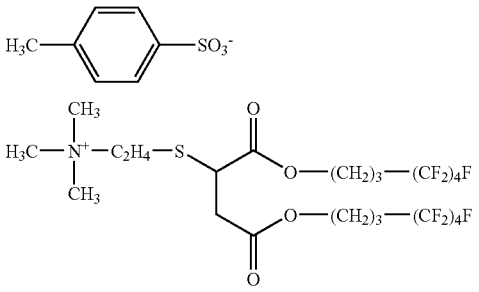
FS-8
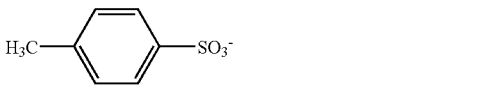
-continued
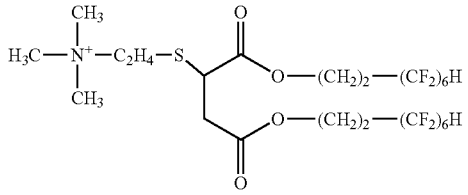
FS-9
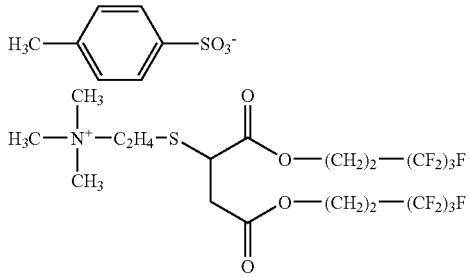
FS-10
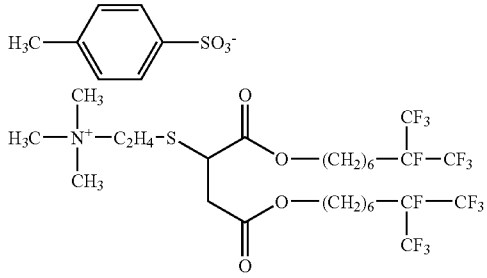
FS-11
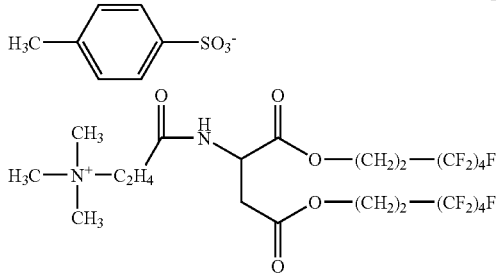
FS-12
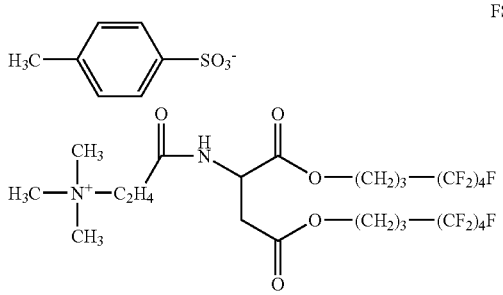
FS-13
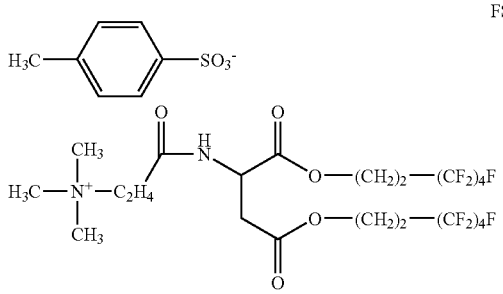

-continued
FS-14
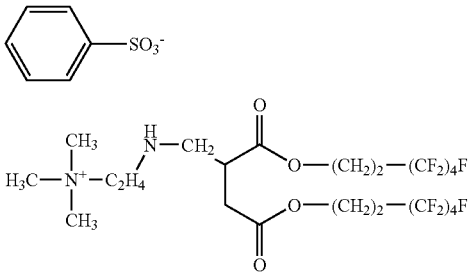
FS-15
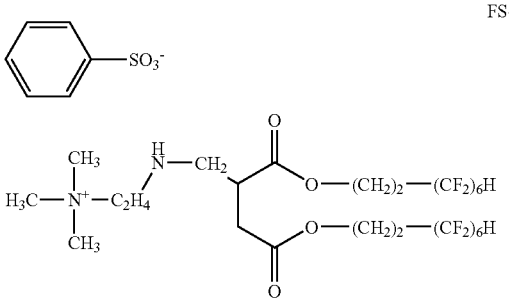
FS-16
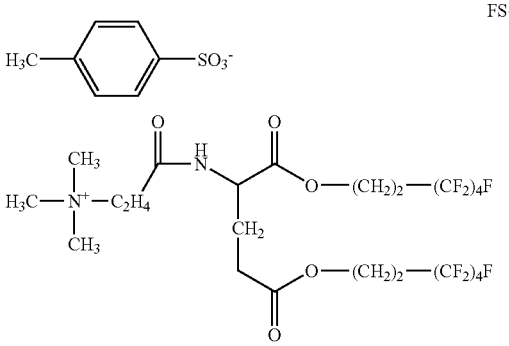
FS-17
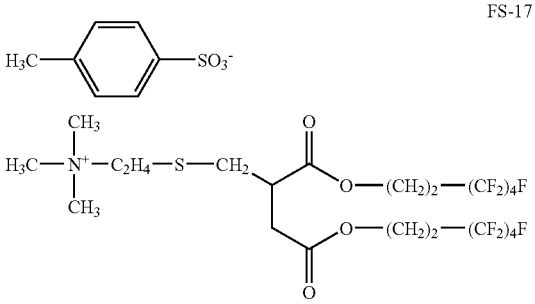
FS-18
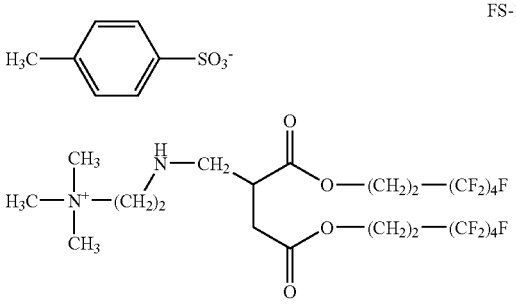
FS-19
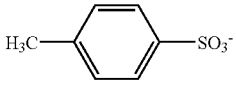
-continued
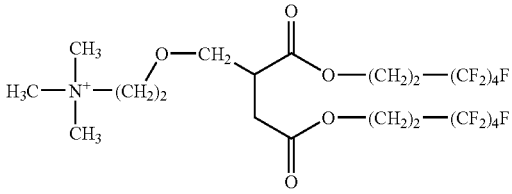
FS-20
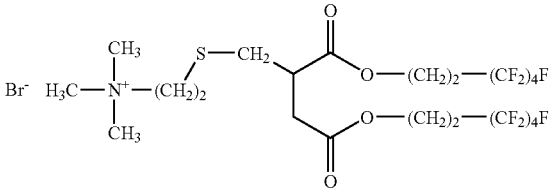
FS-21
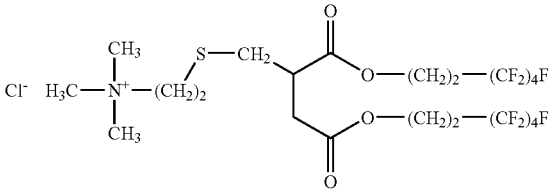
FS-22
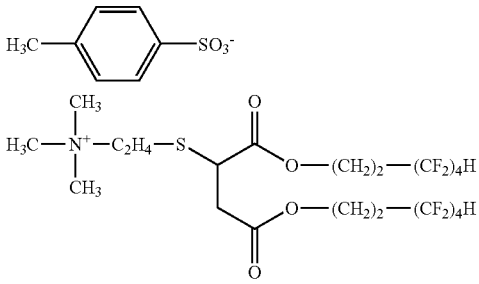
FS-23
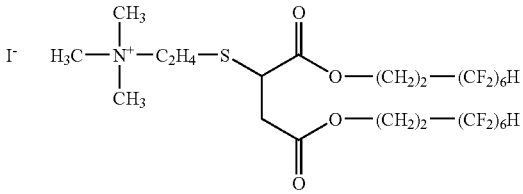
FS-24
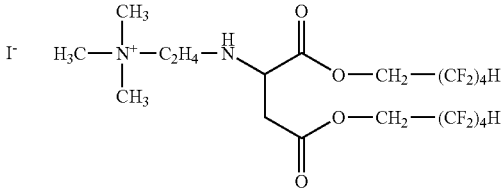
FS-25
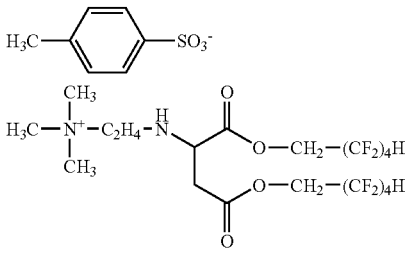

-continued
FS-26
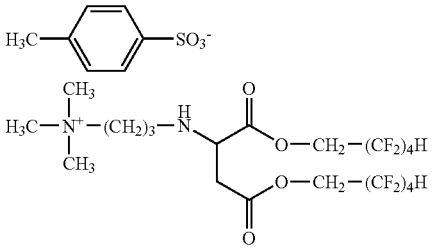
FS-27
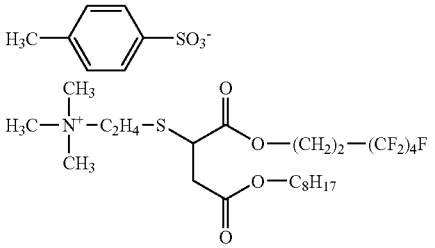
FS-28
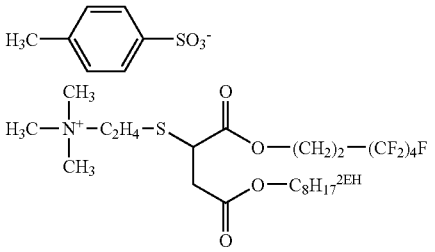
FS-29
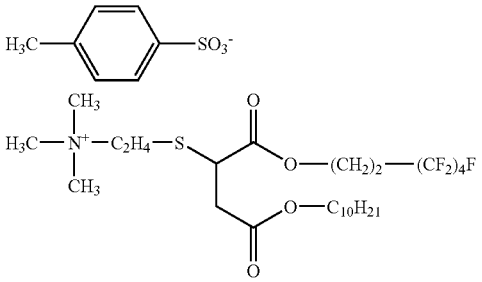
FS-30
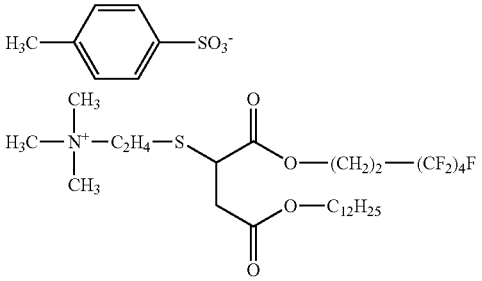
FS-31
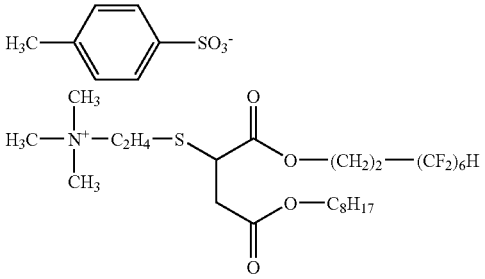
-continued
FS-32
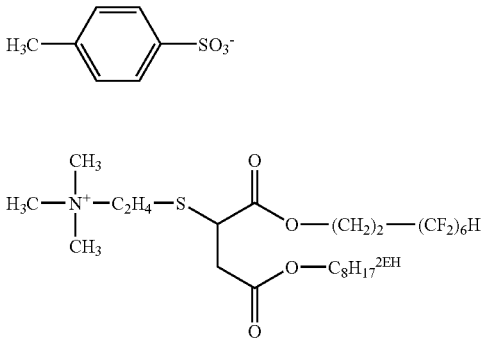
FS-33
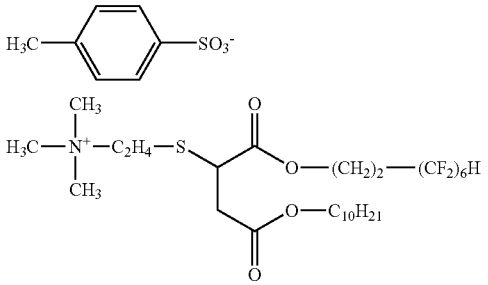
FS-34
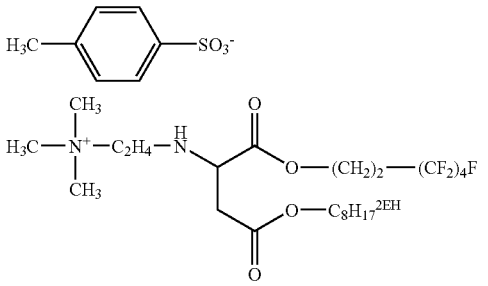
FS-35
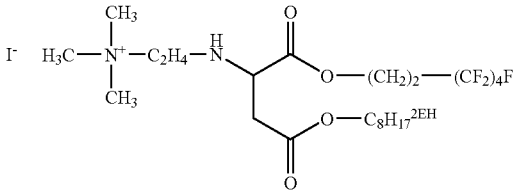
FS-36
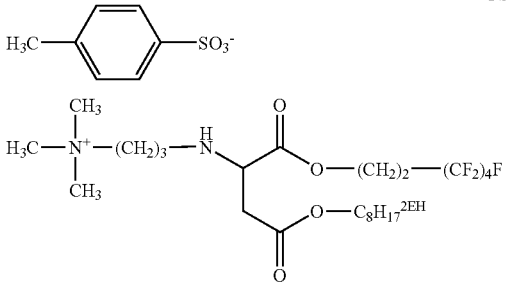
FS-37
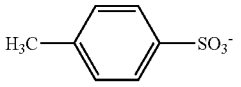

-continued
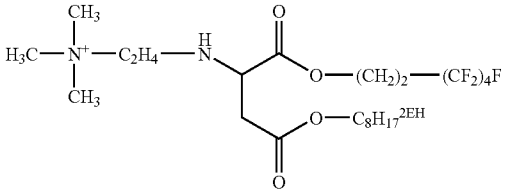
FS-38
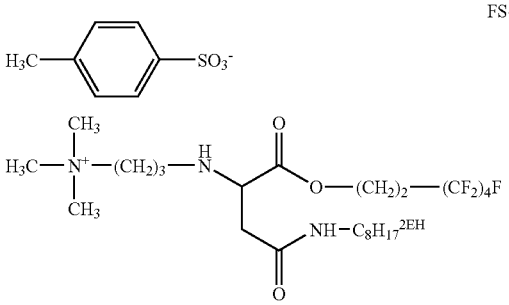
FS-39
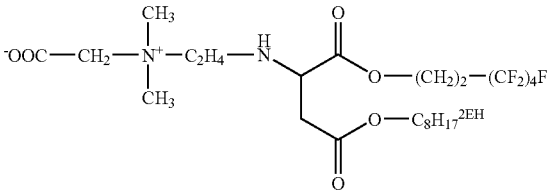
FS-40
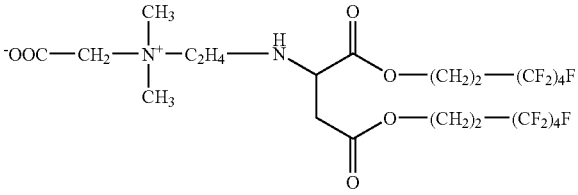
FS-41
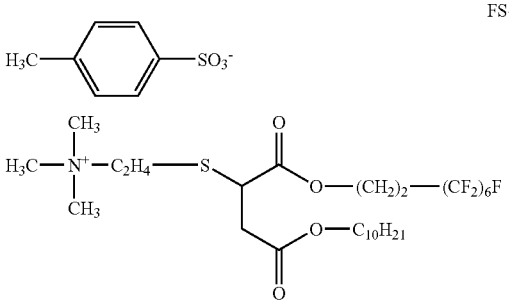
FS-42
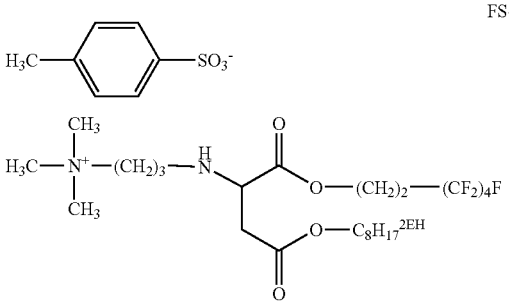
-continued
FS-43
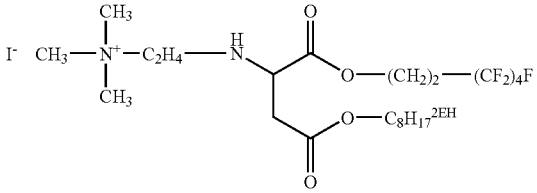
FS-44
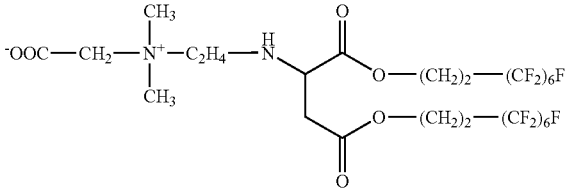
FS-45
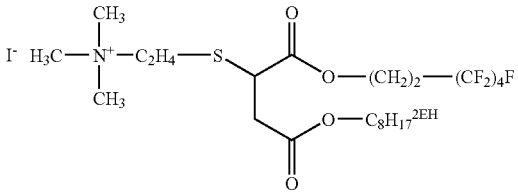
FS-46
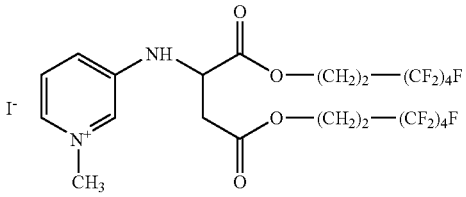
FS-47
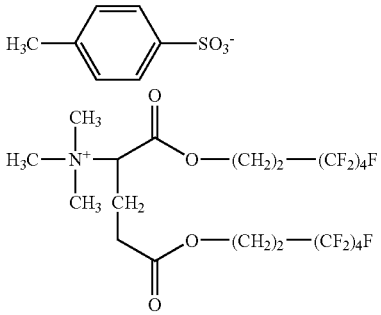
FS-48
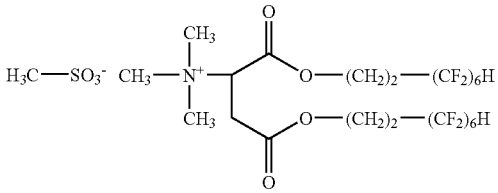

-continued
FS-49
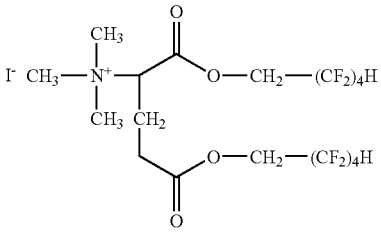
FS-50
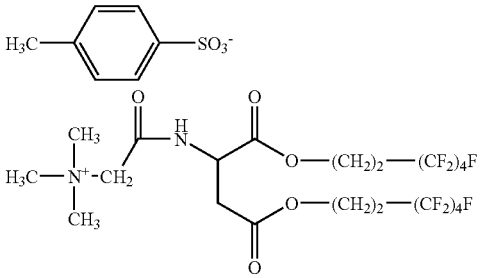
FS-51
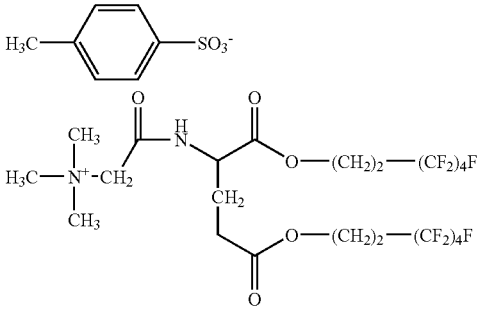
FS-52
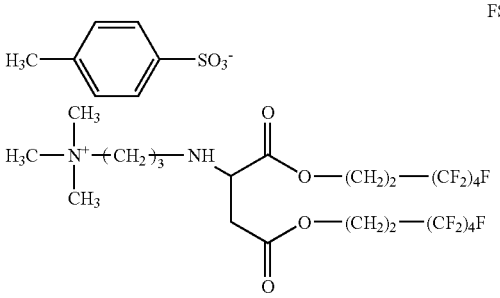
FS-53
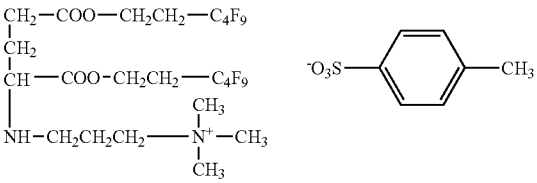
FS-54
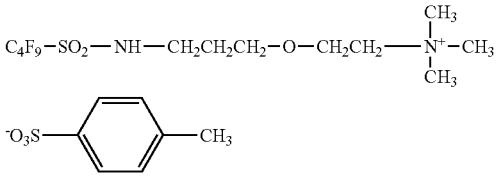
FS-55
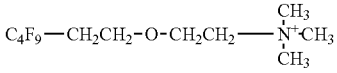
-continued
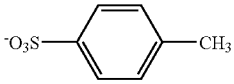
FS-56
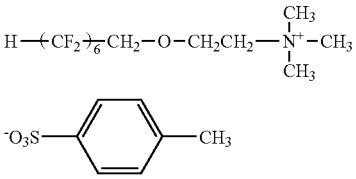
FS-57
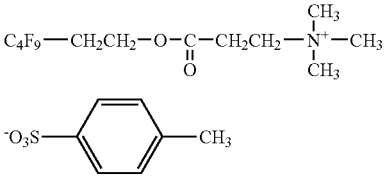
FS-58
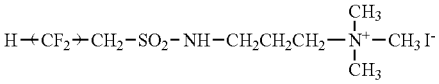
FS-59
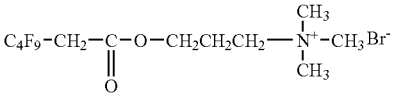
FS-60
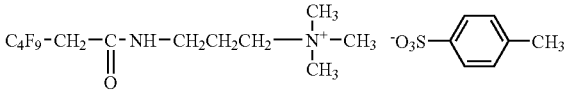
FS-61
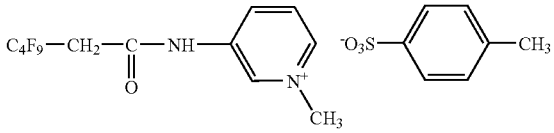
FS-62
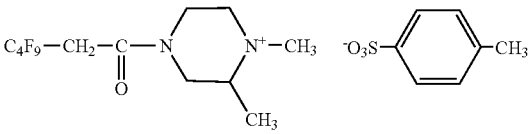
FS-63
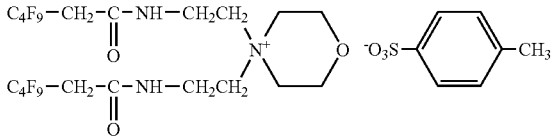
FS-64
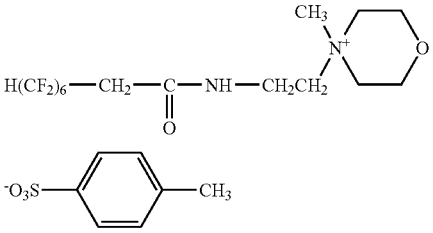

-continued

FS-65

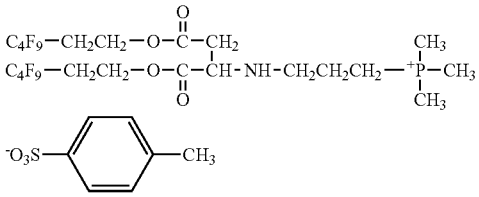

FS-66

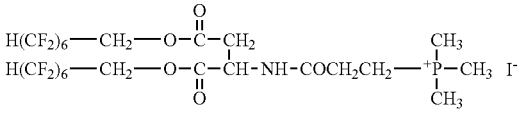

FS-67

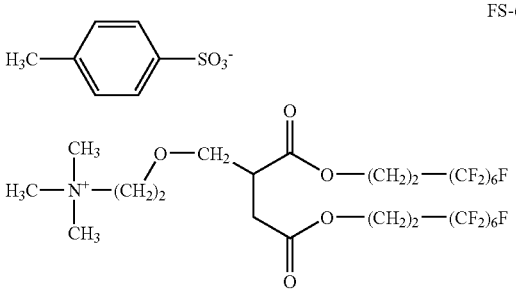

FS-68

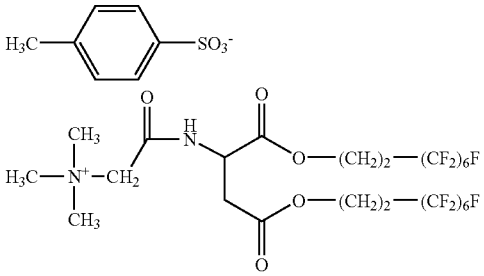

FS-69

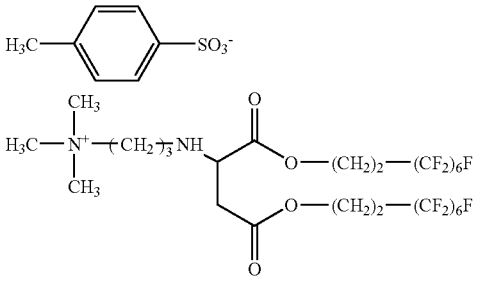

Then, an example of a general synthesis method for the compounds represented by the general formula (1), (1-a) of the present invention is to be shown below but the present invention is not restricted to them.

The compound of the present invention can be synthesized using fumaric acid derivative, maleic acid derivative, itaconic acid derivative, glutamic acid derivative, and aspartic acid derivative as the starting material. For example, in a case of using the fumaric acid derivative, maleic acid derivative and itaconic acid derivative as the starting material, the compound can be synthesized by taking place Michael addition reaction with nucleophilic species to the double bond therein and then conducting cationization with an alkylating agent.

The fluoro compound of the present invention may also have an anionic hydrophilic group.

The anionic hydrophilic group includes an acidic group with pKa of 7 or less and alkali metal salt or ammonium salt thereof. Specifically, it can include, for example, sulfo group, carboxyl group, phosphonic group, carbamoyl sulfamoyl group, sulfamoyl sulfamoyl group, acyl sulfamoyl group, and salts thereof. Among them, sulfo group, carboxyl group, phosphonic group and salts thereof are preferred and sulfonic group and salts thereof are more preferred. Cationic species forming salts can include, for example, lithium, sodium, potassium, cesium, ammonium, tetramethyl ammonium, tetrabutyl ammonium and methylpyridinium and, preferably, lithium, sodium, potassium and ammonium.

A preferred fluoro compound having the anionic hydrophilic group in the present invention is represented by the following general formula (3).

General formula 3

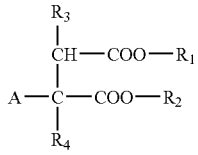

In the formula, $R^1$ and $R^2$ each represents independently an alkyl group in which at least one of them represents Rf. In a case where $R^1$ and $R^2$ each represents an alkyl group other than the fluoro alkyl group, an alkyl group of 2 to 18 carbon atoms is preferred and an alkyl group of 4 to 12 carbon atoms is more preferred. $R^3$ and $R^4$ each represents independently a hydrogen atom or a substituted or unsubstituted alkyl group.

The specific examples for the fluoro alkyl group represented by $R^1$ and $R^2$ can include, the fluoro alkyl group described above and a preferred structure is identical with the structure represented by general formula (A) described above. Further, a preferred structure among them is also identical with those described for the fluoro alkyl group. Each of the alkyl groups represented by $R^1$ and $R^2$ is preferably the fluoro alkyl group described above.

The substituted or unsubstituted alkyl group represented by $R^3$ and $R^4$ may have a linear, branched or cyclic structure. There is no particular restriction for the substituents, and alkenyl group, aryl group, alkoxy group, halogen atom (preferably Cl), carbonic acid ester group, carbonic amide group, carbamoyl group, oxycarbonyl group, and phosphate ester group are preferred.

A represents $L_b$-$SO_3M$ in which M represents a cation. The cation represented by M can preferably include, for example, alkali metal ion (lithium ion, sodium ion, potassium ion), alkaline earth metal ion (barium ion, calcium ion), and ammonium ion. Among them, more preferred are lithium ion, sodium ion, potassium ion or ammonium ion and, further preferred are lithium ion, sodium ion or potassium ion and can be selected properly depending on the total number of carbon atoms or the substituent and the degree of branching of the alkyl group of the compound according to the general formula (3). When M is lithium ion in a case where the total number of carbon atoms for $R^1$, $R^2$, $R^3$ and $R^4$ is 16 or more, it is excellent in view of the compatibility between solubility (particularly to water) and antistatic performance or uniformess of coating.

$L_b$ represents a single bond or a substituted or unsubstituted alkylene group. The substituent described for $R^3$ is preferred. In a case where $L_b$ is an alkylene group, the number of carbon atoms is preferably 2 or less. $L_b$ is preferably, a single bond or —$CH_2$— group and —$CH_2$— group is most preferred.

For the general formula (3) described above, it is preferred to bond respective preferred modes described above.

Specific examples of the fluoro compound having the anionic hydrophilic group according to the present invention are shown below but the present invention are not restricted at all by the following specific examples.

In the expression of the structure for the compounds exemplified below, alkyl group and perfluoroalkyl group mean each a linear structure unless otherwise specified particularly.

(F-1)

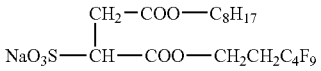

(F-2)

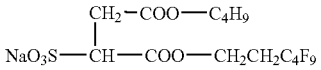

(F-3)

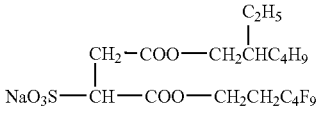

(F-4)

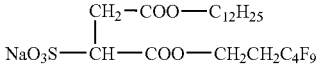

(F-5)

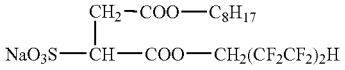

(F-6)

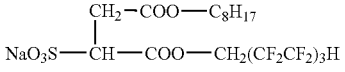

(F-7)

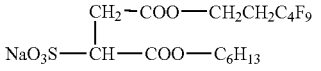

(F-8)

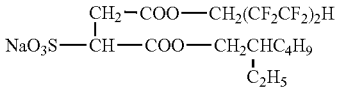

(F-9)

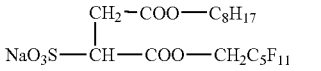

(F-10)

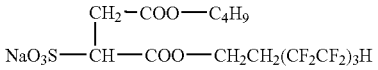

(F-11)

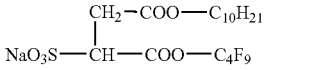

(F-12)

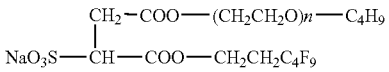

$n = 5\sim15$ (F-13)

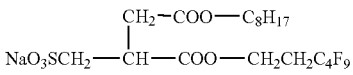

-continued (F-14)

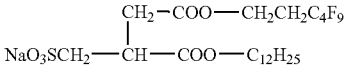

(F-15)

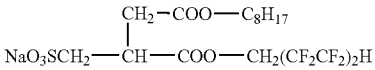

(F-16)

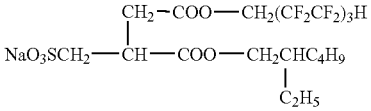

(F-17)

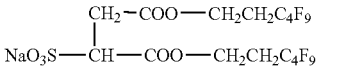

(F-18)

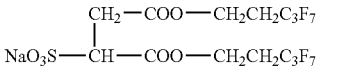

(F-19)

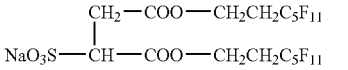

(F-20)

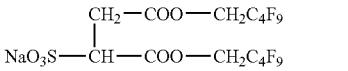

(F-21)

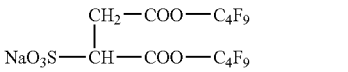

(F-22)

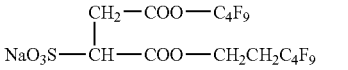

(F-23)

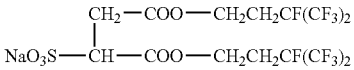

(F-24)

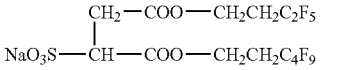

(F-25)

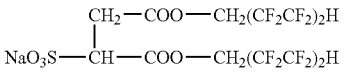

(F-26)

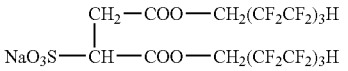

(F-27)

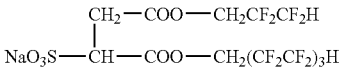

(F-28)

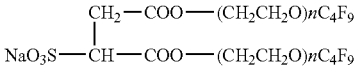

$n = 5\sim15$ (F-29)

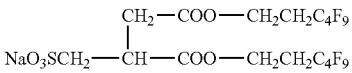

(F-30)

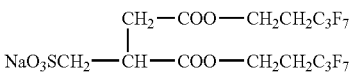

(F-31)

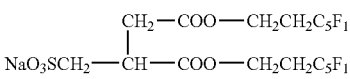

-continued
(F-32)
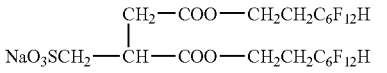
(F-33)
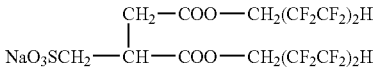
(F-34)
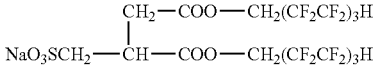
(F-35)
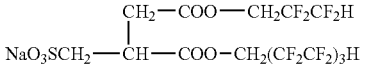
(F-36)
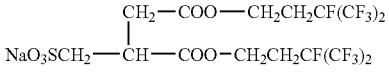
(F-37)
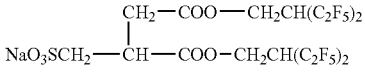
(F-38)
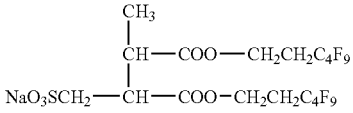
(F-39)
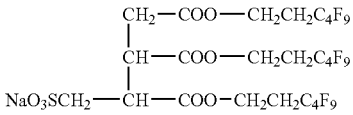
(F-40)
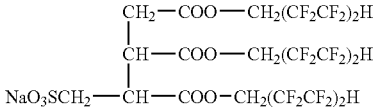
(F-41)
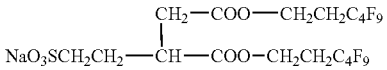
(F-42)
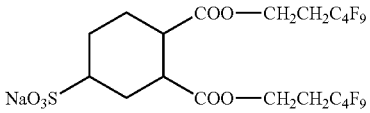
(F-43)
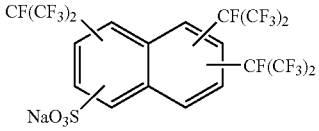
(F-44)
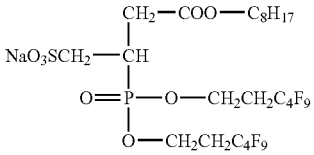
(F-45)
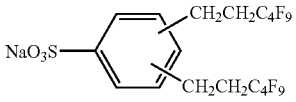
-continued
(F-46)
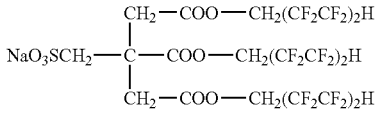
(F-47)
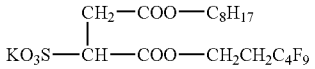
(F-48)
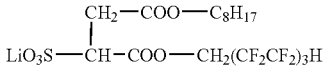
(F-49)
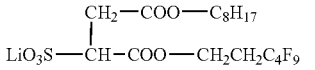
(F-50)
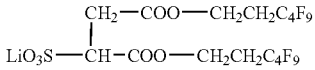
(F-51)
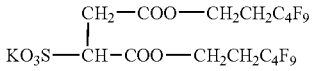
(F-52)
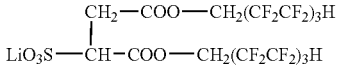
(F-53)
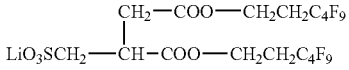
(F-54)
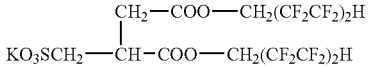
(F-55)
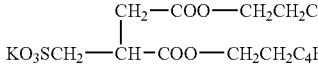
(F-56)
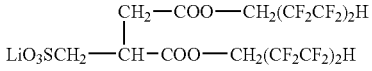
(F-57)
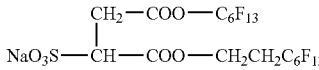
(F-58)
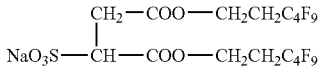
(F-59)
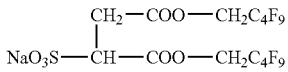
(F-60)
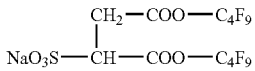
(F-61)
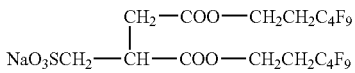
The fluoro compound of the present invention may have a nonionic hydrophilic group.
Nonionic hydrophilic group means a group soluble to water without dissociating into ions.
Specifically, poly(oxyethylene) alkyl ether or polyhydric alcohol may be mentioned but they are not restrictive.

In this invention, preferred nonionic fluoro compounds are represented by following general formula (4).

$$Rf—X—((CH_2)_n—O)_m—R \qquad \text{General formula (4)}$$

In the general formula (4), Rf is the fluoro alkyl group described above, specific examples for Rf can include those groups described above, and preferred structures are also identical with the structures represented by the general formula (A) described above. Further, preferred structures among them are also identical with those described for Rf.

X in the general formula (4) represents a bivalent connection group with no particular restriction and can include, for example,

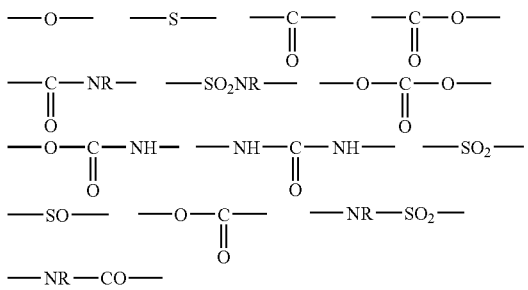

In the general formula (4), n is 2 or 3 and m represents an integer of 1 to 30. R is a hydrogen atom, alkyl group, aryl group, heterocyclic ring group and Rf, or a group having one or more Rf as the substituent.

Specific examples for the nonionic fluoro compound used in the present invention are exemplified below but the present invention is not restricted at all by the following specific examples.

FN-1

$C_4F_9CH_2CH_2O—(CH_2CH_2O)_n—H$ n = 5~15

FN-2

$H(CF_2)_6CH_2O—(CH_2CH_2O)_n—H$ n = 5~15

FN-3

$C_4F_9CH_2COO—(CH_2CH_2O)_n—H$ n = 5~15

FN-4

$C_4F_9CH_2CONH—(CH_2CH_2O)_n—H$ n = 5~15

FN-5

$C_4F_9CH_2SO_2NH—(CH_2CH_2O)_n—H$ n = 5 ~ 15

FN-6

$C_4F_9CH_2CH_2NHCOO—(CH_2CH_2O)_n—H$ n = 5~15

FN-7

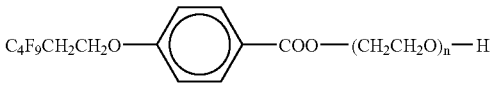

n = 5~15

FN-8

$H(CF_2)_4CH_2O—(CH_2CH_2CH_2O)_n—H$ n = 5~15

-continued

FN-9

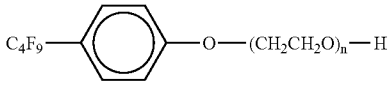

n = 5~15

FN-10

$C_4F_9CH_2CH_2O—(CH_2CH_2O)_{n1}—(CH_2CH_2CH_2O)_{n2}—(CH_2CH_2O)_{n3}—H$ n1 = 5~10
n2 = 5~10
n3 = 5~10

FN-11

$C_4F_9CH_2CH_2O—(CH_2CH_2O)_n—CH_3$ n = 10~20

FN-12

$C_4F_9CH_2CH_2O—(CH_2CH_2O)_n—C_4H_9$ n = 10~20

FN-13

$C_4F_9CH_2CH_2O—(CH_2CH_2O)_n—CH_2CH_2C_4F_9$ n = 10~20

FN-14

$CH_2COO—(CH_2CH_2O)_n—CH_2CH_2C_4F_9$
$CH_2COO—(CH_2CH_2O)_n—CH_2CH_2C_4F_9$ n = 5~10

FN-15

$CH_2COO—(CH_2CH_2O)_n—CH_2CH_2C_4F_9$
$CHCOO—(CH_2CH_2O)_n—CH_2CH_2C_4F_9$
$CH_2COO—(CH_2CH_2O)_n—CH_2CH_2C_4F_9$ n = 5~10

FN-16

$CH_2O—(CH_2CH_2O)_n—CH_2CH_2C_4F_9$
$CHO—(CH_2CH_2O)_n—CH_2CH_2C_4F_9$
$CH_2O—(CH_2CH_2O)_n—CH_2CH_2C_4F_9$ n = 5~10

FN-17

$H—C_6F_{12}CH_2O—(CH_2CH_2O)_n—CH_2C_6F_{12}—H$ n = 5 ~ 10

FN-18

$CH_2O—(CH_2CH_2O)_n—CH_2(CF_2)_4H$
$C_2H_5—C—CH_2O—(CH_2CH_2O)_n—CH_2(CF_2)_4H$
$CH_2O—(CH_2CH_2O)_n—CH_2(CF_2)_4H$ n = 5~10

FN-19

$C_6F_{13}CH_2CH_2O—(CH_2CH_2O)_n—H$ n = 5~15

FN-20

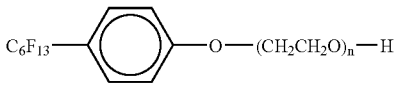

n = 5~15

FN-21

$C_6F_{13}CH_2CH_2O—(CH_2CH_2O)_n—CH_2CH_2C_6F_{13}$ n = 10~20

The compound having the specified fluoro alkyl group used in the present invention is used preferably as a surface active agent for the coating composition for forming a layer constituting the photosensitive material (particularly, protection layer, under coating layer, back layer, etc.). Among them, when it is used for the formation of the outermost layer of the photosensitive material, it is particularly preferred since effective antistatic performance and uniformess of coating can be obtained. Further, it has been found that the structure according to the present invention is effective for the improvement of the store stability and working circumstance dependence intended in the present invention. For obtaining the effect, it is preferred that the fluoro compound of the present invention is used for the outermost layer of the image forming layer surface or the back surface. Further, similar effect can also be obtained when it is used for the under coating layer of a support.

There is no particular restriction on the amount of using the specified fluoro compound in the present invention and the amount of use may be determined optionally in accordance with the structure of the fluoro compound used, a place where it is used, and kind or amount of other materials contained in the composition. For example, in a case where it is used as the coating solution for the outermost layer of the photothermographic material, the coating amount of the fluoro compound in the coating composition is, preferably, 0.1 $mg/m^2$ or more and 100 $mg/m^2$ or less and, more preferably, 0.5 $mg/m^2$ or more and 20 $mg/m^2$ or less.

In the present invention, a kind of the specified fluoro compound may be used alone or two or more kinds of the compounds may be used in admixture.

<Non-Photosensitive Organic Silver Salt>

1) Composition

The non-photosensitive organic silver salt usable in the present invention is relatively stable to light and it functions as a silver ion supplier in a case where it is heated at 80° C. or higher in the presence of an exposed photosensitive silver halide and a reducing agent, to form silver images. The organic silver salt may be any organic substance capable of supplying silver ions that can be reduced by a releasing agent. The non-photosensitive organic silver salt is described, for example, in JP-A No. 10-62899, in column Nos. 0048 to 0049, EP-A No. 0,803,764 A1, from page 18, line 24 to page 19, line 37, EP-A No. 0,962,812 A1, JP-A Nos. 11-349591, 2000-7683 and 2000-72711. Among them, silver salts of organic acids, particularly, silver salts of long chained aliphatic carboxylic acids (with number of carbon atoms of 10 to 30, preferably, 15 to 28) are preferred. Preferred examples of the fatty acid silver salts include, for example, silver lignocerate, silver behenate, silver arachidate, silver stearate, silver oleate, silver laurate, silver caproate, silver myristate, silver palmitate, silver erucate and mixtures thereof. In the present invention, it is preferred to use, among the fatty acid silver salts, a fatty acid silver salt with the silver behenate content of 50% by mole or more and 100% by mole or less, more preferably 85% by mole or more and 100% by mole or less, and further preferably 95% by mole or more and 100% by mole or less. Further, it is preferred to use a fatty acid silver salt with the silver erucate content of 2% by mole or less, more preferably, 1% by mole or less and, further preferably, 0.1% by mole or less.

Further, the silver stearate content is, preferably, 1% by mole or less. A silver salt of an organic acid with low Dmin, at high sensitivity and excellent in image storability can be obtained when the silver stearate content is 1% by mole or less. The stearic acid content is preferably 0.5% by mole or more and it is particularly preferred not to substantially contain the same.

Further, in a case where silver arachidate is contained as the organic acid silver salt, it is preferred that the silver arachidate content is 6% by mole or less for obtaining low Dmin and obtaining an organic acid silver salt excellent in image storability, and it is further preferably 3% by mole or less.

2) Shape

There is no particular restriction on the shape of the organic silver salt usable in the present invention and it may be any of needle-like, bar-like, plate-like or flaky shape.

In the present invention, a flaky organic silver salt is preferred. Short needle-like, rectangular, cuboidal or potato-like indefinite shaped particle with the major axis to minor axis ratio being less than 5 is also used preferably. Such organic silver particle has a feature of less suffering from fogging during heat development compared with long needle-like particles with the major axis to minor axis length ratio of 5 or more. Particularly, a particle with the major axis to minor axis ratio of 3 or less is preferred since it can improve the mechanical stability of the coating film. In the present specification, the flaky organic silver salt is defined as described below. When an organic acid silver salt is observed under an electron microscope, calculation is made while approximating the shape of an organic acid silver salt particle to a rectangular body and assuming each side of the rectangular body as a, b, c from the shorter side (c may be identical with b) and determining x based on numerical values a, b for the shorter side as below.

$$x=b/a$$

As described above, when x is determined for the particles by the number of about 200, those capable of satisfying the relation: x (average)≧1.5, x being an average value, is defined as a flaky shape. The relation is preferably: 30≧x (average)≧1.5 and, more preferably, 15≧x (average)>1.5. By the way, needle-like shape is expressed as 1≦x (average) <1.5.

In the flaky particle, a can be regarded as a thickness of a plate particle having a main plate with b and c being as the sides. a is, preferably, 0.01 μm or more and 0.3 μm or less and, more preferably, 0.1 μm or more and 0.23 μm or less in average. c/b is, preferably, 1 or more and 9 or less, more preferably, 1 or more and 6 or less and, further preferably, 1 or more and 4 or less and, most preferably, 1 or more and 3 or less in average.

When the sphere-equivalent diameter is defined as 0.05 μm or more and 1 μm or less, coagulation less occurs in the photosensitive material to improve the image storability. The sphere-equivalent diameter is, preferably, 0.1 μm or more and 1 μm or less. In the present invention, the sphere-equivalent diameter is determined by a measuring method of photographing a sample directly by using an electron microscope and then applying imaging processing to a negative film.

In the flaky particle, the sphere-equivalent diameter/a of the particle is defined as an aspect ratio. The aspect ratio of the flaky particle is, preferably, 1.1 or more and 30 or less and, more preferably, 1.1 or more and 15 or less with a view point that coagulation less occurs in the photosensitive material and the image storability is improved.

The particle size distribution of the organic silver salt is preferably mono-dispersion. The mono-dispersion means that the percentages of a values obtained by dividing standard deviations of the lengths of the shorter axis and the longer axis by the lengths of the shorter axis and the longer axis, respectively, are preferably 100% or less, more preferably 80% or less, and further preferably 50% or less. The shape of the organic silver salt can be measured from an image the organic silver salt dispersion observed with a transmission electron microscope. As another method for measuring the mono-dispersion property, it can be measured from a standard deviation of a volume weighted average particle diameter of the organic silver salt, and a percentage of a value obtained by dividing the standard deviation by the volume weighted average particle diameter (i.e., variation coefficient) is preferably 100% or less, more preferably 80% or less, and further preferably 50% or less. The measurement may be carried out, for example, in such a manner that an organic silver salt dispersed in a liquid is irradiated with laser light, an autocorrelation function of the wobble of the scattered light with respect to time-rate-of-change is obtained to calculate the particle size (the volume weighted average particle diameter), from which the mono-dispersion property is obtained.

3) Preparation

For the production of the organic acid silver salts used in the present invention and the dispersion method thereof, known methods can be applied. Reference can be made, for example, to JP-A No. 10-62899, EP-A Nos. 0,803,763 A1 and 0,962,812 A1, JP-A Nos. 11-349591, 2000-7683, 2000-72711, 2001-163889, 2001-163890, 2001-163827, 2001-033907, 2001-188313, 2001-083652, 2002-006442,2002-49117, 2002-031870, and 2002-107868 described above.

When the photosensitive silver salt is present together upon dispersion of the organic silver salt, since fogging increases to remarkably lower the sensitivity, it is more preferred not to substantially contain the photosensitive silver salt during dispersion. In the present invention, the amount of the photosensitive silver salt in the aqueous dispersion to which it is dispersed is, preferably, 1% by mole or less, more preferably, 0.1% by mole or less based on 1 mol of the organic acid silver salt in the liquid and, more preferably, the photosensitive silver salt is not added positively.

In the present invention, the photosensitive material can be produced by mixing an aqueous dispersion of an organic silver salt and an aqueous dispersion of a photosensitive silver salt, in which the mixing ratio between the organic silver salt and the photosensitive silver salt can be selected depending on the purpose. The ratio of the photosensitive silver salt to the organic silver salt is, preferably, within a range from 1% by mole or more to 30% by mole or less and, further, preferably, from 2% by mole or more to 20% by mole or less and, particularly preferably, within a range from 3% by mole or more to 15% by mole or less. Mixing of two or more kinds of the aqueous dispersions of organic silver salts and two or more kinds of aqueous dispersions of the photosensitive silver salts upon mixing is a method used preferably for controlling the photographic properties.

4) Addition Amount

The organic silver salt used in the present invention can be used at a desired amount and it is within a range, preferably, from 0.1 $g/m^2$ or more to 5.0 $g/m^2$ or less, more preferably, from 0.3 $g/m^2$ or more to 3.0 $g/m^2$ or less and, further preferably, from 0.5 $g/m^2$ or more to 2.0 $g/m^2$ or less as the total coating amount of silver including silver halide. Particularly, for improving the image storability, it is preferred that the total coating amount of silver is 1.8 $g/m^2$ or less and, more preferably, 1.6 $g/m^2$ or less. When the preferred reducing agent in the present invention is used, sufficient image density can be obtained even at such a low silver content.

<Reducing Agent>

The photothermographic material according to the present invention preferably contains a heat developing agent as a reducing agent for the organic silver salt. The reducing agent for the organic silver salt may be any substance (preferably, organic substance) capable of reducing silver ion into metal silver. Examples of the reducing agent described above are described in JP-A No. 11-65021 in column Nos. 0043–0045, and EP-A No. 0,803,764 A1, from page 7, line 34 to page 18, line 12.

In the present invention, the reducing agent is, preferably, a so-called hindered phenolic reducing agent or a bisphenolic reducing agent having a substituent on the ortho-position to the phenolic hydroxyl group, and the compound represented by the following general formula (R) is more preferred.

General formula (R)

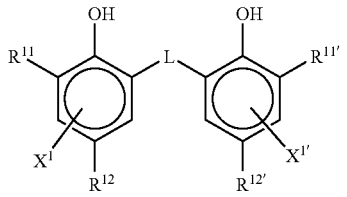

In the general formula (R), $R^{11}$ and $R^{11'}$ each represents independently an alkyl group of 1 to 20 carbon atoms. $R^{12}$ and $R^{12'}$ each represents independently a hydrogen atom or a substituent capable of substitution on the benzene ring. L represents —S— group or —$CHR^{13}$— group. $R^{13}$ represents a hydrogen atom or an alkyl group of 1 to 20 carbon atoms. $X^1$ and $X^{1'}$ each represents independently a hydrogen atom or a group capable of substitution on the benzene ring.

The general formula (R) is to be described specifically.

1) $R^{11}$ and $R^{11'}$ $R^{11}$ and $R^{11'}$ each represents independently a substituted or unsubstituted alkyl group of 1 to 20 carbon atoms. While there is no particular restriction on the substituent of the alkyl group, it can preferably include, for example, aryl group, hydroxyl group, alkoxy group, aryloxy group, alkylthio group, arylthio group, acylamino group, sulfoneamide group, sulfonyl group, phosphoryl group, acyl group, carbamoyl group, ester group, ureido group, urethane group and halogen atom.

2) $R^{12}$ and $R^{12'}$, $X^1$ and $X^{1'}$ $R^{12}$ and $R^{12'}$ each independently represents a hydrogen atom or a substituent capable of substitution on the benzene ring, and $X^1$ and $X^{1'}$ also represents each independently a hydrogen atom or a group capable of substitution on the benzene ring. Respective groups capable of substitution on the benzene ring can include, preferably, an alkyl group, aryl group, halogen atom, alkoxy group and acylamino group.

3) L

L represents —S— group or —$CHR^{13}$— group. $R^{13}$ represents a hydrogen atom or an alkyl group of 1 to 20 carbon atoms and the alkyl group may have a substituent. Specific examples of the unsubstituted alkyl group of $R^{13}$ can include, for example, methyl group, ethyl group, propyl group, butyl group, heptyl group, undecyl group, isopropyl group, 1-ethylpentyl group, and 2,4,4-trimethylpentyl group. Examples of the substituent for the alkyl group can include the same substituents as those for $R^{11}$ and can include, for example, a halogen atom, alkoxy group, alkylthio group, aryloxy group, arylthio group, acylamino group, sulfoneamide group, sulfonyl group, phospholyl group, oxycarbonyl group, carbamoyl group and sulfamoyl group.

4) Preferred Substituent $R^{11}$ and $R^{11'}$ can include each, preferably, a secondary or tertiary alkyl group of 3 to 15 carbon atoms and, specifically, isopropyl group, isobutyl group, t-butyl group, t-amyl group, t-octyl group, cyclohexyl group, cyclopentyl group, 1-methylcyclohexyl group, and 1-methylcyclopropyl group. $R^{11}$ and $R^{11'}$ are, more preferably, tertiary alkyl groups of 4 to 12 carbon atoms. Among them, t-butyl group, t-amyl group and 1-methylcyclohexyl group are further preferred, with t-butyl group being most preferred.

$R^{12}$ and $R^{12'}$ can include, preferably, alkyl groups of 1 to 20 carbon atoms and, specifically, include methyl group, ethyl group, propyl group, butyl group, isopropyl group, t-butyl group, t-amyl group, cyclohexyl group, 1-methylcyclohexyl group, benzyl group, methoxymethyl group, and methoxyethyl group. They are, more preferably, methyl group, ethyl group, propyl group, isopropyl group, and t-butyl group. $X^1$ and $X^{1'}$ can include, preferably, a hydrogen atom, halogen atom and alkyl group and, more preferably, hydrogen atom.

L is preferably —$CHR^{13}$— group.

$R^{13}$ is, preferably, a hydrogen atom or an alkyl group of 1 to 15 carbon atoms, and the alkyl group is, preferably, a methyl group, ethyl group, propyl group, isopropyl group, and 2,4,4-trimethylpentyl group. Particularly preferred $R^{13}$ is a hydrogen atom, methyl group, ethyl group, propyl group or isopropyl group.

In a case where $R^{13}$ is a hydrogen atom, $R^{12}$ and $R^{12'}$ can include, preferably, alkyl groups of 2 to 5 carbon atoms. Ethyl group or propyl group is more preferred, with ethyl group being most preferred.

In a case where $R^{13}$ is a primary or secondary alkyl group of 1 to 8 carbon atoms, $R^{12}$ and $R^{12'}$ can include, preferably, methyl group. As a primary or secondary alkyl group of 1 to 8 carbon atoms for $R^{13}$, a methyl group, ethyl group, propyl group and isopropyl group are more preferred and methyl group, ethyl group, and propyl group are further preferred.

In a case where each of $R^{11}$, $R^{11'}$, $R^{12}$ and $R^{12'}$ is a methyl group, $R^{13}$ is, preferably, a secondary alkyl group. The secondary alkyl group for $R^{13}$ is, preferably, an isopropyl group, isobutyl group, and 1-ethylpentyl group, with isopropyl group being more preferred.

The reducing agent described above has different heat developability and color tone of developed silver depending on the combination of $R^{11}$, $R^{11'}$, $R^{12}$, $R^{12'}$ and $R^{13}$. Since they can be controlled by the combination of two or more kinds of reducing agents, it is preferred to use two or more of them in combination depending on the purpose.

Specific examples of the reducing agent including the compounds represented by the general formula (R) in the present invention are to be shown below but the present invention is not restricted to them.

(R-1)

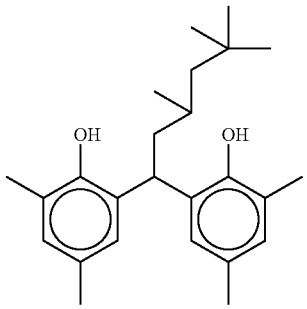

(R-2)

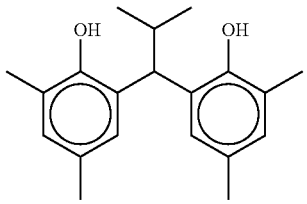

(R-3)

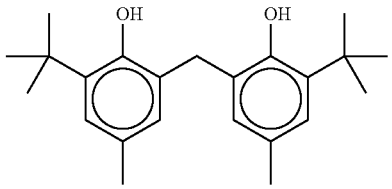

(R-4)

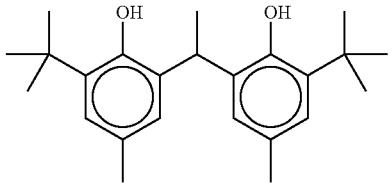

(R-5)

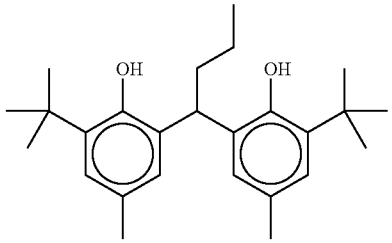

(R-6)

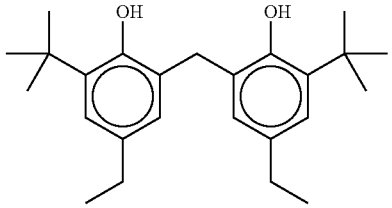

(R-7)

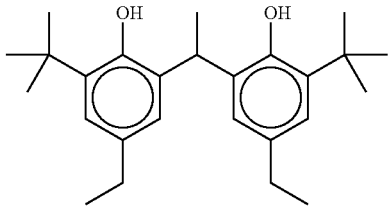

-continued (R-8)

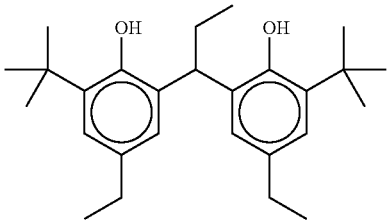

(R-9)

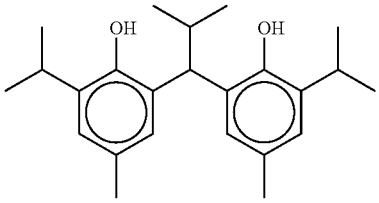

(R-10)

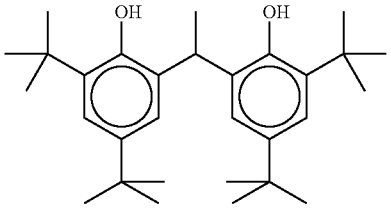

(R-11)

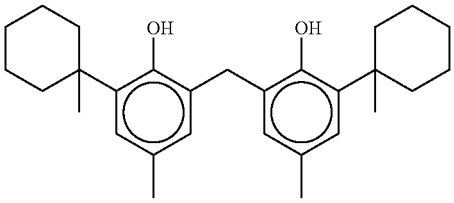

(R-12)

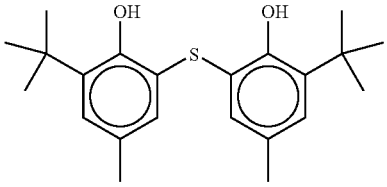

(R-13)

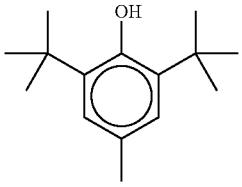

(R-14)

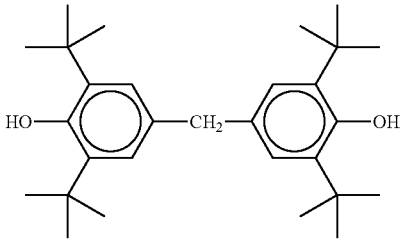

-continued (R-15)

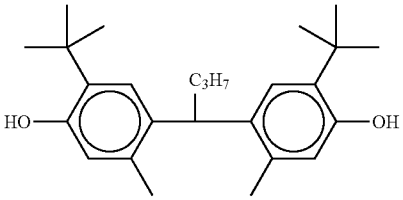

Other examples of preferred reducing agent in the present invention than described above are compounds described in JP-A Nos. 2001-188314, 2001-209145, 2001-350235 and 2002-156727.

In the present invention, the addition amount of the reducing agent is within a range, preferably, from 0.1 g/m$^2$ or more to 3.0 g/m$^2$ or less, more preferably, from 0.2 g/m$^2$ or more to 1.5 g/m$^2$ or less and, further preferably, from 0.3 g/m$^2$ or more to 1.0 g/m$^2$ or less. It is contained within a range, preferably, from 5% by mole or more to 50% by mole or less, more preferably, from 8% by mole or more to 30% by mole or less and, further preferably, from 10% by mole or more to 20% by mole or less based on one mol of silver on the side of the surface having the image forming layer. The reducing agent is incorporated preferably in the image forming layer.

The reducing agent may be contained in a coating solution and incorporated in a photosensitive material by any form and method such as in the form of solution, emulsified dispersion or fine solid particle dispersion.

Examples of a well known emulsion dispersion method include such a method in that the reducing agent is dissolved in an auxiliary solvent, such as an oil, e.g., dibutyl phthalate, tricresyl phosphate, glyceryl triacetate and diethyl phthalate, ethyl acetate and cyclohexanone, and the resulting solution is mechanically dispersed to form an emulsion dispersion.

Further, Examples of the solid fine particle dispersion method include such a method in that a powder of the reducing agent is dispersed in an appropriate solvent, such as water, with a ball mill, a colloid mill, a vibration ball mill, a sand mill, a jet mill, a roller mill or ultrasonic vibration, so as to form a solid dispersion A protective colloid (such as polyvinyl alcohol) and a surface active agent (such as an anionic surface active agent, e.g., sodium triisopropylnaphthalenesulfonate (a mixture of isomers having different substitution positions of three isopropyl groups) may be used. In the mills described above, beads, for example, of zirconia are generally used as the dispersion medium, and Zr or the like leaching from the beads may sometimes be intruded into the dispersion. Depending on the dispersion condition, it is usually within a range from 1 ppm to 1000 ppm. If the content of Zr in the photosensitive material is 0.5 mg or less per Ig of the silver, it causes no practical problem.

The aqueous dispersion is preferably incorporated with a corrosion inhibitor (for example, sodium salt of benzoisothiazolinone).

Particularly preferred is a solid particle dispersion method of the reducing agent and it is preferably added as a fine particle with an average particle size of from 0.01 μm or more and 10 μm or less, preferably, 0.05 μm or more and 5 μm or less and, more preferably, 0.1 μm or more and 2 μm or less. In the present application, other solid dispersions are also used preferably being dispersed at a particle size within the range described above.

<Development Accelerator>

The development accelerator used preferably in the photothermographic material of the present invention can include sulfoneamide phenolic compounds represented by the general formula (A) as described, for example, in the specification of JP-A No. 2000-267222 or the specification of JP-A No. 2000-330234, hindered phenolic compound represented by the general formula (II) as described in JP-A No. 2001-92075, hydrazinic compounds represented by the general formula (I) described in the specification of JP-A No. 10-62895 and the specification of JP-A No. 11-15116, general formula [D] in JP-A No. 2002-156271 and general formula (I) described in the specification of JP-A No. 2002-278017, and phenolic or naphtholic compounds represented by the general formula (2) as described in the specification of JP-A No. 2001-264929. These development accelerators may be used in an amount of from 0.1 to 20% by mole, preferably from 0.5 to 10% by mole, and more preferably from 1 to 5% by mole, based on the amount of the reducing agent. The addition method thereof to the photosensitive material may be the same as those described for the reducing agent, and it is preferably added as a solid dispersion or an emulsion dispersion. In the case where it is added in the form of an emulsion dispersion, it is preferably added in the form of an emulsion dispersion obtained by dispersing by using a high boiling point solvent, which is in a solid state at ordinary temperature, and a low boiling point auxiliary solvent, or in the form of a so-called oilless emulsion dispersion using no high boiling point solvent.

In the present invention, among the development accelerators described above, hydrazinic compounds represented by the general formula (D) described in JP-A No. 2002-156727 and phenolic or naphtholic compounds represented by the general formula (2) described in the specification of JP-A No. 2001-264929 are particularly preferred.

Particularly preferred development accelerator of the present invention is compounds represented by the following general formulae (A-1) or (A-2).

$Q_1$-NHNH-$Q_2$ General formula (A-1)

(in which $Q_1$ represents an aromatic group or a heterocyclic group coupling at a carbon atom to —NHNH-$Q_2$, and $Q_2$ represents a carbamoyl group, acyl group, alkoxycarbonyl group, aryloxycarbonyl group, sulfonyl group or sulfamoyl group).

In the general formula (A-1), the aromatic group or heterocyclic group represented by $Q_1$ is, preferably, a 5 to 7 membered unsaturated rings. Preferred examples can include benzene ring, pyridine ring, pyrazine ring, pyrimidine ring, pyridazine ring, 1,2,4-triazine ring, 1,3,5-triazine ring, pyrrole ring, imidazole ring, pyrazole ring, 1,2,3-triazole ring, 1,2,4-triazole ring, tetrazole ring, 1,3,4-thiadiazole ring, 1,2,4-thiadiazole ring, 1,2,5-thiadiazole ring, 1,3,4-oxadiazole ring, 1,2,4-oxadiazole ring, 1,2,5-oxadiazole ring, thiazole ring, oxazole ring, isothiazole ring, isooxazole ring, and thiophene rings, and condensed rings formed by condensation of the rings described above to each other are also preferred.

The rings described above may have substituents and in a case where they have two or more substituents, the substituents may be identical or different with each other. Examples of the substituents can include halogen atom, alkyl group, aryl group, carbonamide group, alkylsulfoneamide group, arylsulfonamide group, alkoxy group, aryloxy group, alkylthio group, arylthio group, carbamoyl group, sulfamoyl group, cyano group, alkylsulfonyl group, arylsulfonyl group, alkoxycarbonyl group, aryloxycarbonyl group and acyl group. In a case where the substituents are groups capable of substitution, they may have further substituents and examples of preferred substituents can include a halogen atom, an alkyl group, aryl group, carbonamide group, alkylsulfoneamide group, arylsulfoneamide group, alkoxy group, aryloxy group, alkylthio group, arylthio group, acyl group, alkoxycarbonyl group, aryloxycarbonyl group, carbamoyl group, cyano group, sulfamoyl group, alkylsulfonyl group, arylsulfonyl group and acyloxy group.

The carbamoyl group represented by $Q_2$ is a carbamoyl group preferably of 1 to 50 carbon atoms and, more preferably, of 6 to 40 carbon atoms, for example, unsubstituted carbamoyl, methyl carbamoyl, N-ethylcarbamoyl, N-propylcarbamoyl, N-sec-butylcarbamoyl, N-octylcarbamoyl, N-cyclohexylcarbamoyl, N-tert-butylcarbamoyl, N-dodecylcarbamoyl, N-(3-dodecyloxypropyl)carbamoyl, N-octadecylcarbamoyl, N-{3-(2,4-tert-pentylphenoxy)propyl} carbamoyl, N-(2-hexyldecyl)carbamoyl, N-phenylcarbamoyl, N-(4-dodecyloxyphenyl)carbamoyl, N-(2-chloro-5-dodecyloxycarbonylphenyl)carbamoyl, N-naphthylcarbaoyl, N-3-pyridylcarbamoyl and N-benzylcarbamoyl.

The acyl group represented by $Q_2$ is an acyl group, preferably, of 1 to 50 carbon atoms and, more preferably, 6 to 40 carbon atoms and can include, for example, formyl, acetyl, 2-methylpropanoyl, cyclohexylcarbonyl, octanoyl, 2-hexyldecanoyl, dodecanoyl, chloroacetyl, trifluoroacetyl, benzoyl, 4-dodecyloxybenzoyl, and 2-hydroxymethylbenzoyl. Alkoxycarbonyl group represented by $Q_2$ is an alkoxycarbonyl group, preferably, of 2 to 50 carbon atom and, more preferably, of 6 to 40 carbon atoms and can include, for example, methoxycarbonyl, ethoxycarbonyl, isobutyloxycarbonyl, cyclohexyloxycarbonyl, dodecyloxycarbonyl and benzyloxycarbonyl.

The aryloxy carbonyl group represented by $Q_2$ is an aryloxy carbonyl group, preferably, of 7 to 50 carbon atoms and, more preferably, of 7 to 40 carbon atoms and can include, for example, phenoxycarbonyl, 4-octyloxyphenoxycarbonyl, 2-hydroxymethylphenoxycarbonyl, and 4-dodecyloxyphenoxycarbonyl. The sulfonyl group represented by $Q_2$ is a sulfonyl group, preferably, of 1 to 50 carbon atoms and, more preferably, of 6 to 40 carbon atoms and can include, for example, methylsulfonyl, butylsulfonyl, octylsulfonyl, 2-hexadecylsulfonyl, 3-dodecyloxypropylsulfonyl, 2-octyloxy-5-tert-octylphenyl sulfonyl, and 4-dodecyloxyphenyl sulfonyl.

The sulfamoyl group represented by $Q_2$ is a sulfamoyl group, preferably, of 0 to 50 carbon atoms and, more preferably, of 6 to 40 carbon atoms and can include, for example, unsubstituted sulfamoyl, N-ethylsulfamoyl, N-(2-ethylhexyl)sulfamoyul, N-decylsulfamoyl, N-hexadecylsulfamoyl, N-{3-(2-ethylhexyloxy) propyl}sulfamoyl, N-(2-chloro-5-dodecyloxycarbonylphenyl)sulfamoyl, and N-(2-tetradecyloxyphenyl)sulfamoyl. The group represented by $Q_2$ may further have a group mentioned as the example of the substituent of 5 to 7-membered unsaturated ring represented by $Q_1$ at the position capable of substitution. In a case where the group has two or more substituents, such substituents may be identical or different with each other.

Then, a preferred range for the compounds represented by the formula (A-1) is to be described. 5 to 6 membered unsaturated ring is preferred for $Q_1$, and benzene ring, pyrimidine ring, 1,2,3-triazole ring, 1,2,4-triazole ring, tetrazole ring, 1,3,4-thiadiazole ring, 1,2,4-thiadiazole ring, 1,3,4-oxadiazole ring, 1,2,4-oxadiazole ring, thiazole ring, oxazole ring, isothiazole ring, isooxazole ring and a ring in which the ring described above is condensed with a benzene ring or unsaturated hetero ring is further preferred. Further, $Q_2$ is preferably a carbamoyl group and, particularly, a carbamoyl group having hydrogen atom on the nitrogen atom is preferred.

General formula (A-2)

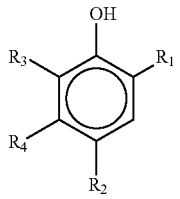

In the general formula (A-2), $R_1$ represents an alkyl group, acyl group, acylamino group, sulfoneamide group, alkoxycarbonyl group, and carbamoyl group. $R_2$ represents a hydrogen atom, halogen atom, alkyl group, alkoxy group, aryloxy group, alkylthio group, arylthio group, acyloxy group and carbonate ester group. $R_3$, $R_4$ each represents a group capable of substitution on the benzene ring which is mentioned as the example of the substituent for the general formula (A-1). $R_3$ and $R_4$ may bond to each other to form a condensed ring.

$R_1$ is, preferably, an alkyl group of 1 to 20 carbon atoms (for example, methyl group, ethyl group, isopropyl group, butyl group, tert-octyl group, or cyclohexyl group), acylamino group (for example, acetylamino group, benzoylamino group, methylureido group, or 4-cyanophenylureido group), carbamoyl group (for example, n-butylcarbamoyl group, N,N-diethylcarbamoyl group, phenylcarbamoyl group, 2-chlorophenylcarbamoyl group, or 2,4-dichlorophenylcarbamoyl group), acylamino group (including ureido group or urethane group) being more preferred. $R_2$ is, preferably, a halogen atom (more preferably, chlorine atom, bromine atom), alkoxy group (for example, methoxy group, butoxy group, n-hexyloxy group, n-decyloxy group, cyclohexyloxy group or benzyloxy group), and aryloxy group (phenoxy group or naphthoxy group).

$R_3$ is, preferably a hydrogen atom, halogen atom or an alkyl group of 1 to 20 carbon atoms, the halogen atom being most preferred. $R_4$ is preferably a hydrogen atom, alkyl group or an acylamino group, with the alkyl group or the acylamino group being more preferred. Examples of the preferred substituent thereof are identical with those for $R_1$. In a case where $R_4$ is an acylamino group, $R_4$ may also preferably be bonded with $R_3$ to form a carbostyryl ring.

In a case where $R_3$ and $R_4$ in the general formula (A-2) are bonded to each other to form a condensed ring, a naphthalene ring is particularly preferred as the condensed ring. The same substituent as the example of the substituent referred to for the general formula (A-1) may be bonded to the naphthalene ring. In a case where the general formula (A-2) is a naphtholic compound, $R_1$ is, preferably, a carbamoyl group. Among them, benzoyl group is particularly preferred. $R_2$ is, preferably, an alkoxy group or aryloxy group and, particularly preferably an alkoxy group.

Preferred specific examples for the development accelerator in the present invention are to be described below. The present invention is not restricted to them.

(A-1)

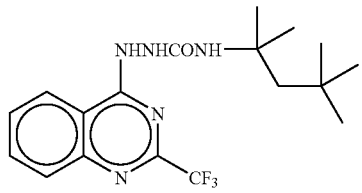

(A-2)

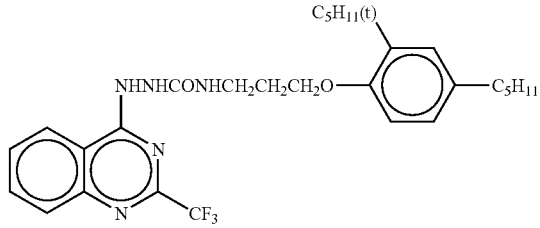

(A-3)

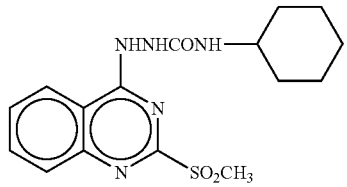

(A-4)

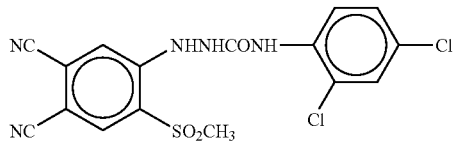

(A-5)

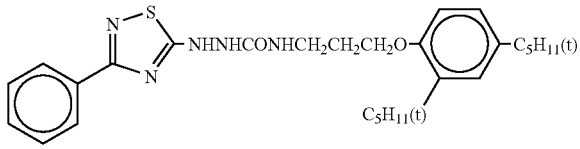

(A-6)

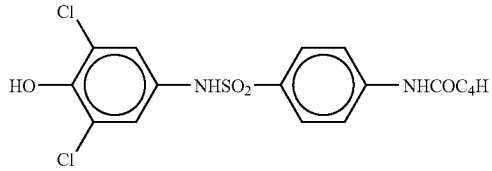

(A-7)

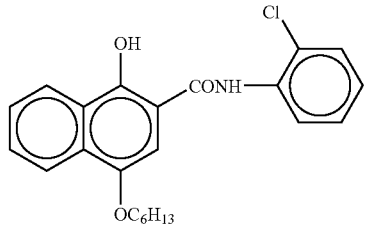

-continued (A-8)

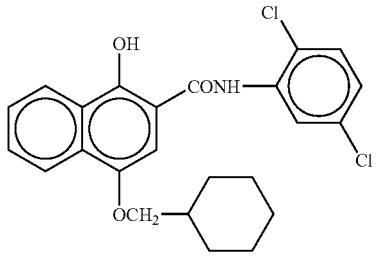

(A-9)

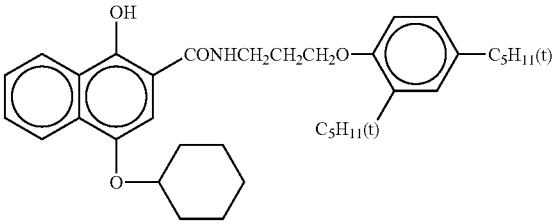

(A-10)

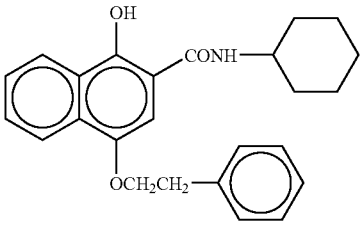

(A-11)

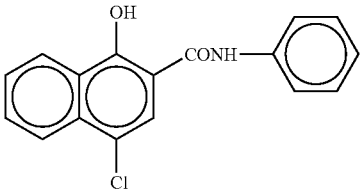

(A-12)

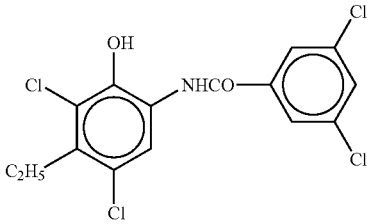

<Hydrogen Bonding Compound>

In a case where the reducing agent in the present invention has an aromatic hydroxyl group (—OH) or amino group (—NHR, in which R is hydrogen atom or alkyl group), particularly, in a case of the bisphenols, it is preferred to use a non-reducing compound having a group capable of forming a hydrogen bond with the group described above in combination.

The group capable of forming the hydrogen bond with hydroxyl group or amino group can include, for example, phosphoryl group, sulfoxide group, sulfonyl group, carbonyl group, amide group, ester group, urethane group, ureido group, tertiary amino group, and nitrogen-containing aromatic group. Among them, preferred are those compounds having a phosphoryl group, sulfoxide group, amide group (on the condition of not having >N—H group, and blocked as: >N—Ra (Ra being substituent other than H)), urethane group (on the condition of not having >N—H group, and blocked as: >N—Ra (Ra being substituent other than H)), ureido group (on the condition of not having >N—H group, and blocked as: >N—Ra (Ra being substituent other than H)).

In the present invention, particularly preferred hydrogen bonding compound is the compound represented by the following general formula (D).

General formula (D)

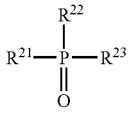

In the general formula (D), $R^{21}$ to $R^{23}$ each represents, independently, an alkyl group, aryl group, alkoxy group, aryloxy group, amino group or heterocyclic group, in which the group may be unsubstituted or may have a substituent.

In a case where $R^{21}$ to $R^{23}$ have substituent, the substituent can include, for example, a halogen atom, an alkyl group, aryl group, alkoxy group, amino group, acyl group, acylamino group, alkylthio group, arylthio group, sulfoneamide group, acyloxy group, oxycarbonyl group, carbamoyl group, sulfamoyl group, sulfonyl group, and phosphoryl group. Preferred substituent can include an alkyl group or aryl group, for example, methyl group, ethyl group, isopropyl group, t-butyl group, t-octyl group, phenyl group, 4-alkoxyphenyl group, and 4-acyloxyphenyl group.

The alkyl group of $R^{21}$ to $R^{23}$ can specifically include, for example, methyl group, ethyl group, butyl group, octyl group, dodecyl group, isopropyl group, t-butyl group, t-amyl group, t-octyl group, cyclohexyl group, 1-methylcyclohexyl group, benzyl group, phenetyl group, and 2-phenoxypropyl group.

The aryl group can include, for example, phenyl group, cresyl group, xylyl group, naphthyl group, 4-t-butylphenyl group, 4-t-octylphenyl group, 4-anisidyl group, and 3,5-dichlorophenyl group.

The alkoxy group can include, for example, methoxy group, ethoxy group, butoxy group, octyloxy group, 2-ethylhexyloxy group, 3,5,5-trimethylhexyloxy group, dodecyloxy group, cyclohexyloxy group, 4-methylcyclohexyloxy group, and benzyloxy group.

The aryloxy group can include, for example, phenoxy group, cresyloxy group, isopropylphenoxy group, 4-t-butylphenoxy group, naphthoxy group, and biphenyloxy group.

The amino group can include, for example, dimethylamino group, diethylamino group, dibutylamino group, dioctylamino group, N-methyl-N-hexylamino group, dicyclohexylamino group, diphenylamino group, and N-methyl-N-phenylamino group.

As $R^{21}$ to $R^{23}$, alkyl group, aryl group, alkoxy group, and aryloxy group are preferred. It is preferred from the standpoint of the effect of the present invention that at least one of $R^{21}$ to $R^{23}$ represents an alkyl group or an aryl group, and it is more preferred that two or more of them each represents an alkyl group or an aryl group. The case where $R^{21}$ to $R^{23}$ represent the same groups is preferred since the compound can be inexpensively available.

Specific examples of the hydrogen bonding compounds including the compounds of the general formula (D) in the present invention are shown below but the present invention is not restricted to them.

(D-1)
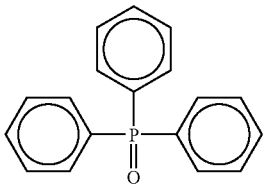
(D-2)
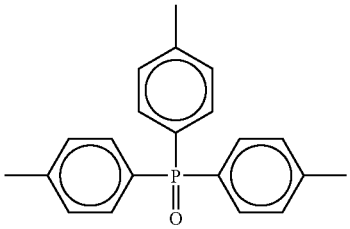
(D-3)
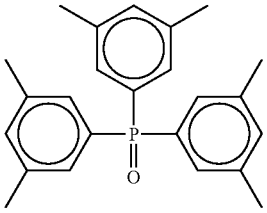
(D-4)
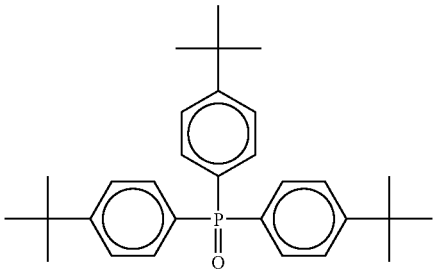
(D-5)
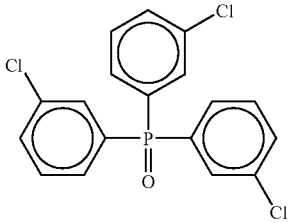
(D-6)
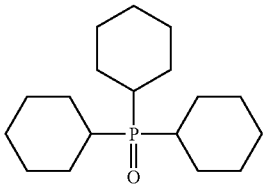
(D-7)
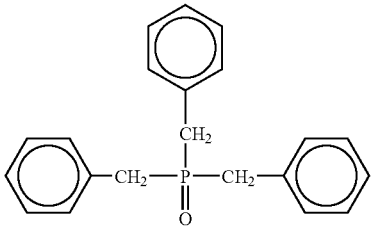
-continued
(D-8)
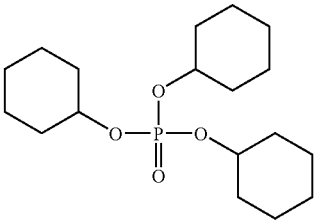
(D-9)
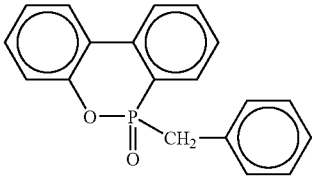
(D-10)
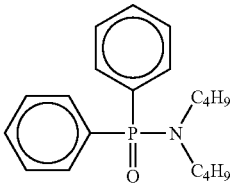
(D-11)
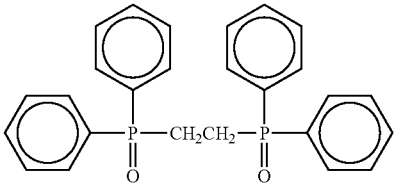
(D-12)
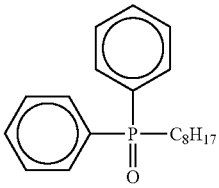
(D-13)
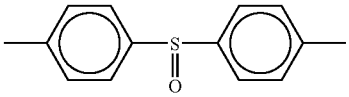
(D-14)
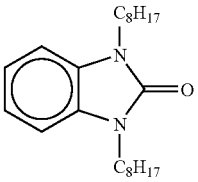
(D-15)
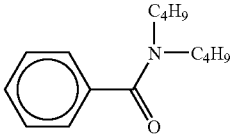
Specific examples of the hydrogen bonding compounds include, in addition to those described above, those described in EP-Patent No. 1096310, JP-A Nos. 2002-156727, 2002-318431.
The hydrogen bonding compound is preferably added to the same layer with the reducing agent.

While the compound of the general formula (D) in the present invention can be incorporated in a coating solution in the form of solution, emulsified dispersion and fine solid particles dispersion and can be used in the light sensitive material, as similar to the reducing agent, it is used preferably as solid dispersion. The compounds form a hydrogen bonding complex with a compound having the phenolic hydroxyl group or the amino group in the state of solution, and can be isolated in the state of crystals as a complex depending on the combination of the reducing agent and the compound of the general formula (D) in the present invention.

It is particularly preferred for obtaining stable performance that the thus isolated crystal powder is used as a solid fine particle dispersion. Such a method is also preferably used in that the reducing agent and the hydrogen bonding compound of the general formula (D) in the present invention are mixed in a powder state, and a complex is formed upon dispersing with a sand grinder mill or the like by using a suitable dispersing agent.

The compound of the general formula (D) in the present invention is used within a range, preferably, from 1% by mole or more to 200% by mole or less, more preferably, within a range from 10% by mole or more to 150% by mole or less and, further preferably, within a range from 20% by mole or more to 100% by mole or less based on the amount of the reducing agent.

<Photosensitive Silver Halide>

1) Halide Composition

The photosensitive silver halide used in the present invention has no particular restriction for the halogen composition, and silver chloride, silver bromochloride, silver bromide, silver bromoiodide, silver chlorobromoiodide and silver iodide can be used. Among them, silver bromide, silver bromoiodide and silver iodide are preferred. The distribution of the halogen composition in the particle may be uniform or the halogen composition may be changed stepwise, or may be changed continuously. Further, silver halide particle having a core/shell structure can be used preferably. A core/shell particle of 2–5 layered structure is preferred and, more preferably, 2–4 layered structure can be used. Further, a technique of localizing silver bromide or silver iodide on the surface of silver chloride, silver bromide or silver bromochloride particles can also be used preferably.

2) Particle Forming Method

The method of forming photosensitive silver halide is well-known in the relevant art and, for example, a method described in Research Disclosure No. 17029, June 1978 and U.S. Pat. No. 3,700,458 can be used. Specifically, a method of preparing a photosensitive silver halide by adding a silver source supply compound and a halogen source supply compound in a gelatin or other polymer solution and then mixing them with an organic silver salt is used. Further, a method described in JP-A No. 11-119374, column Nos. 0217 to 0224 and a method described in JP-A Nos. 11-352627 and 2000-347335 are also preferred.

3) Particle Size

The particle size of the photosensitive silver halide is preferably smaller with an aim of suppressing clouding after image formation and, specifically, it is 0.20 μm or less, more preferably, 0.01 μm or more and 0.15 μm or less and, further preferably, 0.02 μm or more and 0.12 μm or less. The particle size referred to herein means a diameter when converted into a circular image of an area identical with a projection area of the silver halide particle (projection area of a main plane in a case of a plate particle).

4) Particle Shape

The shape of the silver halide particle can include, for example, cuboidal, octahedral, tabular, spherical, rod shape or potato-like shape. The cuboidal particle is particularly preferred in the present invention. A silver halide particle rounded at corners can also be used preferably. While there is no particular restriction on the index of plane (Mirror's index) of the outer surface of the photosensitive silver halide particle, it is preferred that the ratio of {100} face is higher, in which the spectral sensitizing efficiency is higher in a case of adsorption of a spectral sensitizing dye. The ratio is preferably 50% or more, more preferably, 65% or more and, further preferably, 80% or more. The ratio of the Mirror's index {100} face can be determined by the method of utilizing the adsorption dependence of the {111} face and [100] face upon adsorption of a sensitizing dye described by T. Tani; in J. Imaging Sci., 29, 165 (1985).

5) Heavy Metal

The photosensitive silver halide particles in the present invention may contain a metal of Groups 8 to 10 in the periodic table (showing Groups 1 to 18) or a metallic complex. Preferred examples of the metal of Groups 8 to 10 and the central metal of the metallic complex include rhodium, ruthenium and iridium. The metallic complex may be used solely or in combination of two or more kinds of complexes having the same metallic species or different metallic species. The content thereof is preferably in a range of from $1\times10^{-9}$ to $1\times10^{-3}$ mole per 1 mole of silver. The heavy metal, the metallic complex and the addition method thereof are described in JP-A No. 7-225449, paragraphs 0018 to 0024 of JP-A No. 11-65021 and paragraphs 0227 to 0240 of JP-A No. 11-119374.

In the present invention, silver halide particles having a hexacyano metallic complex present on the outermost surface of the particles are preferred. Examples of the hexacyano metallic complex include $[Fe(CN)_6]^{4-}$, $[Fe(CN)_6]^{3-}$, $[Ru(CN)_6]^{4-}$, $[Os(CN)_6]^{4-}$, $[Co(CN)_6]^{3-}$, $[Rh(CN)_6]^{3-}$, $[Ir(CN)_6]^{3-}$, $[Cr(CN)_6]^{3-}$ and $[Re(CN)_6]^{3-}$. In the present invention, a hexacyano Fe complex is preferred.

A counter cation is not so important because the hexacyano metallic complex is present in the form of ion in an aqueous solution, but is preferably those miscible with water and suitable for precipitation operation of a silver halide emulsion, examples of which include an alkali metal ion, such as a sodium ion, a potassium ion, a rubidium ion, a cesium ion and a lithium ion, an ammonium ion, and an alkylammonium ion (such as a tetramethylammonium ion, a tetraethylammonium ion, a tetrapropylammonium ion and a tetra(n-butyl)ammonium ion).

The hexacyano metallic complex may be added after mixing with water, a mixed solvent of water with a suitable water miscible organic solvent (such as an alcohol compound, an ether compound, a glycol compound, a ketone compound, an ester compound and an amide compound), or gelatin.

The addition amount of the hexacyano metallic complex is preferably from $1\times10^{-5}$ to $1\times10^{-2}$ mole, and more preferably from $1\times10^{-4}$ to $1\times10^{-3}$ mole, per 1 mole of silver.

In order to make the hexacyano metallic complex present on the outermost surface of the silver halide particles, the hexacyano metallic complex is directly added before completing the preparing step, which is after completing the addition of a silver nitrate aqueous solution used for forming particles but before the chemical sensitization step for attaining chalcogen sensitization, such as sulfur sensitization, selenium sensitization and tellurium sensitization, and noble metal sensitization, such as gold sensitization, or is directly added during the water washing step, during the dispersing step or before the chemical sensitizing step. The hexacyano metallic complex is preferably added immediately after forming the particles in order to prevent the silver halide particles from growing, and it is preferably added before completing the preparing step.

The addition of the hexacyano metallic complex may be started after adding 96% by mass of the total amount of silver nitrate added for forming the particles, and is preferably started after adding 98% by mass thereof, and more preferably after adding 99% by mass thereof.

In the case where the hexacyano metallic complex is added after adding a silver nitrate aqueous solution that is added immediately before completing the particle formation, the complex can be adsorbed on the outermost surface of the silver halide particles, and the most proportion thereof forms an hardly soluble salt with silver ions on the surface of the particles. Because the silver salt of hexacyano iron(II) is hardly soluble in comparison to AgI, redissolution due to fine particles can be prepvented, and thus silver halide fine particles having a small particle diameter can be produced.

A metallic atom (for example, $[Fe(CN)_6]^{4-}$) that may be contained in the silver halide particles used in the present invention, a desalting method and a chemical sensitization method for the silver halide particles are described in paragraphs 0046 to 0050 of JP-A No. 11-84574, paragraphs 0025 to 0031 of JP-A No. 11-65021, and paragraphs 0242 to 0250 of JP-A No. 11-119374.

6) Gelatin

As the gelatin contained in the photosensitive silver halide emulsion used in the present invention, various kinds of gelatins can be used. It is necessary for satisfactorily keeping the dispersion state of a photosensitive silver halide emulsion in an organic silver salt-containing coating solution, and gelatin having a molecular weight of 10,000 or more and 1,000,000 or less is used preferably. Further, it is also preferred to apply phthalizing treatment to substituents on gelatin. The gelatin may be used upon particle formation or upon dispersion after the desalting treatment and it is preferably used during particle formation.

7) Sensitizing Dye

As the sensitizing dye applicable in the present invention, those capable of spectrally sensitizing silver halide particles in a desired wavelength region upon adsorption to silver halide particles and having spectral sensitivity suitable to spectral characteristic of an exposure light source can be selected advantageously. The sensitizing dyes and the addition method are disclosed, for example, as a compound represented by JP-A No. 11-65021, column Nos. 0103 to 0109, the general formula (II) in JP-A No. 10-186572, dyes represented by the general formula (I) in JP-A No. 11-119374, column No. 0106, dyes described in U.S. Pat. Nos. 5,510,236 and 3,871,887 in Example 5, dyes disclosed in JP-A Nos. 2-96131 and 59-48753, as well as in page 19, line 38 to page 20, line 35 of EP-A No. 0,803,764A1, and in JP-A Nos. 2001-272747, 2001-290238, and 2002-23306. The sensitizing dyes described above may be used alone or two or more of them may be used in combination. In the present invention the sensitizing dye is added into the silver halide emulsion at a timing preferably within a period after a desalting step to coating and, more preferably, at a timing after desalting to the completion of chemical aging.

The addition amount of the sensitizing dye in the present invention can be made to a desired amount in accordance with the performance such as sensitivity or fogging and it is, within a range preferably, from $10^{-6}$ mol or more to 1 mol or less, and more preferably, from $10^{-4}$ mol or more to $10^{-1}$ mol or less per 1 mol of the silver halide in the image forming layer.

In the present invention super sensitizer can be used for improving the spectral sensitizing effect. The super sensitizer usable in the present invention can include those compounds described in EP-A No. 587,338, U.S. Pat. Nos. 3,877,943 and 4,873,184 and JP-A Nos. 5-341432, 11-109547, and 10-111543.

8) Chemical Sensitization

The photosensitive silver halide particle in the present invention is preferably sensitized chemically by sulfur sensitization, selenium sensitization or tellurium sensitization. As the compound used preferably for sulfur sensitization, selenium sensitization and tellurium sensitization, known compounds, for example, compounds described in JP-A No. 7-128768 can be used. Particularly, tellurium sensitization is preferred in the present invention and compounds described in the literature cited in JP-A No. 11-65021, column No. 0030 and compounds shown by the general formulae (II), (III), and (IV) in JP-A No. 5-313284 are more preferred.

The photosensitive silver halide particle in the present invention is preferably sensitized chemically by gold sensitization alone or in combination with the chalcogen sensitization described above. As the gold sensitizer, those having +1 or +3 gold valence are preferred and those gold compounds used usually are preferred as the gold sensitizer. Preferred typical examples are chloroauric acid, bromoauric acid, potassium chloroaurate, potassium bromoaurate, auric trichloride, potassium auric thiocyanate, potassium iodoaurate, tetracyanoauric acid, ammonium aurothiocyanate and pyridyl trichloro gold. Further, gold sensitizers described in U.S. Pat. No. 5,858,637 and JP-A No. 2002-278016 are also used preferably.

In the present invention, chemical sensitization can be applied at any time so long as it is after particle formation and before coating and it can be applied, after desalting, (1) before spectral sensitization, (2) simultaneously with spectral sensitization, (3) after spectral sensitization and (4) just before coating.

The amount of sulfur, selenium or tellurium sensitizer used in the present invention may vary depending on the silver halide particle used, the chemical ripening condition and the like and it is used by about $10^{-3}$ mol or more and $10^{-2}$ mol or less and, preferably, $10^{-7}$ mol or more and $10^{-3}$ mol or less per one mol of the silver halide.

The addition amount of the gold sensitizer may vary depending on various conditions and it is generally about $10^{-7}$ mol to $10^{-3}$ mol and, more preferably, $10^{-6}$ mol or more and $5\times10^{-4}$ mol or less per one mol of the silver halide.

There is no particular restriction on the condition for the chemical sensitization in the present invention and, pH is about 5 to 8, pAg is 6 to 11 and temperature is about at 40 to 95° C.

To the silver halide emulsion used in the present invention, a thiosulfonic acid compound may be added by the method shown in EP-A No. 293,917.

A reducing sensitizer is used preferably for the photosensitive silver halide particle in the present invention. As the specific compound for the reducing sensitization, ascorbic acid or thiourea dioxide is preferred, as well as use of stannous chloride, aminoimino methane sulfonic acid, hydrazine derivatives, borane compounds, silane compounds, polyamine compounds and the like is preferred. The reducing sensitizer may be added at any stage in the photosensitive emulsion production process from crystal growth to the preparation step just before coating. Further, it is preferred to apply reducing sensitization by ripening while keeping pH to 7 or higher or pAg to 8.3 or lower for the emulsion, and it is also preferred to apply reducing sensitization by introducing a single addition portion of silver ions during particle formation.

9) Compound Forming One-electron Oxidant by One-electron Oxidation Capable of Releasing One or More Electron The photothermographic material of the present invention preferably contains a compound forming a one-electron oxidant by one-electron oxidation capable of releasing one or more electron. The compound is used solely or in combination with the various kinds of chemical sensitizers described in the foregoing, so as to provide increase in sensitivity of the silver halide.

The compound forming a one-electron oxidant by one-electron oxidation capable of releasing one or more electron, contained in the photothermographic compound is selected from the following types 1 to 5 compounds.

(Type 1)

A compound forms a one-electron oxidant by one-electron oxidation capable of releasing two or more electrons associated with a subsequent bond cleavage reaction.

(Type 2)

A compound forms a one-electron oxidant by one-electron oxidation capable of releasing another one electron associated with a subsequent bond cleavage reaction, and has two or more adsorbing groups to silver halide in one molecule.

(Type 3)

A compound forms a one-electron oxidant by one-electron oxidation capable of releasing one or more electron after a subsequent bond forming process.

(Type 4)

A compound forms a one-electron oxidant by one-electron oxidation capable of releasing one or more electron after a subsequent ring cleavage reaction inside the molecule.

(Type 5)

A compound represented by X—Y, wherein X represents a reductive group and Y represents a releasing group, forms a one-electron oxidant by one-electron oxidation of the reductive group represented by X capable of forming an X radical through release of Y associated with a subsequent bond cleavage reaction of the X—Y bond and releasing another one electron therefrom.

Among the compounds of types 1 and 3 to 5, a compound having an adsorbing group to silver halide inside the molecule and a compound having a partial structure of a spectral sensitizing dye inside the molecule are preferred. A compound having an adsorbing group to silver halide inside the molecule is more preferred. The compounds of types 1 to 4 are preferably a compound having, as an adsorbing group, a nitrogen-containing heterocyclic group having two or more mercapto groups substituted thereon.

The compounds of types 1 to 5 will be described in detail below.

In the compound of type 1, the bond cleavage reaction specifically means cleavage of a carbon-carbon bond, a carbon-silicon bond, a carbon-hydrogen bond, a carbon-boron bond, a carbon-tin bond and a carbon-germanium bond, and cleavage of a carbon-hydrogen bond may be further accompanied therewith. After the compound of type 1 becomes a one-electron oxidant through one-electron oxidation, the one-electron oxidant is then capable of releasing two or more (preferably three or more) electrons associated with a bond cleavage reaction.

Preferred examples of the compound of type 1 include those represented by the following general formulae (A), (B), (1), (2) and (3).

General formula (A)

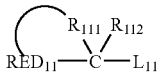

General formula (B)

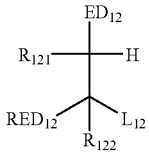

In the general formula (A), $RED_{11}$ represents a reductive group capable of being one-electron-oxidized, $L_{11}$ represents a releasing group, $R_{112}$ represents a hydrogen atom or a substituent, and $R_{111}$ represents a non-metallic atomic group capable of forming, with a carbon atom (C) and $RED_{11}$, a cyclic structure corresponding to a tetrahydro body, a hexahydro body or an octahydro body of a 5- or 6-membered aromatic ring (including an aromatic heterocyclic ring).

In the general formula (B), $RED_{12}$ represents a reductive group capable of being one-electron-oxidized, $L_{12}$ represents a releasing group, $R_{121}$ and $R_{122}$ each represents a hydrogen atom or a substituent, and $ED_{12}$ represents an electron donating group. In the general formula (B), $R_{121}$ and $RED_{12}$, $R_{121}$ and $R_{122}$, or $ED_{12}$ and $RED_{12}$ may be bonded to each other to form a cyclic structure.

The compound represented by the general formula (A) or (B), after one-electron oxidation of the reductive group represented by $RED_{11}$ or $RED_{12}$, spontaneously releases $L_{11}$ or $L_{12}$ by a bond cleavage reaction, whereby two or more electrons, and preferably three or more electrons, can be released associated therewith.

General formula (1)

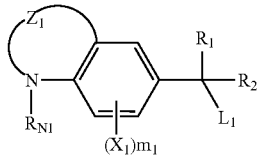

General formula (2)

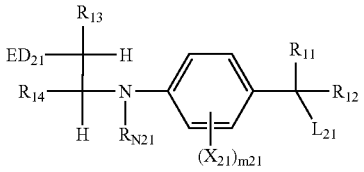

-continued

General formula (3)

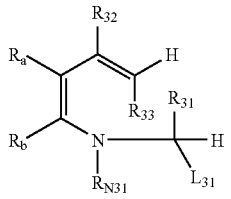

In the general formula (1), $Z_1$ represents an atomic group capable of forming a 6-membered ring with a nitrogen atom and two carbon atoms of a benzene ring, $R_1$, $R_2$ and $R_{N1}$ each represents a hydrogen atom or a substituent, $X_1$ represents a substituent capable of being substituted on a benzene ring, $m_1$ represents an integer of from 0 to 3, and $L_1$ represents a releasing group. In the general formula (2), $ED_{21}$ represents an electron donating group, $R_{11}$, $R_{12}$, $R_{N21}$, $R_{13}$ and $R_{14}$ each represents a hydrogen atom or a substituent, $X_{21}$ represents a substituent capable of being substituted on a benzene ring, $m_{21}$ represents an integer of from 0 to 3, and $L_{21}$ represents a releasing group. $R_{N21}$, $R_{13}$, $R_{14}$, $X_{21}$ and $ED_{21}$ may be bonded to each other to form a cyclic structure. In the general formula (3), $R_{32}$, $R_{33}$, $R_{31}$, $R_{N31}$, $R_a$ and $R_b$ each represents a hydrogen atom or a substituent, and $L_{31}$ represents a releasing group, provided that in the case where $R_{N31}$ represents a group other than an aryl group, $R_a$ and $R_b$ are bonded to each other to form an aromatic ring.

The compound represented by the general formula (1), (2) or (3) after one-electron oxidation, spontaneously releases $L_1$, $L_{21}$ or $L_{31}$ by a bond cleavage reaction, whereby two or more electrons, and preferably three or more electrons, can be released associated therewith.

The compound represented by the general formula (A) will be described in detail.

In the general formula (A), the reductive group capable of being one-electron-oxidized represented by $RED_{11}$ is a group capable of forming a particular ring by bonding to $R_{111}$ described later, and specific examples thereof include divalent groups obtained by removing one hydrogen atom from the following monovalent groups at a position that is appropriate for forming a ring. Examples of the monovalent group include an alkylamino group, an arylamino group (such as an anilino group and a naphthylamino group), a heterocyclic amino group (such as a benzthiazolyl group and a pyrrolylamono group), an alkylthio group, an arylthio group (such as a phenylthio group), a heterocyclic thio group, an alkoxy group, an aryloxy group (such as a phenoxy group), a heterocyclic oxy group, an aryl group (such as a phenyl group, a naphthyl group and an anthranyl group) and an aromatic or non-aromatic heterocyclic group (such as a from 5- to 7-membered monocyclic or polycondensed heterocyclic group containing at least one hetero atom selected from a nitrogen atom, a sulfur atom, an oxygen atom and a selenium atom, specific examples of which include a tetrahydroquinoline ring, a tetrahydroisoquinoline ring, a tetrahydroquinoxaline ring, a tetrahydroquinazoline ring, an indoline ring, an indole ring, an indazole ring, a carbazole ring, a phenoxazine ring, a phenothiazine ring, a benzothiazoline ring, a pyrrole ring, an imidazole ring, a thiazoline ring, a piperidine ring, a pyrrolidine ring, a morpholine ring, a benzimidazole ring, a benzimidazoline ring, a benzoxazoline ring and a methylenedioxyphenyl ring). (Hereinafter, $RED_{11}$ will be described with the name of the monovalent group for convenience.) $RED_{11}$ may have a substituent.

The substituent herein means one selected form the following groups unless otherwise indicated. Examples of the substituent include a halogen atom, an alkyl group (including an aralkyl group, a cycloalkyl group and an active methine group), an alkenyl group, an alkynyl group, an aryl group, a heterocyclic group (the position where the group is substituted is not limited), a heterocyclic group containing a quaternarized nitrogen atom (such as a pyridinio group, an imidazolio group, a quinolinio group and an isoquinolinio group), an acyl group, an alkoxycarbonyl group, an aryloxycarbonyl group, a carbamoyl group, a carboxyl group or a salt thereof, a sulfonylcarbamoyl group, an acylcarbamoyl group, a sulfamoylcarbamoyl group, a carbazoyl group, an oxalyl group, an oxamoyl group, a cyano group, a carbonimidoyl group, a thiocarbamoyl group, a hydroxyl group, an alkoxy group (including a group containing ethyleneoxy group repeating units or propyleneoxy group repeating units), an aryloxy group, a heterocyclic oxy group, an acyloxy group, an (alkoxy or aryloxy)carbonyloxy group, a carbamoyloxy group, a sulfonyloxy group, an amino group, an (alkyl, aryl or hetrocyclic)amino group, an acylamino group, a sulfonamide group, an ureido group, a thioureido group, an imide group, an (alkoxy or aryloxy)carbonylamino group, a sulfamoylamino group, a semicarbazide group, a thiosemicarbazide group, a hydrazino group, an ammonio group, an oxamoylamino group, an (alkyl or aryl)sulfonylureido group, an acylureido group, an acylsulfamoylamino group, a nitro group, a mercapto group, an (alkyl, aryl or heterocyclic)thio group, an (alkyl or aryl)sulfonyl group, an (alkyl or aryl)sulfinyl group, a sulfo group or a salt thereof, a sulfamoyl group, an acylsulfamoyl group, a sulfonylsulfamoyl group or a salt thereof, and a group containing a phosphoamide or phosphate ester structure. These substituents may further be substituted with these substituents.

$RED_{11}$ preferably represents an alkylamino group, an arylamino group, a heterocyclic amino group, an aryl group or an aromatic or non-aromatic heterocyclic group, and more preferably an arylamino group (particularly an anilino group) or an aryl group (particularly a phenyl group). In the case where these groups have a substituent, the substituent is preferably a halogen atom, an alkyl group, an alkoxy group, a carbamoyl group, a sulfamoyl group, an acylamino group or a sulfonamide group.

In the case where $RED_{11}$ represents an aryl group, the aryl group preferably has at least one electron donating group. The electron donating group herein a 5-membered monocyclic or polycondensed electron-excessive aromatic heterocyclic group containing a hydroxyl group, an alkoxy group, a mercapto group, a sulfonamide group, an acylamino group, an alkylamino group, an arylamino group, a heterocyclic amino group, an active methine group or a nitrogen atom in the ring (such as an indolyl group, a pyrrolyl group, an imodazolyl group, a benzimidazolyl group, a thiazolyl group, a benzthiazolyl group and an indazolyl group), or a non-aromatic nitrogen-containing hetecocyclic group substituted with a nitrogen atom (such as a group that may be referred to as a cyclic amino group, e.g., a pyrrolidinyl group, an indolinyl group, a piperidinyl group, a piperadinyl group and a morphlino group). The active methine group herein means a methine group substituted with two electron attracting groups, and the electron attracting group herein means an acyl group, an alkoxycarbonyl group, an aryloxycarbonyl group, a carbamoyl group, an alkylsulfonyl group, an arylsulfonyl group, a sulfamoyl group, a trifluoromethyl group, a cyano group, a nitro group or a carbonimidoyl group. The two electron attracting groups may be bonded to each other to form a cyclic structure.

In the general formula (A), $L_{11}$ specifically represents a carboxyl group or a salt thereof, a silyl group, a hydrogen atom, a triarylboron anion, a trialkylstannyl group, a trialkylgermyl group or a —$CR_{C1}R_{C2}R_{C3}$ group. The silyl group herein specifically represents a trialkylsilyl group, an aryldialkylsilyl group, a triarylsilyl group or the like, which may have an arbitrary substituent.

In the case where $L_{11}$ represents a salt of a carboxyl group, examples of a counter ion for forming the salt include an alkali metal ion, an alkaline earth metal ion, a heavy metal ion, an ammonium ion and a phosphonium ion, and an alkali metal ion and an ammonium ion are preferred, with an alkali metal ion (particularly, $Li^+$, $Na^+$ and $K^+$ ions) being most preferred.

In the case where $L_{11}$ represents a —$CR_{C1}R_{C2}R_{C3}$ group, $R_{C1}$, $R_{C2}$ and $R_{C3}$ each independently represents a hydrogen atom, an alkyl group, an aryl group, a heterocyclic group, an alkylthio group, an arylthio group, an alkylamino group, an arylamino group, a heterocyclic amino group, an alkoxy group, an aryloxy group or a hydroxyl group, which may be bonded to each other to form a cyclic structure, and may have an arbitrary substituent. In the case where one of $R_{C1}$, $R_{C2}$ and $R_{C3}$ represents a hydrogen atom or an alkyl group, the remaining two groups do not represent a hydrogen atom or an alkyl group. $R_{C1}$, $R_{C2}$ and $R_{C3}$ each preferably independently represents an alkyl group, an aryl group (particularly a phenyl group), an alkylthio group, an arylthio group, an alkylamino group, an arylamino group, a heterocyclic group, an alkoxy group or a hydroxyl group, and specific examples thereof include a phenyl group, a p-dimethylaminophenyl group, a p-methoxyphenyl group, a 2,4-dimethoxyphenyl group, a p-hydroxyphenyl group, a methylthio group, a phenylthio group, a phenoxy group, a methoxy group, an ethoxy group, a dimethylamino group, an N-methylanilino group, a diphenylamino group, a morpholino group, a thiomorpholino group and a hydroxyl group. Examples of the case where these are bonded to each other to form a cyclic structure include a 1,3-dithiolan-2-yl group, a 1,3-dithian-2-yl group, a N-methyl-1,3-dithazolidin-2-yl group and an N-benzylbenzothazolidin-2-yl group.

It is also preferred that the —$CR_{C1}R_{C2}R_{C3}$ group represents the same group as a residual group obtained by removing $L_{11}$ from the compound represented by the general formula (A), as a result of selection of $R_{C1}$, $R_{C2}$ and $R_{C3}$ from the aforementioned range.

In the general formula (A), $L_{11}$ preferably represents a carboxyl group or a salt thereof, or a hydrogen atom, and more preferably a carboxyl group or a salt thereof.

In the case where $L_{11}$ represents a hydrogen atom, the compound represented by the general formula (A) preferably has a basic part inside the molecule. According to the function of the basic part, the hydrogen atom represented by $L_{11}$ is deprotonated after oxidization of the compound represented by the general formula (A), and an electron is then released therefrom.

The base herein is specifically a conjugate base of an acid having pKa of about from 1 to 10. Examples thereof include a nitrogen-containing heterocyclic compound (such as a pyridine compound, an imidazole compound, a benzimidazole compound and a thiazole compound), an aniline compound, a trialkylamine compound, an amino compound, a carbon acid compound (such as an active methylene anion), a thioacetate anion, a carboxylate (—$COO^-$), a sulfate (—$SO_3^-$) or an amineoxide (>$N^+(O^-)$—). It is preferably a conjugate base of an acid having pKa of about from 1 to 8, and preferably a carboxylate, a sulfate or an amineoxide, with a carboxylate being particularly preferred. In the case where the base has an anion, it may have a counter cation, and examples thereof include an alkali metal ion, an alkaline earth metal ion, a heavy metal ion, an ammonium ion and a phosphonium ion. The base is bonded to the compound represented by the general formula (A) at an arbitrary position. The position where the basic part is bonded may be any of $RED_{11}$, $R_{111}$ and $R_{112}$ in the general formula (A), and may be bonded to a substituent on these groups.

In the general formula (A), $R_{112}$ represents a hydrogen atom or a substituent capable of being substituted on a carbon atom, provided that $R_{112}$ does not represent the same group as $L_{11}$.

$R_{112}$ preferably represents a hydrogen atom, an alkyl group, an aryl group (such as a phenyl group), an alkoxy group (such as a methoxy group, an ethoxy group and a benzyloxy group), a hydroxyl group, an alkylthio group (such as a methylthio group and a butylthio group), an amino group, an alkylamino group, an arylamino group or a heterocyclic amino group, and more preferably represents a hydrogen atom, an alkyl group, an alkoxy group, a hydroxyl group, a phenyl group or an alkylamino group.

In the general formula (A), the cyclic structure formed by $R_{111}$ is such a cyclic structure that corresponds to a tetrahydro body, a hexahydro body or an octahydro body of a 5- or 6-membered aromatic ring (including an aromatic heterocyclic ring). The hydro body herein means such a cyclic structure in that the carbon-carbon double bond (or a carbon-nitrogen double bond) contained in the aromatic ring (including the aromatic heterocyclic ring) is partially hydrogenated. The tetrahydro body means such a structure in that two carbon-carbon double bonds (or carbon-nitrogen double bonds) are hydrogenated, the hexahydro body means such a structure in that three double bonds are hydrogenated, and the octahydro body means such a structure in that four double bonds are hydrogenated. The aromatic ring is converted to a non-aromatic cyclic structure having been partially hydrogenated through hydrogenation.

Specific examples thereof include a pyrrolidine ring, an imidazolidine ring, a thiazolidine ring, a pyrazolidine ring, an oxazolidine ring, a piperidine ring, a tetrahydropyridine ring, a tetrahydropyrimidine ring, a piperazine ring, a tetralin ring, a tetrahydroquinoline ring, a tetrahydroisoquinoline ring, a tetrahydroquinazoline ring, a tetrahydroquinoxaline ring, a tetrahydrocarbazole ring and an octahydrophenanthridine ring. These cyclic structures may have an arbitrary substituent.

The cyclic structure formed by $R_{111}$ is more preferably a pyrrolidine ring, an imidazolidine ring, a piperidine ring, a tetrahydropyridine ring, a tetrahydropyrimidine ring, a piperazine ring, a tetrahydroquinoline ring, a tetrahydroisoquinoline ring, a tetrahydroquinazoline ring, a tetrahydroquinoxaline ring or a tetrahydrocarbazole ring, particularly preferably a pyrrolidine ring, a piperidine ring, a piperazine ring, a tetrahydropyridine ring, a tetrahydroquinoline ring, a tetrahydroisoquinoline ring, a tetrahydroquinazoline ring or a tetrahydroquinoxaline ring, and most preferably a pyrrolidine ring, a piperidine ring, a tetrahydropyridine ring, a tetrahydroquinoline ring or a tetrahydroisoquinoline ring.

In the general formula (B), $RED_{12}$ and $L_{12}$ are groups having the same meanings as $RED_{11}$ and $L_{11}$ in the general formula (A), respectively, and the preferred ranges thereof are also the same. However, $RED_{12}$ is a monovalent group other than the case where the following cyclic structure is formed, and specific examples thereof include the monovalent group described for $RED_{11}$. $R_{121}$ and $R_{122}$ are groups having the same meanings as $R_{112}$ in the general formula (A), and the preferred ranges thereof are the same. $ED_{12}$ represents an electron donating group. $R_{121}$ and $RED_{12}$, $R_{121}$ and $R_{122}$, or $ED_{12}$ and $RED_{12}$ may be bonded to each other to form a cyclic structure.

In the general formula (B), the electron donating group represented by $ED_{12}$ is the same groups as the electron donating group described as the substituent in the case where $RED_{11}$ represents an aryl group. $ED_{12}$ preferably represents a hydroxyl group, an alkoxy group, a mercapto group, a sulfonamide group, an alkylamino group, an arylamino group, an active methine group, a 5-membered monocyclic or polycondensed electron-excessive aromatic heterocyclic group, a non-aromatic nitrogen-containing heterocyclic group substituted with a nitrogen atom or a phenyl group substituted with these electron donating group, and a hydroxyl group, a mercapto group, a sulfonamide group, an alkylamino group, an arylamino group, an active methine group, a non-aromatic nitrogen-containing heterocyclic group substituted with a nitrogen atom and a phenyl group substituted with these electron donating group (such as a p-hydroxyphenyl group, a p-dialkylaminophenyl group and an o,p-dialkoxyphenyl group) are more preferred.

In the general formula (B), $R_{121}$ and $RED_{12}$, $R_{122}$ and $R_{121}$, or $ED_{12}$ and $RED_{12}$ may be bonded to each other to form a cyclic structure. The cyclic structure formed herein is a non-aromatic carbon ring or heterocyclic ring, which is a 5- to 7-membered monocyclic or polycondensed ring with a substituted or unsubstituted cyclic structure. In the case where $R_{121}$ and $RED_{12}$ form a cyclic structure, specific examples thereof include, in addition to the examples described for the cyclic structure formed by $R_{111}$ in the general formula (A), a pyrroline ring, an imidazoline ring, a thiazoline ring, a pyrazoline ring, an oxazoline ring, an indane ring, a morpholine ring, an indoline ring, a tetrahydro-1,4-oxazine ring, a 2,3-dihydrobenzo-1,4-oxazine ring, a tetrahydro-1,4-thiazine ring, a 2,3-dihydrobenzo-1,4-thiazine ring, a 2,3-dihydrobenzofuran ring and a 2,3-dihydrobenzothiophene ring. In the case where $ED_{12}$ and $RED_{12}$ form a cyclic structure, $ED_{12}$ preferably represents an amino group, an alkylamino group or an arylamino group, and specific examples of the cyclic structure thus formed include a tetrahydropyrazine ring, a piperazine ring, a tetrahydroquinoxaline ring and a tetrahydroisoquinoline ring. In the case where $R_{122}$ and $R_{121}$ form a cyclic structure, specific examples of the cyclic structure include a cyclohexane ring and a cyclopentane ring.

The general formulae (1) to (3) will be described below.

In the general formulae (1) to (3), $R_1$, $R_2$, $R_{11}$, $R_{12}$ and $R_{31}$ each has the same meaning as $R_{112}$ in the general formula (A), with the preferred ranges thereof being the same. $L_1$, $L_{21}$ and $L_{31}$ each represents the same releasing groups described as the specific examples for $L_{11}$ in the general formula (A), with preferred ranges thereof being the same. The substituents represented by $X_1$ and $X_{21}$ are the same as the examples for the substituent substituted on $RED_{11}$ in the general formula (A) in the case where $RED_{11}$ has the substituent, with preferred ranges thereof being the same. $m_1$ and $m_2$, each preferably represents an integer of from 0 to 2, and more preferably 0 or 1.

In the cease where $R_{N1}$, $R_{N21}$ and $R_{N3}$, each represents a substituent, the substituent is preferably an alkyl group, an aryl group or a heterocyclic group, which may have an arbitrary substituent. $R_{N1}$, $R_{N21}$ and $R_{N3}$, each is preferably a hydrogen atom, an alkyl group or an aryl group, and more preferably a hydrogen atom or an alkyl group.

In the case where $R_{13}$, $R_{14}$, $R_{33}$, $R_a$ and $R_b$ each represents a substituent, preferred examples of the substituent include an alkyl group, an aryl group, an acyl group, an alkoxycarbonyl group, a carbamoyl group, a cyano group, an alkoxy group, an acylamino group, a sulfonamide group, an ureido group, a thioureido group, an alkylthio group, an arylthio group, an alkylsulfonyl group, an arylsulfonyl group and a sulfamoyl group.

The 6-membered ring formed by $Z_1$ in the general formula (1) is a non-aromatic heterocyclic ring condensed with the benzene ring in the general formula (1), and specific examples of the cyclic structure including the benzene ring thus condensed include a tetrahydroquinoline ring, a tetrahydroquinoxaline ring and a tetrahydroquinazoline ring, and preferably a tetrahydroquinoline ring and a tetrahydroquinoxaline ring. These rings may have a substituent.

In the general formula (2), $ED_2$, represents a group having the same meaning as $ED_{12}$ in the general formula (B), with a preferred range thereof being the same.

In the general formula (2), two of $R_{N21}$, $R_{13}$, $R_{14}$, $X_{21}$ and $ED_{21}$ may be bonded to each other to form a cyclic structure. Examples of the cyclic structure formed by bonding $R_{N21}$ and $X_{21}$ include a non-aromatic carbon ring or heterocyclic ring, and specific examples thereof include a tetrahydroquinoline ring, a tetrahydroquinoxaline ring, an indoline ring and a 2,3-dihydro-5,6-benzo-1,4-thiazine ring, and preferably a tetrahydroquinoline ring, a tetrahydroquinoxaline ring and an indoline ring.

In the general formula (3), in the case where $R_{N31}$ represents a group other than an aryl group, $R_a$ and $R_b$ are bonded to each other to form an aromatic ring. Examples of the aromatic ring include an aryl group (such as a phenyl group and a naphthyl group) and an aromatic heterocyclic group (such as a pyridine ring group, a pyrrole ring group, a quinoline ring group and an indole ring group), and an aryl group is preferred. The aromatic ring groups may have a substituent.

In the general formula (3), it is preferred that $R_a$ and $R_b$ are bonded to each other to form an aromatic ring (particularly, a phenyl group).

In the general formula (3), $R_{32}$ preferably represents a hydrogen atom, an alkyl group, an aryl group, a hydroxyl group, an alkoxy group, a mercapto group and an amino group, and in the case where $R_{32}$ represents a hydroxyl group, it is a preferred example that $R_{33}$ simultaneously represents an electron attracting group. The electron attracting group herein has the same meaning as described in the foregoing, and preferred examples thereof include an acyl group, an alkoxycarbonyl group, a carbamoyl group and a cyano group.

The compound of type 2 will be described.

In the compound of type 2, the bond cleavage reaction means cleavage of a carbon-carbon bond, a carbon-silicon bond, a carbon-hydrogen bond, a carbon-boron bond, a carbon-tin bond and a carbon-germanium bond, and cleavage of a carbon-hydrogen bond may be further accompanied therewith.

The compound of type 2 has two or more (preferably from 2 to 6, and more preferably from 2 to 4) adsorbing groups to silver halide in the molecule. It is more preferably a compound having a nitrogen-containing heterocyclic group having two or more mercapto groups substituted thereon as the adsorbing groups. The number of adsorbing groups is preferably from 2 to 6, and more preferably from 2 to 4. The adsorbing group will be described later.

Preferred examples of the compound of type 2 include a compound represented by the following general formula (C).

General formula (C)

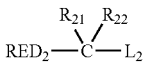

The compound represented by the general formula (C) is a compound, after one-electron oxidation of the reductive group represented by $RED_2$, spontaneously releases $L_2$ by a bond cleavage reaction, whereby one electron can be released associated therewith.

In the general formula (C), $RED_2$ represents a group having the same meaning as $RED_{12}$ in the general formula (B), with a preferred range thereof being the same. $L_2$ represents a group having the same meaning as $L_{11}$ in the general formula (A), with a preferred range thereof being the same. In the case where $L_2$ represents a silyl group, the compound has a nitrogen-containing heterocyclic group having two or more mercapto groups substituted thereon. $R_{21}$, and $R_{22}$ each represents a hydrogen atom or a substituent, which has the same meaning as $R_{112}$ in the general formula (A), with preferred ranges thereof being the same. $RED_2$ and $R_{21}$ may be bonded to each other to form a cyclic structure.

The cyclic structure formed herein is a 5- to 7-membered monocyclic or polycondensed non-aromatic carbon ring or heterocyclic ring, which may have a substituent, provided that the cyclic structure is not such a cyclic structure that corresponds to a tetrahydro body, a hexahydro body or an octahydro body of an aromatic ring or an aromatic heterocyclic ring. The cyclic structure is preferably a cyclic structure corresponding to a dihydro body of an aromatic ring or an aromatic heterocyclic ring, and specific examples thereof include a 2-pyrroline ring, a 2-imidazoline ring, a 2-thiazoline ring, a 1,2-dihydropyridine ring, a 1,4-dihydropyridine ring, an indoline ring, a benzimodazoline ring, a benzothiazoline ring, a benzoxazoline ring, a 2,3-dihydrobenzothiophene ring, a 2,3-dihydrobenzofuran ring, a benz-α-pyran ring, a 1,2-dihydroquinoline ring, a 1,2-dihydroquinazoline ring and a 1,2-dihydroquinoxaline ring, preferably a 2-imidazoline ring, a 2-thiazoline ring, an indoline ring, a benzimodazoline ring, a benzothiazoline ring, a benzoxazoline ring, a 1,2-dihydropyridine ring, a 1,2-dihydroquinoline ring, a 1,2-dihydroquinazoline ring and a 1,2-dihydroquinoxaline ring, more preferably an indoline ring, a benzimodazoline ring, a benzothiazoline ring and a 1,2-dihydroquinoline ring, and particularly preferably an indoline ring.

The compound of type 3 will be described.

In the compound of type 3, the bond forming process means formation of a bond between atoms, such as a carbon-carbon bond, a carbon-nitrogen bond, a carbon-sulfur bond and a carbon-oxygen bond.

The compound of type 3 preferably forms a one-electron oxidant by one-electron oxidation capable of releasing one or more electron after a subsequent bond forming process, in which a bond is formed by reacting with a reactive group part coexisting in the molecule (such as a carbon-carbon double bond part, a carbon-carbon triple bond part, an aromatic group part or a non-aromatic heterocyclic ring part of benzo ring condensation).

In more detail, the compound of type 3 forms a one-electron oxidant (such as a cationic radical species or a neutral radical species formed by elimination of a proton therefrom) by one-electron oxidation, which reacts with the reactive group coexisting in the molecule to form a bond, whereby another radical species having a cyclic structure is formed inside the molecule. The radical species then releases a second electron directly or associated with elimination of a proton.

In the compound of type 3, there are such cases that the two-electron oxidant thus formed receives a hydrolysis reaction in some cases, or directly causes a mutual isomerization reaction associated with migration of a proton in other cases, so as to release one or more electron, generally two or more electrons. The compound of type 3 also includes such a compound that the two-electron oxidant directly releases one or more electron, generally two or more electrons, without involvement of the mutual isomerization reaction.

The compound of type 3 preferably represents the following general formula (D).

$RED_3$-$L_3$-$Y_3$ General formula (D)

In the general formula (D), $RED_3$ represents a reductive group capable of being subjected to one-electron oxidation, $Y_3$ represents a reactive group part that reacts after one-electron oxidation of $RED_3$, which specifically represents a carbon-carbon double bond part, a carbon-carbon triple bond part, an aromatic group part or a non-aromatic heterocyclic ring part of benzo ring condensation, and $L_3$ represents a linking group connecting $RED_3$ and $Y_3$.

$RED_3$ represents a group having the same meaning as $RED_{12}$ in the general formula (B), preferably an arylamino group, a heterocyclic amino group, an aryloxy group, an arylthio group, an aryl group or an aromatic or non-aromatic heterocyclic group (with a nitrogen-containing heterocyclic group being particularly preferred), and more preferably an arylamino group, a heterocyclic amino group, an aryl group or an aromatic or non-aromatic heterocyclic group. Preferred examples of the heterocyclic group include a tetrahydroquinoline ring, a tetrahydroquinoxaline ring, a tetrahydroquinazoline ring, an indoline ring, an indole ring, a carbazole ring, a phenoxazine ring, a phenothiazine ring, a benzothiazoline ring, a pyrrole ring, an imidazole ring, a thiazole ring, a benzimidazole ring, an benzimidazoline ring, a benzothiazoline ring, and a 3,4-methylenedioxyphenyl-1-yl.

$RED_3$ particularly preferably represents an arylamino group (particularly, an anilino group), an aryl group (particularly, a phenyl group) or an aromatic or non-aromatic heterocyclic group.

In the case where $RED_3$ represents an aryl group, the aryl group preferably has at least one electron donating group. The electron donating group has the same meaning as described in the foregoing.

In the case where $RED_3$ represents an aryl group, more preferred examples of the substituent thereon include an alkylamino group, a hydroxyl group, an alkoxy group, a mercapto group, a sulfonamide group, an active methine group or a non-aromatic nitrogen-containing heterocyclic group having a nitrogen atom substituted thereon, further preferably an alkylamino group, a hydroxyl group, an active methine group or a non-aromatic nitrogen-containing heterocyclic group having a nitrogen atom substituted thereon, and most preferably an alkylamino group or a non-aromatic nitrogen-containing heterocyclic group having a nitrogen atom substituted thereon.

In the case where the organic group having a carbon-carbon double bond part represented by $Y_3$ (such as a vinyl)

group has a substituent, preferred examples of the substituent include an alkyl group, a phenyl group, an acyl group, a cyano group an alkoxycarbonyl group, a carbamoyl group and an electron donating group, and preferred examples of the electron donating group include an alkoxy group, a hydroxyl group (which may be protected with a silyl group, for example, a trimethylsilyloxy group, a t-butyldimethylsilyloxy group, a triphenylsilyloxy group, a triethylsilyloxy group and a phenyldimethylsilyloxy group), an amino group, an alkylamino group, an arylamino group, a sulfonamide group, an active methine group, a mercapto group, an alkylthio group and a phenyl group having the electron attracting group as a substituent.

In the case where the organic group containing a carbon-carbon double bond part has a hydroxyl group as a substituent, $Y_3$ contains the structure $>C_1{=}C_2(—OH)—$, which may be mutually isomerized to be another structure $>C_1H—C_2(=O)—$. In this case, such a case is also preferred that a substituent substituted on the carbon atom $C_1$ is an electron attracting group, and $Y_3$ in this case contains a partial structure of an active methylene group or an active methine group. The electron attracting group providing the partial structure of an active methylene group or an active methine group is the same as that referred in the aforementioned description for the active methine group.

In the case where the organic group containing a carbon-carbon triple bond part (for example, an ethylnyl group) represented by $Y_3$ has a substituent, preferred examples of the substituent include an alkyl group, a phenyl group, an alkoxycarbonyl group, a carbamoyl group and an electron donating group.

In the case where $Y_3$ represents an organic group containing an aromatic group part, the aromatic group is preferably an aryl group (particularly preferably a phenyl group) having an electron donating group as a substituent or an indole ring group, and preferred examples of the electron donating group include a hydroxyl group (which may be protected with a silyl group), an alkoxy group, an amino group, an alkylamino group, an active methine group, a sulfonamide group and a mercapto group.

In the case where $Y_3$ represents an organic group containing a non-aromatic heterocyclic ring part of benzo ring condensation, the non-aromatic heterocyclic ring part of benzo ring condensation is preferably those having an aniline structure as a partial structure contained therein, and examples thereof include an indoline ring group, a 1,2,3,4-tetrahydroquinoline ring group, a 1,2,3,4-tetrahydroquinoxaline ring group and a 4-quinolone ring group.

The reactive group represented by $Y_3$ is more preferably an organic group containing a carbon-carbon double bond part, an aromatic group part or a non-aromatic heterocyclic ring part of benzo ring condensation, and more preferably an organic group containing a carbon-carbon double bond part, a phenyl group having an electron donating group as a substituent, an indole ring group or a non-aromatic heterocyclic ring part of benzo ring condensation having an aniline structure as a partial structure contained therein. Here, the carbon-carbon double bond part more preferably includes at least one electron donative group as a substituent.

It is also a preferred example of the compound of the general formula (D) in which the reactive group represented by $Y_3$ has the same partial structure as the reductive group represented by $RED_3$ as a result of selection of $Y_3$ from the aforementioned ranges.

$L_3$ represents a linking group connecting $RED_3$ and $Y_3$, and specifically may represents a single bond, a sole group of an alkylene group, an arylene group, a heterocyclic ring group, —O—, —S—, —$NR_N$—, —C(=O)—, —$SO_2$—, —SO— and —P(=O)—, and a group containing a combination of these groups, in which $R_N$ represents a hydrogen atom, an alkyl group, an aryl group or a heterocyclic group. The linking group represented by $L_3$ may have an arbitrary substituent. The linking group represented by $L_3$ may be connected to arbitrarily positions of $RED_3$ and $Y_3$ by substituting with an arbitrary hydrogen atom of each group at the position.

Preferred examples of the linking group represented by $L_3$ include a single bond, an alkylene group (particularly, a methylene group, an ethylene group and a propylene group), an arylene group (particularly, a phenylene group), a —C(=O)— group, an —O— group, an —NH— group, an —N(alkyl)-group and a divalent group containing a combination of these groups.

The group represented by $L_3$ is preferably such a group that in the case where a cationic radical species ($X^+$.) formed by oxidation of $RED_3$ or a radical species (X.) formed by associated with elimination of a proton therefrom is reacted with the reactive group represented by $Y_3$ to form a bond, the atomic group concerning thereto forms a 3- to 7-membered cyclic structure including $L_3$. In order to attain the conformation, it is preferred that the radical species ($X^+$. or X.), the reactive group represented by Y and L are connected with an atomic group having from 3 to 7 atoms.

The compound of type 4 will be described.

The compound of type 4 is a compound having a cyclic structure having a reductive group substituted thereon, and after one-electron oxidation of the reductive group, the compound is capable of releasing one or more electron associated with a cleavage reaction of the cyclic structure. The cleavage reaction of the cyclic structure herein means a reaction shown by the following general scheme.

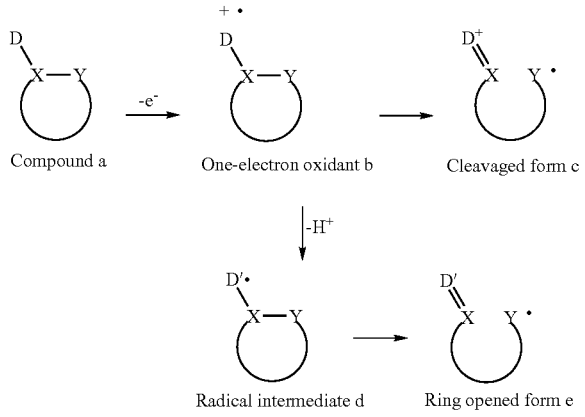

In the scheme, the compound a represents the compound of type 4. In the compound a, D represents a reductive group, X and Y represent atoms forming a bond in the cyclic structure that is cleaved after the one-electron oxidation. The compound a is one-electron-oxidized to form a one-electron oxidant b, from which the single bond D-X is changed to a double bond, and simultaneously, the bond X—Y is cut, so as to form a ring-opening body c. In alternative, there are cases where a radical intermediate body d is formed from the one-electron oxidant b associated with elimination of a proton, from which a ring-opening body e in the similar manner. One of the characteristic features of the compound resides in that one or more electron is subsequently released from the ring-opening body c or e thus formed.

The cyclic structure contained in the compound of type 4 is a 3- to 7-membered carbon ring or heterocyclic ring, which is a monocyclic or polycondensed, saturated or unsaturated non-aromatic ring. It is preferably a saturated cyclic structure, and more preferably a 3-membered or 4-membered ring. Preferred examples of the cyclic structure include a cyclopropane ring, a cyclobutane ring, an oxirane ring, an oxetane ring, an aziridine ring, an azetidine ring, an episulfide ring and a thietane ring, more preferably a cyclopropane ring, a cyclobutane ring, an oxirane ring, an oxetane ring and an azetidine ring, and particularly preferably a cyclopropane ring, a cyclobutane ring and an azetidine ring. The cyclic structure may have an arbitrary substituent.

The compound of type 4 is preferably represented by the following general formulae (E) and (F).

General formula (E)

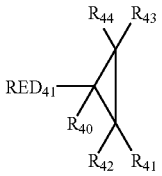

General formula (F)

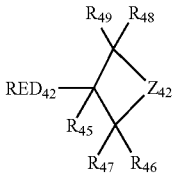

In the general formulae (E) and (F), $RED_{41}$ and $RED_{42}$ each represents a group having the same meaning as $RED_{12}$ in the general formula (B), with preferred ranges thereof being the same. $R_{40}$ to $R_{44}$ and $R_{45}$ to $R_{49}$ each represents a hydrogen atom or a substituent. In the general formula (F), $Z_{42}$ represents —$CR_{420}R_{421}$—, —$NR_{423}$ or —O—, wherein $R_{420}$ and $R_{421}$ each represents a hydrogen atom or a substituent, and $R_{423}$ represents a hydrogen atom, an alkyl group, an aryl group or a heterocyclic group.

In the general formulae (E) and (F), $R_{40}$ and $R_{45}$ each preferably represents a hydrogen atom, an alkyl group, an aryl group or a heterocyclic group, and more preferably a hydrogen atom, an alkyl group or an aryl group. Preferred examples of $R_{41}$ to $R_{44}$ and $R_{46}$ to $R_{49}$ include a hydrogen atom, an alkyl group, an alkenyl group, an aryl group, a heterocyclic group, an arylthio group, an alkylthio group, an acylamino group and a sulfonamide group, and more preferably a hydrogen atom, an alkyl group, an aryl group and a heterocyclic group.

It is preferred that at least one of $R_{41}$ to $R_{44}$ is a donative group, and it is also preferred that both $R_{41}$ and $R_{42}$, or both $R_{43}$ and $R_{44}$ are electron attracting groups. It is more preferred that at least one of $R_{41}$ to $R_{44}$ is a donative group. It is further preferred that at least one of $R_{41}$ to $R_{44}$ is a donative group, and a group among $R_{41}$ to $R_{44}$ that is not a donative group is a hydrogen atom or an alkyl group.

The donative group herein means an electron donative group or an aryl group having at least one electron donative group substituted thereon. The donative group is preferably an alkylamino group, an arylamino group, a heterocyclic amino group, a 5-membered monocyclic or polycondensed aromatic electron-excessive heterocyclic ring group having at least one nitrogen atom in the ring, a non-aromatic heterocyclic ring group having a nitrogen atom substituted thereon, and a phenyl group having at least one electron donative group substituted thereon, more preferably an alkylamino group, an arylamino group, a 5-membered monocyclic or polycondensed aromatic electron-excessive heterocyclic ring group having at least one nitrogen atom in the ring (such as an indol ring, a pyrrole ring and a carbazole ring), and a phenyl group having an electron donative group substituted thereon (such as a phenyl group having three or more alkoxy groups substituted thereon and a phenyl group having a hydroxyl group, an alkylamino group or an arylamino group substituted thereon), and particularly preferably an arylamino group, a 5-membered monocyclic or polycondensed aromatic electron-excessive heterocyclic ring group having at least one nitrogen atom in the ring (such as a 3-indolyl group), and a phenyl group having an electron donative group substituted thereon (such as a trialkoxyphenyl group and a phenyl group having an alkylamino group or an arylamino group substituted thereon).

$Z_{42}$ preferably represents —$CR_{420}R_{421}$—, —$NR_{423}$, and more preferably —$NR_{423}$, wherein $R_{420}$ and $R_{42}$, each preferably represents a hydrogen atom, an alkyl group, an aryl group, a heterocyclic group, an acylamino group or a sulfoamino group, and more preferably a hydrogen atom, an alkyl group, an aryl group or a heterocyclic group. $R_{423}$ preferably represents a hydrogen atom, an alkyl group, an aryl group or an aromatic heterocyclic group, and more preferably a hydrogen atom, an alkyl group or an aryl group.

In the case where $R_{40}$ to $R_{49}$, $R_{420}$, $R_{421}$ and $R_{423}$ each represents a substituent, the total carbon number thereof is 40 or less, more preferably 30 or less, and particularly preferably 15 or less. These substituents may be bonded to each other or bonded to other parts in the molecule (such as $RED_{41}$, $RED_{42}$ or $Z_{42}$) to form a ring.

In the compounds of types 1 to 4 in the present invention, the adsorbing group to silver halide is a group that directly adsorbs silver halide or a group that accelerates adsorption of silver halide, and specific examples thereof include a mercapto group (or a salt thereof), a thione group (—C(═S)—), a heterocyclic group containing at least one atom selected from a nitrogen atom, a sulfur atom, a selenium atom and a tellurium atom, a sulfide group, a cationic group and an ethynyl group, provided that a sulfide group is not included in the adsorbing group in the compound of type 2 of the present invention.

The mercapto group (or a salt thereof) as the adsorbing group means a mercapto group (or a salt thereof) itself, and simultaneously it preferably represents a heterocyclic group, an aryl group or an alkyl group having at least one mercapto group (or a salt thereof) substituted thereon. The heterocyclic group herein may be a 5- to 7-membered monocyclic or polycondensed aromatic or non-aromatic heterocyclic ring, and examples thereof include an imidazole ring group, a thiazole ring group, an oxazole ring group, a benzimidazole ring group, a benzthiazole ring group, a benzoxazole ring group, a triazole ring group, a thiadiazole ring group, an oxadiazole ring group, a tetrazole ring group, a purine ring group, a pyridine ring group, a quinoline ring group, an isoquinolie ring group, a pyrimidine ring group and a triazine ring group. It may also be a heterocyclic group containing a quaternarized nitrogen atom, and in this case, the substituted mercapto group may be dissociated to a mesoion. Examples of such a heterocyclic group include an imidazolium ring group, a pyrazolium ring group a thiazolium, ring group, a triazolium ring group, a tetrazolium ring group, a thiadiazolium ring group, a pyridinium ring group, a pyrimidinium ring group and a triazinium ring group, and among these a triazolium ring group (such as a 1,2,4-triazolium-3-thiolate ring group) is preferred. Examples of the aryl group include a phenyl group and a naphthyl group. Examples of the alkyl group include a linear, branched or cyclic alkyl group having from 1 to 30 carbon atoms. Examples of a counter ion in the case where the mercapto group forms a salt include a cation, such as an alkali metal, an alkaline earth metal and a heavy metal (such as $Li^+$, $Na^+$, $K^+$, $Mg^{2+}$, $Ag^+$ and $Zn^{2+}$), an ammonium ion, a heterocyclic group containing a quaternarized nitrogen atom and a phosphonium ion.

The mercapto group as the adsorbing group may be a thione group through mutual isomerization, and examples thereof include a thioamide group (which is a —C(═S)—NH— group herein) and a group containing a partial structure of the thioamide group, such as a linear or cyclic thioamide group, a thioureido group, a thiourethane group and a dithiocarbamate ester group. Examples of the cyclic group include a thiazolin-2-thione group, an oxazolin-2-thione group, a 2-thiohydantoin group, a rhodanine group, an isorhodanine group, a thio barbituric acid group and a 2-thioxo-oxazolin-4-one group.

The thione group as the adsorbing group includes, in addition to the aforementioned case where the mercapto group becomes a thione group through mutual isomerization, a linear or cyclic thioamide group, a thioureido group, a thiourethane group and a dithiocarbamate ester group, which cannot be mutually isomerized to a mercapto group (i.e., that does not have a hydrogen atom at the α-position of the thione group).

The heterocyclic group containing at least one atom selected from a nitrogen atom, a sulfur atom, a selenium atom and a tellurium atom may be a nitrogen-containing heterocyclic group having an —NH— group as a partial structure of the heterocyclic ring that is capable of forming imino silver (>NAg), or a heterocyclic group having an —S— group, an —Se— group, a —Te— group or an ═N— group as a partial structure of the heterocyclic ring that is capable of being coordinated to a silver ion through a coordinate bond. Examples of the former include a benzotriazole group, a triazole group, an indazole group, a pyrazole group, a tetrazole group, a benzimidazole group, an imidazole group and purine group, and examples of the later include a thiophene group, a thiazole group, an oxazole group, a benzthiazole group, a benzoxiazole group, a thiadiazole group, an oxadiazole group, a triazine group, a selenoazole group, a benzselenoazole group, a tellurazole group and a benztellurazole group, with the former being preferred.

Examples of the sulfide group as the adsorbing group include all groups that have an —S— structure as a partial structure, and preferred examples thereof include groups having an alkyl (or alkylene)-S-alkyl (or alkylene) structure, an aryl (or arylene)-S-alkyl (or alkylene) structure or an aryl (or arylene)-S-aryl (or arylene) structure as a partial structure. The sulfide group may form a cyclic structure and may be an —S—S— group. Specific examples thereof in the case where a cyclic structure is formed include groups containing a thiolane ring, a 1,3-dithiolane ring, a 1,2-dithiolane ring, a thiane ring, a dithiane ring and a tetrahydro-1,4-thiazine ring (a thiomorpholine ring). Particularly preferred examples of the sulfide group include a group having an alkyl (or alkylene)-S-alkyl (or alkylene) partial structure.

The cationic group as the adsorbing group means a group containing a quaternarized nitrogen atom, and specifically an ammonio group or a group containing a nitrogen-containing heterocyclic group containing a quaternarized nitrogen atom, provided that the cationic group does not become a part of an atomic group forming a dye structure (such as a cyanine chromophoric group). Examples of the ammonio group herein include a trialkylammonio group, a dialkylarylammonio group and an alkyldiarylammonio group, and specific examples thereof include a benzyldimethylammonio group, a trihexylammonio group and a phenyldiethylammonio group. Examples of the heterocyclic group containing a quaternarized nitrogen atom include a pyridinio group, a quinolinio group, an isoquinolinio group and an imidazolio group, and a pyridinio group and an imidazolinio group are preferred, with a pyridinio group being particularly preferred. The nitrogen-containing heterocyclic group containing a quaternarized nitrogen atom may have a substituent. Preferred examples of the substituent on a pyridinio group and an imidazolio group include an alkyl group, an aryl group, an acylamino group, a chlorine atom, an alkoxycarbonyl group and a carbamoyl group, and particularly preferred examples of the substituent on a pyridinio group include a phenyl group.

The ethynyl group as the adsorbing group means a —C≡CH group, and the hydrogen atom therein may be substituted.

The aforementioned adsorbing groups may have an arbitrary substituent.

Specific examples of the adsorbing group also include those described in JP-A No. 11-95355, p. 4 to 7.

Preferred examples of the adsorbing group in the present invention include a mercapto group-substituted nitrogen-containing heterocyclic group (such as a 2-mercaptothiadiazole group, a 3-mercapto-1,2,4-triazole group, a 5-mercaptotetrazole group, a 2-mercapto-1,3,4-oxadiazole group, a 2-mercaptobenzoxazole group, a 2-mercaptobenzthiazole group and a 1,5-dimetyl-1,2,4-triazolium-3-thiolate group) and a nitrogen-containing heterocyclic group having an —NH— group as a partial structure of the heterocyclic ring that is capable of forming imino silver (>NAg) (such as a benztriazole group, a benzimidazole group and an indazole group), particularly preferred examples thereof include a 5-mercaptotetrazole group, a 3-mercapto-1,2,4-triazole group and a benztriazole group, and most preferred examples thereof include a 3-mercapto-1,2,4-triazole group and a 5-mercaptotetrazole group.

Among the compounds in the present invention, a compound having two or more mercapto groups as a partial structure is also particularly preferred. The mercapto group herein may be a thione group in the case where it can exert mutual isomerization. Examples of such a compound include a compound having two or more of the adsorbing groups having a mercapto group or a thione group as a partial structure (such as a ring-forming thioamide group, an alkylmercapto group, an arylmercapto group and a heterocyclic mercapto group) in the molecule, and a compound having one or more adsorbing group having two or more mercapto groups or thione groups as a partial structure (such as a dimercapto-substituted nitrogen-containing heterocyclic group).

Examples of the adsorbing group having two or more mercapto groups as a partial structure (such as dimercapto-substituted nitrogen-containing heterocyclic group) include a 2,4-dimercaptopyrimidine group, a 2,4-dimercaptotriazine group, a 3,5-dimercapto-1,2,4-triazole group, a 2,5-dimercapto-1,3-thiazole group, a 2,5-dimercapto-1,3-oxazole group, 2,7-dimercapto-5-methyl-s-triazolo(1,5-A)-pyrimidine group, a 2,6,8-trimercaptopurine group, a 6,8-dimercaptopurine group, a 3,5,7-trimercapto-s-triazolotriazine group, a 4,6-dimercaptopyrazolopyrimidine group and a 2,5-dimercaptoimidazole group, and a 2,4-dimercaptopyrimidine group, a 2,4-dimercaptotriazine group and a 3,5-dimercapto-1,2,4-triazole group are particularly preferred.

While the adsorbing group may be substituted on any position in the general formulae (A) to (F) and the general formulae (1) to (3), it is preferred that the adsorbing group is substituted on $RED_{11}$, $RED_{12}$, $RED_2$ or $RED_3$ in the general formulae (A) to (D), $RED_{41}$, $R_{41}$, $RED_{42}$ or $R_{46}$ to $R_{48}$ in the general formulae (E) and (F), and an arbitrary position except for $R_1$, $R_2$, $R_{11}$, $R_{12}$, $R_{31}$, $L_1$, $L_{21}$ and $L_{31}$ in the general formulae (1) to (3), and it is preferred that the adsorbing group is substituted on $RED_{11}$ to $RED_{42}$ in all the general formulae (A) to (F).

The partial structure of a spectral sensitizing dye is a group containing a chromophoric group of the spectral sensitizing dye and is a residual group obtained by removing an arbitrary hydrogen atom or substituent from the spectral sensitizing dye. While the partial structure of a spectral sensitizing dye may be any position in the general formulae (A) to (F) and the general formulae (1) to (3), it is preferred that the partial structure is substituted on $RED_{11}$, $RED_{12}$, $RED_2$ or $RED_3$ in the general formulae (A) to (D), $RED_{41}$, $R_{41}$, $RED_{42}$ or $R_{46}$ to $R_{48}$ in the general formulae (E) and (F), and an arbitrary position except for $R_1$, $R_2$, $R_{11}$, $R_{12}$, $R_{31}$, $L_1$, $L_2$, and $L_{31}$ in the general formulae (1) to (3), and it is preferred that the partial structure is substituted on $RED_{11}$ to $RED_{42}$ in all the general formulae (A) to (F). Preferred examples of the spectral sensitizing dye include a spectral sensitizing dye used in a color sensitizing technique, such as a cyanine dye compound, a complex cyanine dye compound, a merocyanine dye compound, a complex merocyanine dye compound, a homopolar cyanine dye compound, a stylyl dye compound and a hemicyanine dye compound. Representative examples of the spectral sensitizing dye are described in Research Disclosure, item 36544 (September of 1994). These dyes can be synthesized by a skilled person in the art according to the aforementioned Research Disclosure, item 36544 or F. M. Hamer, The Cyanine Dyes and Related Compounds (Interscience Publishers, New York, 1964). Dyes described in JP-A No. 11-95355, p. 7 to 14 (U.S. Pat. No. 6,054,260) may also be used as they are.

The compound of types 1 to 4 in the present invention preferably has a total carbon number in a range of from 10 to 60, more preferably from 15 to 50, further preferably from 18 to 40, and particularly preferably from 18 to 30.

The compound of types 1 to 4 in the present invention is one-electron-oxidized triggered by exposure of a silver halide photosensitive material containing the compound, and after the subsequent reaction, one electron or two electrons in some types are released through oxidation. The oxidation potential of the first electron is preferably about 1.4 V or less, and more preferably 1.0 V or less. The oxidation potential is preferably 0 V or more, and more preferably 0.3 V or more. Accordingly, the oxidation potential is preferably about from 0 to 1.4 V, and more preferably about 0.3 to 1.0 V.

The oxidation potential can be measured by a cyclic voltammetry technique and specifically measured in the following manner. That is, a sample is dissolved in a solution of acetonitrile and water (containing 0.1 M of lithium perchlorate) (80/20 in terms of % by volume), and after nitrogen gas is bubbled therein for 10 minutes, the oxidation potential is measured by using a glassy carbon disk as an operating electrode, a platinum wire as a counter electrode and a calomel electrode (SCE) as a reference electrode at 25° C. with a potential scanning rate of 0.1 V per second. The oxidation potential with respect to the SCE is measured at the peak potential of the cyclic voltammetry wave.

In the case where the compound of types 1 to 4 in the present invention is a compound that is one-electron-oxidized and after the subsequent reaction, releases another one electron, the oxidation potential of the later step is preferably from −0.5 to −2 V, more preferably from −0.7 to −2 V, and further preferably from −0.9 to −1.6 V.

In the case where the compound of types 1 to 4 in the present invention is a compound that is one-electron-oxidized and after the subsequent reaction, releases two or more electrons through oxidation, the oxidation potential of the later step is not particularly limited. This is because the oxidation potential of the second electron and the oxidation potential of the third electron cannot be clearly distinguished from each other, and thus it is often difficult to accurately measure them separately.

The compound of type 5 will be described.

The compound of type 5 is represented by X—Y, wherein X represents a reductive group, and Y represents a releasing group, and it is such a compound that the reductive group represented by X is one-electron-oxidized to form a one-electron oxidant, which forms an X radical by releasing Y associated with a cleavage reaction of the X—Y bond, and another one electron can be released therefrom. The reaction where the compound of type 5 is oxidized can be expressed by the following scheme.

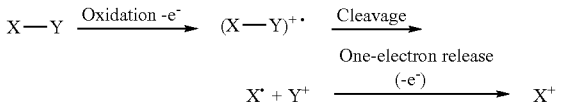

The compound of type 5 preferably has an oxidation potential of from 0 to 1.4 V, and more preferably from 0.3 to 1.0 V. The oxidation potential of the radical X formed in the aforementioned reaction is preferably from −0.7 to −2.0 V, and more preferably from −0.9 to −1.6 V.

The compound of type 5 is preferably represented by the following general formula (G).

General formula (G)

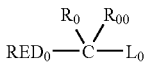

In the general formula (G), $RED_0$ represents a reductive group, $L_0$ represents a releasing group, and $R_0$ and $R_{00}$ each represents a hydrogen atom or a substituent. $RED_0$ and $R_0$, and $R_0$ and $R_{00}$ may be bonded to each other to form a cyclic structure. $RED_0$ represents a group having the same meaning as $RED_2$ in the general formula (C), with a preferred range thereof being the same. $R_0$ and $R_{00}$ each represents a group having the same meanings as $R_2$, and $R_{22}$ in the general formula (C), with preferred ranges thereof being the same, provided that $R_0$ and $R_{00}$ each does not represents the same group as $L_0$ except for a hydrogen atom. $RED_0$ and $R_0$ may be bonded to each other to form a cyclic structure, and examples of the cyclic structure include the examples described for the case where $RED_2$ and $R_{21}$ are bonded to each other to form a cyclic structure in the general formula (C), with a preferred range thereof being the same. Examples of the cyclic structure formed by bonding $R_0$ and $R_{00}$ include a cyclopentane ring and a tetrahydrofuran ring. In the general formula (G), $L_0$ represents a group having the same meaning as $L_2$ in the general formula (C), with a preferred range thereof being the same.

The compound represented by the general formula (G) preferably has a adsorbing group to silver halide or a partial structure of a spectral sensitizing dye in the molecule, provided that in the case where $L_0$ represents a group other than a silyl group, two or more adsorbing groups are not simultaneously contained in the molecule. However, two or more sulfide groups as the adsorbing group may be contained irrespective to $L_0$.

Examples of the adsorbing group to silver halide contained in the compound represented by the general formula (G) include the examples described for the adsorbing group that may be contained in the compound of types 1 to 4 in the present invention, and in addition thereto, also include all the groups described in JP-A No. 11-95355, p. 4 to 7, under the name of silver halide adsorbing groups, with the preferred range thereof being applicable.

The partial structure of a spectral sensitizing dye that may be contained in the compound represented by the general formula (G) is the same as the partial structure of a spectral sensitizing dye that may be contained in the compound of types 1 to 4 in the present invention, and in addition thereto, examples thereof also include all the groups described in JP-A No. 11-95355, p. 7 to 14, under the name of photoabsorbing groups, with the preferred range thereof being applicable.

Specific examples of the compound of types 1 to 5 in the present invention are shown below, but the present invention is not limited thereto.

1

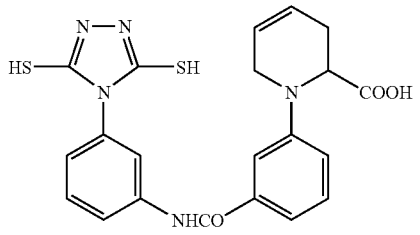

2

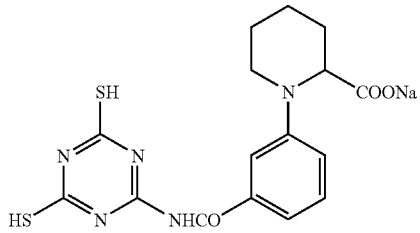

-continued

3

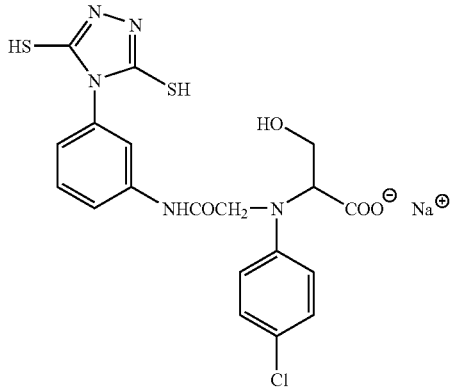

4

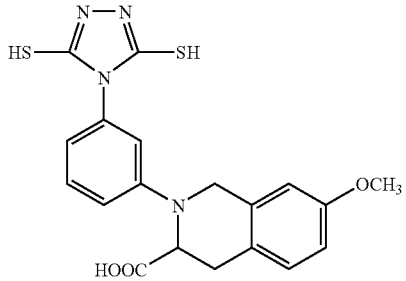

5

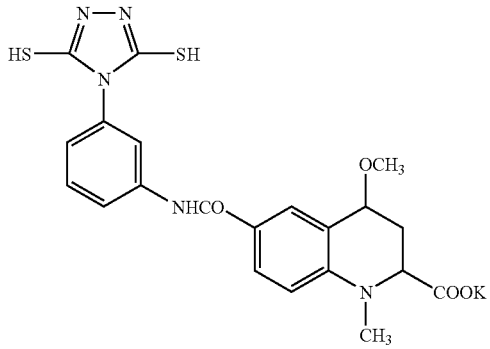

6

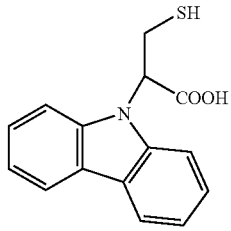

7

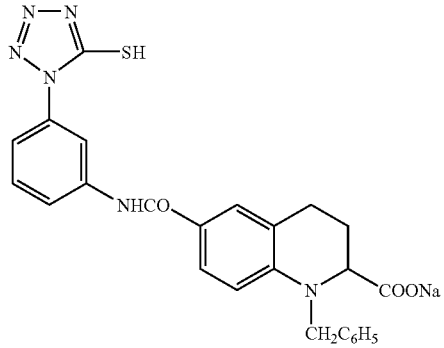

-continued
8
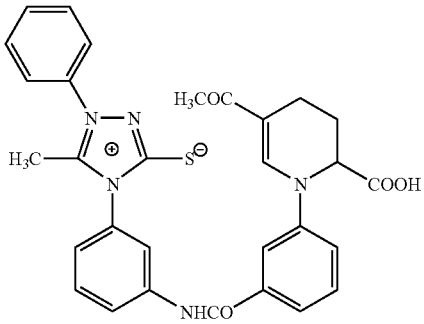
9
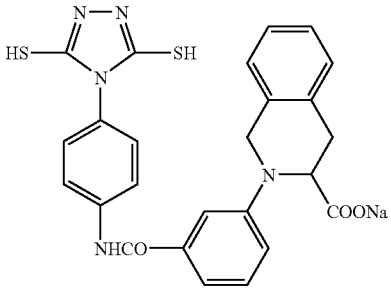
10
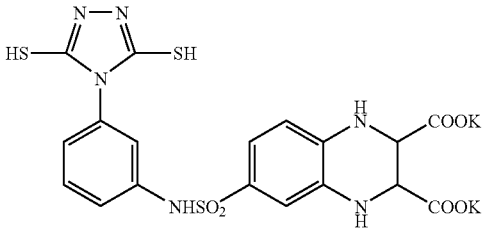
11
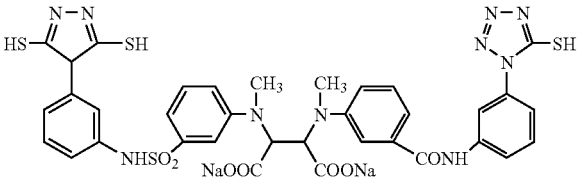
12
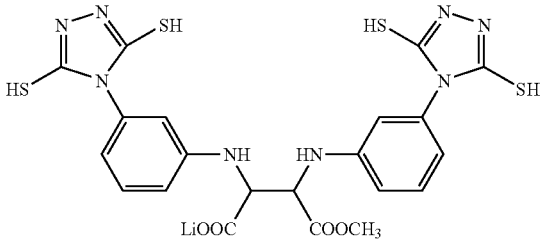
13
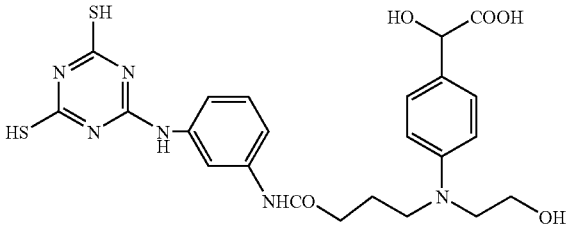
-continued
14
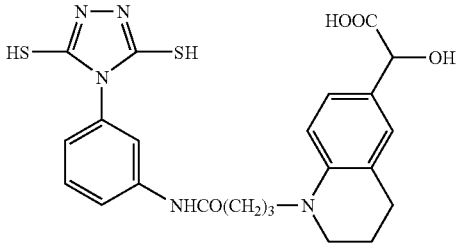
15
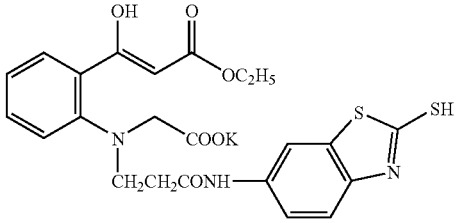
16
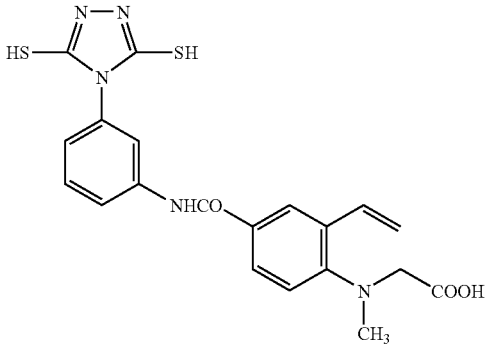
17
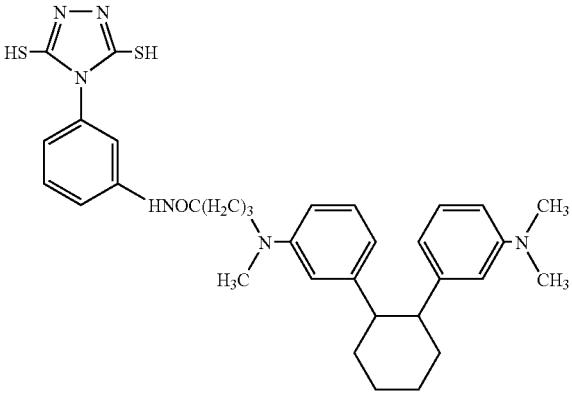
18
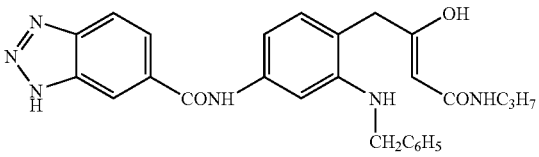

-continued
19
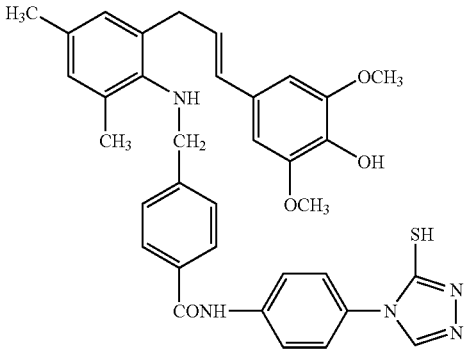
20
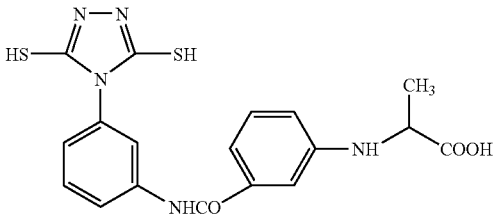
21
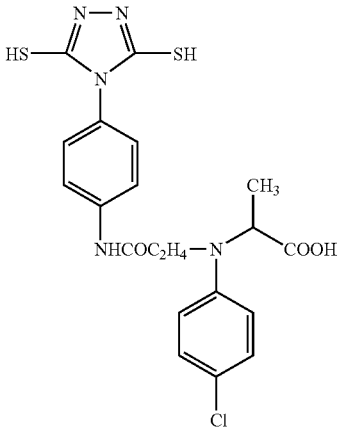
22
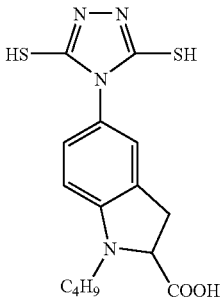
-continued
23
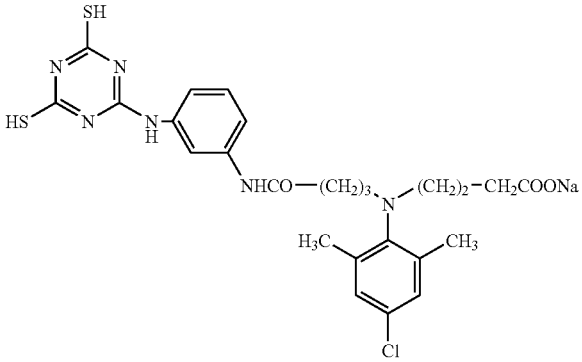
24
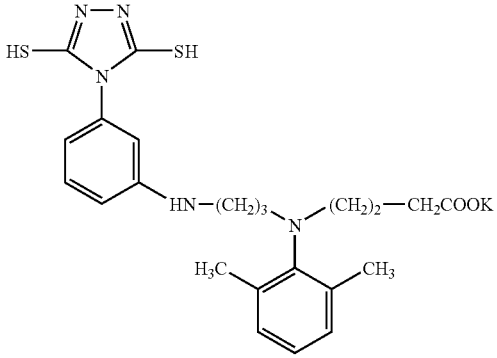
25
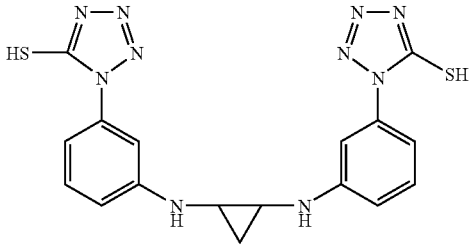
26
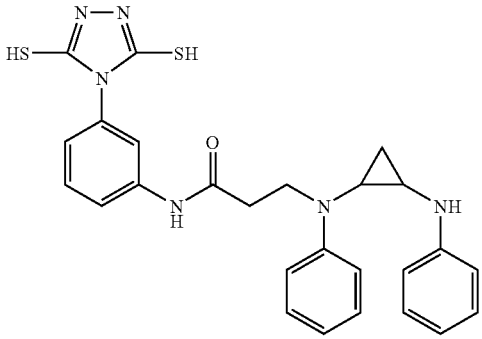
27
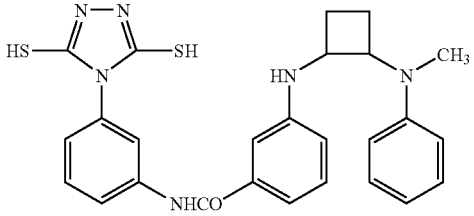

-continued
28
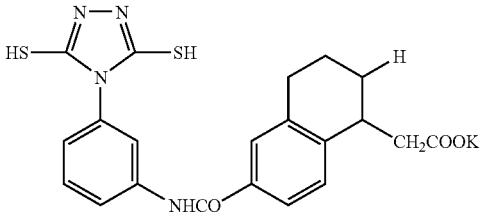
29
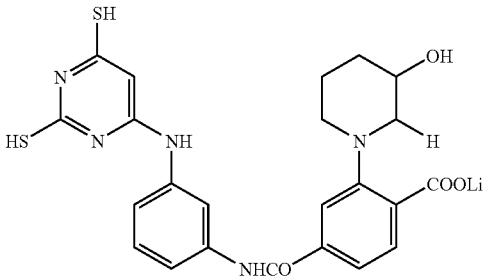
30
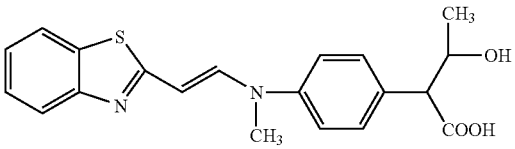
31
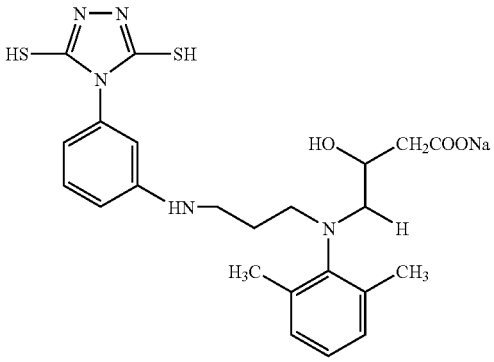
32
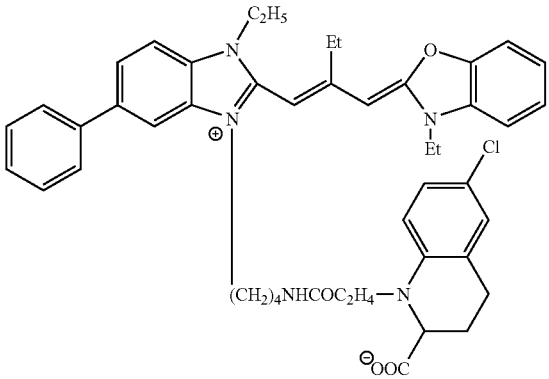
-continued
33
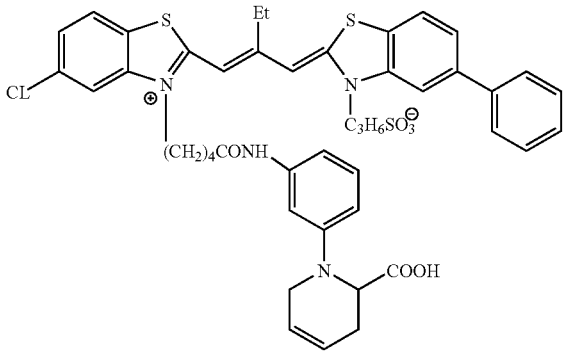
34
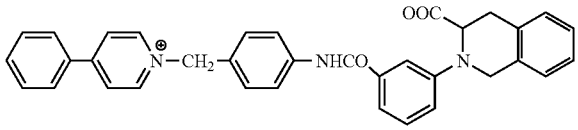
35
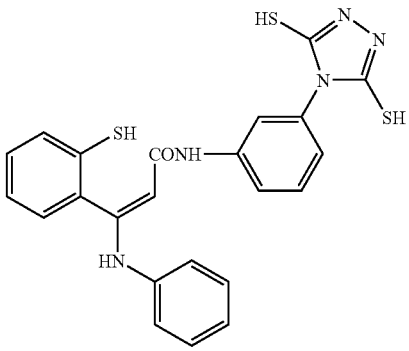
G-1
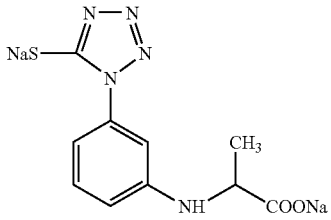
G-2
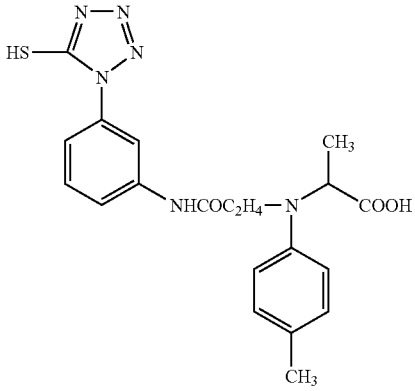

-continued

G-3

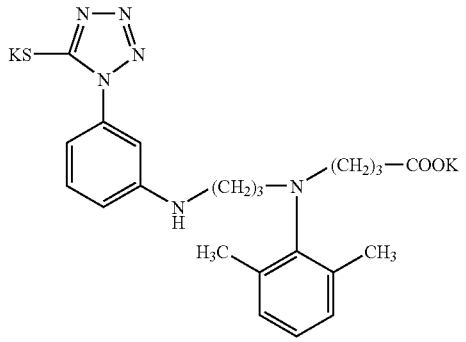

G-4

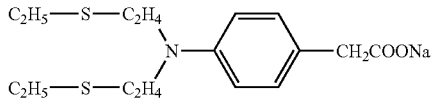

G-5

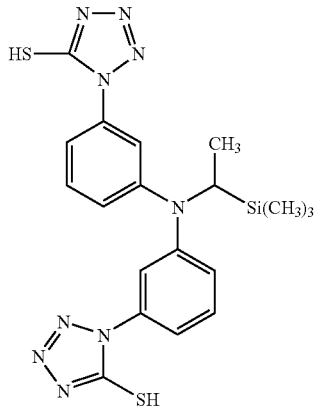

The compound of types 1 to 4 in the present invention may be those described in detail in JP-A Nos. 2003-114487, 2003-114486, 2003-140287, 2003-075950 and 2003-114488. Specific example compounds described in these patent literatures are also included in specific examples of the compound of types 1 to 4 in the present invention. Examples of synthesis of the compound of types 1 to 4 in the present invention may be those described in these patent literatures.

Specific examples of the compound of type 5 in the present invention further include examples of compounds referred to as a one-photon two-electron sensitizing agent and a deprotonation electron donating sensitizing agent described in JP-A No. 9-211769 (compounds PMT-1 to S-37 shown in Tables E and F at p. 28 to 32), JP-A No. 9-211774, JP-A No. 11-95355 (compound INV1 to 36), JP-W No. 2001-500996 (compounds 1 to 74, 80 to 87 and 92 to 122), U.S. Pat. Nos. 5,747,235 and 5,747,236, EP-A No. 786,692A1 (compounds INV1 to 35), EP-A No. 893,732A1, and U.S. Pat. Nos. 6,054,260 and 5,994,051.

The compound of types 1 to 5 in the present invention may be used in any occasion upon preparation of a photosensitive silver halide emulsion and production of a photothermographic material. For example, it may be added upon forming photosensitive silver halide particles, in a desalting process, in a chemical sensitization process, and before coating. It may also be added in plural times separately in the process. The occasion of addition is preferably from completion of formation of photosensitive silver halide particles until before a desalting step, upon chemical sensitization (immediately before starting chemical sensitization and immediately after the same), and before coating, and more preferably from chemical sensitization until before mixing with a non-photosensitive organic silver salt.

The compound of types 1 to 5 in the present invention is preferably added after dissolving in water, a water miscible solvent, such as methanol and ethanol, or a mixed solvent thereof. In the case where it is dissolved in water, the pH may be raised or lowered in the case of a compound that is increased in solubility upon raising or lowering the pH, followed by being added.

While the compound of types 1 to 5 in the present invention is preferably used in the image forming layer containing the photosensitive silver halide and the non-photosensitive organic silver salt, it may be also added to a protective layer and an intermediate layer, in addition to the image forming layer containing the photosensitive silver halide and the non-photosensitive organic silver salt, and may be diffused upon coating. The occasion of addition of the compound to the silver halide emulsion layer may be determined irrespective to before or after the spectral sensitizing dye in an amount of preferably from $1\times10^{-9}$ to $5\times10^{-1}$ mole, and more preferably from $1\times10^{-8}$ to $5\times10^{-2}$ mole, per 1 mole of silver halide.

10) Combination Use of Silver Halide

The photosensitive silver halide emulsion used in the photothermographic material of the present invention may be used solely or in combination of two or more kinds thereof (for example, those having different average particle sizes, different halogen compositions, different crystal habits, or different conditions for chemical sensitization). The use of plural kinds of silver halides having different sensitivities can adjust the gradation. Techniques relating thereto are described in JP-A Nos. 57-119341, 53-106125, 47-3929, 48-55730, 46-5187, 50-73627 and 57-150841. The difference in sensitivity is preferably 0.2 logE for the respective emulsions.

11) Coating Amount

The addition amount of the photosensitive silver halide, when expressed as the coating amount of silver per 1 $m^2$ of the photosensitive material, is within a range from 0.03 $g/m^2$ or more to 0.6 $g/m^2$ or less, more preferably, from 0.05 $g/m^2$ or more to 0.4 $g/m^2$ or less, most preferably, from 0.07 $g/m^2$ or more to 0.3 $g/m^2$ or less. The photosensitive silver halide, based on one mol of organic silver salt, is within a range preferably from 0.01 mol or more to 0.5 mol or less, more preferably, from 0.02 mol or more to 0.3 mol or less, further preferably, from 0.03 mol or more to 0.2 mol or less.

12) Mixing of Light Sensitive Silver Halide and Organic Silver Salt

Mixing method and mixing condition for a light sensitive silver halide and an organic silver salt prepared separately include a method of mixing silver halide particles and an organic silver salt completed for preparation respectively by a high speed stirrer, ball mill, sand mill, colloid mill, vibration mill or homogenizer, or a method of mixing a light sensitive silver halide completed for preparation at a certain timing during preparation of an organic silver salt thereby preparing an organic silver salt, with no particular restriction so long as a sufficient effect of the present invention is attained. Further, mixing of two or more kinds of aqueous dispersion of organic silver salts and two or more kinds of aqueous dispersions of light sensitive silver salts upon mixing is a preferred method for controlling photographic properties.

13) Mixing of Silver Halide to Coating Composition

The timing of adding the silver halide to the coating composition for forming the image forming layer in the present invention may be from 180 minutes before coating to immediately before coating, and preferably 60 minutes before coating to 10 seconds before coating. The mixing method and the mixing conditions are not particularly limited as far as the effect of the present invention can be sufficiently exerted. Specific examples of the mixing method include a method for mixing in a tank, in which the average residence time calculated from the addition flow amount and the liquid delivery amount to a coater is adjusted to a desired value, and a method using a static mixer described in N. Harnby, M. F. Edwards and A. W. Neinow, translation by K. Takahashi, Ekitai Kongo Gijutu (Liquid Mixing Technologies), chapter 8, (published by Nikkan Kogyo Shimbun, Ltd. on 1989).

<Binder>

The binder for the image forming layer in the present invention may be any polymer, and preferred examples of the binder include a transparent or translucent and generally colorless natural resin, polymer or copolymer, a synthetic resin, polymer or copolymer, or medium capable of forming a film. Examples thereof include a gelatin compound, a rubber compound, a poly(vinyl alcohol) compound, a hydroxyethylcellulose compound, a cellulose acetate compound, a cellulose acetate butyrate compound, a poly(vinylpyrrolidone) compound, casein, starch, a poly(acrylic acid) compound, a poly(methylmethacrylic acid) compound, a poly(vinyl chloride) compound, a poly(methacrylic acid) compound, a styrene-maleic anhydride copolymer, a styrene-acrylonitrile copolymer, a styrene-butadiene copolymer, a poly(vinylacetal) compound (such as poly(vinylformal) and poly(vinylbutyral)), a poly(ester) compound, a poly(urethane) compound, a phenoxy resin, a poly(vinylidene chloride) compound, a poly(epoxide) compound, a poly(carbonate) compound, a poly(vinyl acetate) compound, a poly(olefin) compound, a cellulose ester compound and a poly(amide) compound. The binder may be formed into a film through water, an organic solvent or an emulsion.

The binder used in the layer containing the organic silver salt preferably has a glass transition temperature of from 10 to 80° C., more preferably from 20 to 70° C., and further preferably from 23 to 65° C.

The glass transition temperature Tg in the present invention is calculated according to the following equation.

$$1/Tg=\Sigma(X_i/Tg_i)$$

It is assumed herein that the polymer is formed by copolymerizing n monomer components of from i=1 to n. $X_i$ represents the weight fraction of the i-th monomer (where $\Sigma X_i=1$), and $Tg_i$ represents the glass transition temperature (K) of a homopolymer of the i-th monomer, provided that Σ means the sum of i=1 to n.

The glass transition temperatures of the homopolymers of the respective monomers ($Tg_i$) are those described in J. Brandrup and E. H. Immergut, Polymer Handbook (3rd Edition) (Wiley-Interscience, Inc. (1989)).

The polymer used as the binder may be used solely or may be used in combination of two or more kinds thereof. A polymer having a glass transition temperature of 20° C. or more and a polymer having a glass transition temperature of less than 20° C. may be used in combination. In the case where two or more kinds of polymers having different glass transition temperatures are used in combination, it is preferred that the weight average glass transition temperature of the mixture is in the aforementioned range.

The performance in the present invention is improved in the following cases, i.e., the case where the image forming layer is formed by coating and drying a coating composition using a solvent containing 30% by mass or more of water, and the case where the binder of the image forming layer can be dissolved or dispersed in an aqueous solvent, and in particular, is formed with a polymer latex having an equilibrium water content at 25° C. 60% RH of 2% by mass or less.

In the most preferred embodiment, the binder is prepared to have an ionic electroconductivity of 2.5 mS/cm or less, and examples of the preparation method therefor include such a method in that the polymer is purified by using an isolation functional film after the synthesis thereof.

Examples of the aqueous solvent, in which the polymer is soluble or dispersible, include water and a mixed solvent containing water and 70% by mass or less water miscible organic solvent.

Examples of the water miscible organic solvent include an alcohol solvent, such as methyl alcohol, ethyl alcohol and propyl alcohol, a cellosolve solvent, such as methylcellosolve, ethylcellosolve and butylcellosolve, ethyl acetate, and dimethylformamide.

The term "aqueous solvent" is used also to a system in which the polymer is not dissolved thermodynamically but is present in a so-called dispersed state.

The equilibrium water content at 25° C. 60% RH can be expressed by the weight W 1 of the polymer in an equilibrium humidity state under an atmosphere at 25° C. 60% RH and the weight W0 of the polymer in the bone dry state.

$$\text{Equilibrium water content at 25° C. 60\% } RH=((W1-W0)/W0)\times 100 \text{ (\% by mass)}$$

The definition and the measurement method of the water content can be referred in Kobunshi Kogaku Koza 14, Kobunshi Zairyo Siken-ho (Lectures on Polymer Engineering 14, Test Method for Polymer Materials), edited by Society of Polymer Science, Japan (published by Chijin Shokan Co., Ltd.).

The equilibrium water content at 25° C. 60% RH of the binder polymer in the present invention is preferably 2% by mass or less, more preferably from 0.01 to 1.5% by mass, and further preferably from 0.02 to 1% by mass.

The binder in the present invention is particularly preferably a polymer that is dispersible in an aqueous solvent. Examples of the dispersion state include a latex having fine particles of a water insoluble hydrophobic polymer dispersed therein, and a state where polymer molecules are dispersed in a molecular state or through formation of micelles, both of which are preferred. The average particle diameter of the dispersed particles is generally from 1 to 50,000 nm, and preferably from 5 to 1,000 nm. The particle diameter distribution of the dispersed particles is not particularly limited, and those having a broad particle diameter distribution and those having a mono-dispersion particle diameter distribution may be used. Use of two or more of those having grain size distributions of mono dispersion in admixture is also a preferred method of use in view of control for the physical property of the coating solution.

As preferred embodiments of polymers dispersible to the aqueous solvent in the present invention, hydrophobic polymer such as acrylic polymers, poly(esters), rubbers (for example SBR resin), poly(urethanes), poly(vinyl chlorides), poly(vinyl acetates), poly(vinylidene chlorides), and poly (olefins) can be used preferably. The polymer may be a linear polymer or branched polymer, or crosslinked polymer, as well as it may be a so-called homopolymer in which single monomers are polymerized or a copolymer in which two or more kinds of monomers are polymerized. In the case of the copolymer, it may be either a random copolymer or a block copolymer. The molecular weight of the polymer in terms of a number average molecular weight is generally from 5,000 or more to 1,000,000 or less, and preferably from 10,000 or more to 200,000 or less. A polymer having a too small molecular weight is not preferred since it is insufficient in mechanical strength of the image forming layer, and that having a too large molecular weight is also not preferred since it exhibits poor film forming property. A crosslinked polymer latex is particularly preferably used.

(Specific Example of Polymer Latex)

Preferred examples of the latex polymer include those described below. In the following description, the polymers are expressed by raw material monomers, the numerals in parentheses are percent by mass, and the molecular weights are number average molecular weights. In the case where a polyfunctional monomer is used, a crosslinked structure is formed, and thus the molecular weight cannot be conceptually applied. These cases are expressed with the term "crosslinked", and indication of molecular weight is omitted. Tg represents a glass transition temperature.

P-1: latex of -MMA (70)-EA(27)-MAA(3) (molecular weight 37000, Tg 61° C.)

P-2: latex of -MMA (70)-2EHA(20)-St(5)-AA(5) (molecular weight 40000, Tg 59° C.)

P-3: latex of -St(50)-Bu(47)-MAA(3) (crosslinking, Tg −17° C.)

P-4: latex of -St(68)-Bu(29)-AA(3) (crosslinking, Tg 17° C.)

P-5: latex of -St(71)-Bu(26)-AA(3) (crosslinking, Tg 24° C.)

P-6: latex of -St(70)-Bu(27)-IA(3) (crosslinking)

P-7: latex of -St(75)-Bu(24)-AA(1) (crosslinking, Tg 29° C.)

P-8: latex of -St(60)-Bu(35)-DVB(3)-MAA(2) (crosslinking)

P-9: latex of -St(70)-Bu(25)-DVB(2)-AA (3) (crosslinking)

P-10: latex of -VC(50)-MMA(20)-EA(20)-AN(5)-AA(5) (molecular weight 80000)

P-11: latex of -VDC(85)-MMA(5)-EA(5)-MAA(5) (molecular weight 67000)

P-12: latex of -ET(90)-MAA(10) (molecular weight 12000)

P-13:—latex of St(70)-2EHA(27)-AA(3) (molecular weight 130000, Tg 43° C.)

P-14: latex of -MMA(63)-EA(35)-AA(2) (molecular weight of 33000, Tg 47° C.)

P-15: latex of -St(70.5)-Bu(26.5)-AA(3) (crosslinking, Tg 23° C.)

P-16: latex of -St(69.5)-Bu(27.5)-AA (3) (crosslinking, Tg 20.5° C.).

The abbreviations for the structure represent the following monomers. MMA; methyl methacrylate, EA; ethyl acrylate, MAA: methacrylic acid, 2EHA: 2-ethylhexylacrylate, St; styrene, Bu; butadiene, AA; acrylic acid, DVB; divinyl benzene, VC; vinyl chloride, AN; acrylonitrile, VDC; vinylidene chloride, Et; ethylene, IA; itaconic acid.

The polymer latexes described above are also commercially available and the following polymers can be utilized. They can include CEBIAN A-4635, 4718, 4601 (all manufactured by Dicel Chemical Industry Co. Ltd.), and Nipol Lx 811, 814, 821, 820, 857 (manufactured by Nippon Zeon Co.) as examples for the acrylic polymer, FINETEX, ES 650, 611, 675, 850 (manufactured by Dainippon Ink Chemical Co.), WD-size, WMS (manufactured by Eastman Chemical Co.) as examples for polyesters, HYDRAN AP 10, 20, 30 and 40 (manufactured by Dainippon Ink Chemical Co.) as examples for polyurethanes, LACSTAR 7310K, 3307B, 4700H and 7132C (manufactured by Dainippon Ink Chemical Co.), and Nipol Lx 416, 410, 438C and 2507 (manufactured by Nippon Zeon Co.) as examples for rubbers. G351, G576 (manufactured by Nippon Zeon Co.) as examples for polyvinyl chlorides, L 502, L513 (manufactured by Asahi Kasei Industry Co.) as examples for polyvinylidene chlorides, and CHEMIPAL S120, SA100 (manufactured by Mitsui Petrochemical Co.) as examples for polyolefins.

The polymer latexes described above may be used alone or two or more of them may be blended as required.

(Preferred Latex)

The polymer latex used in the present invention is particularly preferably a latex of a styrene-butadiene copolymer. The mass ratio of the styrene monomer unit and the butadiene monomer unit in the styrene-butadiene copolymer is preferably from 40:60 to 95:5.

In the copolymer formed by polymerizing two or more kinds of monomers, it is preferred that the total amount of the styrene monomer unit and the butadiene monomer unit is from 60% by mass or more to 99% by mass or less based on the amount of the copolymer. The copolymer in the present invention is preferably obtained by polymerizing by adding acrylic acid or methacrylic acid in an amount of from 1% by mass or more to 6% by mass or less based on the total amount of styrene and butadiene, and more preferably by adding acrylic acid or methacrylic acid in an amount of from 2% by mass or more to 5% by mass or less. In particular, a polymer obtained by polymerizing by adding acrylic acid is preferred. The preferred molecular weight of the copolymer is the same as that described hereinabove.

Specific examples of the preferred latex of a styrene-butadiene copolymer include P-3 to P-8 and P-15, as well as LACSTAR-3307B and 7132C, and NIPOL LX 416, which are commercially available products.

A hydrophilic polymer such as gelatin, polyvinyl alcohol, methyl cellulose, hydroxypropyl cellulose and carboxymethyl cellulose may be added optionally to the image forming layer of the photosensitive material in the present invention. In the image forming layer, the content of the hydrophilic polymer is preferably from 30% by mass or less and, more preferably, 20% by mass or less, based on the total binder of the image forming layer.

The layer containing the organic silver salt (i.e., the image forming layer) of the present invention is preferably formed by using a polymer latex. The amount of the binder in the image forming layer in terms of the mass ratio of (total binder)/(organic silver salt) is generally from 1/10 to 10/1, preferably from 1/3 to 5/1, and more preferably from 1/1 to 3/1.

The image forming layer is generally an emulsion layer containing a photosensitive silver halide, which is a photosensitive silver salt, and in this case, the mass ratio of (total binder)/(silver halide) is generally from 400 to 5, and preferably from 200 to 10.

The total amount of the binder in the image forming layer in the present invention is preferably from 0.2 $g/m^2$ or more to 30 $g/m^2$ or less, more preferably from 1 $g/m^2$ or more to 15 $g/m^2$ $g/m^2$ or less, and further preferably from 2 $g/m^2$ or more to 10 $g/m^2$ $g/m^2$ or less. The image forming layer in the present invention may further contain a crosslinking agent for crosslinking, a surface active agent for improving coating property, and the like.

<Preferred Solvent for Coating Solution>

The solvent of the coating composition for the image forming layer of the photosensitive material in the present invention (herein, a solvent and a dispersion medium are totally referred to as a solvent for convenience) is preferably an aqueous solvent containing 30% by mass or more water. The component other than water may be an arbitrary water miscible organic solvent, such as methyl alcohol, ethyl alcohol, isopropyl alcohol, methylcellosolve, ethylcellosolve, dimethylformamide and ethyl acetate. The water content of the solvent is more preferably 50% by mass or more, and further preferably 70% by mass or more.

Specific examples of the preferred solvent composition include 100% by mass of water, water/methyl alcohol=90/10, water/methyl alcohol=70/30, water/methyl alcohol/dimethylformamide=80/15/5, water/methyl alcohol/ethylcellosolve=85/10/5, and water/methyl alcohol/isopropyl alcohol=85/10/5 (all the numerals indicate percentages by mass).

<Anti-Foggant>

The anti-foggant, the stabilizing agent and the stabilizing agent precursor usable in the present invention can include those described in JP-A No. 10-62899, in column No. 0070, EP-A No. 0,803,764A1, in page 20, line 57—page 21, line 7, compounds described in JP-A Nos. 9-281637 and 9-329864, compounds described in U.S. Pat. No. 6,083,681, and EP Patent No. 1048975. Further, the anti-foggant used preferably in the present invention is an organic halogen compound and includes those disclosed in JP-A No. 11-65021, in column Nos. 0111 to 0112. Particularly, the organic halogen compound represented by the formula (P) in JP-A No. 2000-284399, the organic polyhalogen compound represented by the general formula (II) in JP-A No. 10-339934 and the organic polyhalogen compounds described in JP-A Nos. 2001-31644 and 2001-33911 are preferred.

<Polyhalogen Compound>

Preferred organic polyhalogen compounds in the present invention are to be described specifically.

The preferred polyhalogen compound in the present invention is a compound represented by the following general formula (H).

$$Q\text{-}(Y)_n\text{—}C(Z_1)(Z_2)X \qquad \text{General formula (H)}$$

In the general formula (H), Q represents an alkyl group, aryl group or heterocyclic group, Y represents a bivalent connection group, n represents 0 or 1, $Z_1$ and $Z_2$ each represents a halogen atom and X represents a hydrogen atom or an electron attracting group.

In the general formula (H), Q is preferably an aryl group or a heterocyclic group. In the general formula (H), in a case where Q is a heterocyclic group, a nitrogen-containing heterocyclic group containing 1 or 2 nitrogen atom is preferred and 2-pyridyl group or 2-quinolyl group is particularly preferred.

In the general formula (H), in a case where Q is an aryl group, Q preferably represents a phenyl group substituted with an electron attracting group in which the Hammett's substituent group constant σp takes a positive value. For the Hammett's substituent constant, Journal of Medicinal Chemistry, 1973, vol. 16, No. 11, pages 1207–1216 etc. can be referred to. The electron attracting group described above can include, for example, halogen atom (fluorine atom (σp value: 0.06), chlorine atom (σp value: 0.23), bromine atom (σp value: 0.23), iodine atom (σp value: 0.18)), trihalomethyl group (tribromomethyl (σp value: 0.29), trichloromethyl (σp value: 0.33), trifluoromethyl (σp value: 0.54)), cyano group (σp value: 0.66), nitro group (σp value: 0.78), aliphatic aryl, or heterocyclic sulfonyl group (for example, methanesulfonyl (σp value: 0.72)), aliphatic aryl or heterocyclic, acyl group (for example, acetyl (σp value: 0.50), benzoyl (σp value: 0.43)), alkinyl group (for example, C≡CH (σp value: 0.23)), aliphatic.aryl or heterocyclic oxy carbonyl group (for example, methoxy carbonyl (σp value: 0.45), phenoxy carbonyl (σp value: 0.44)), carbamoyl group (σp value: 0.36), sulfamoyl group (σp value: 0.57), sulfoxide group, heterocyclic group, and phosphoryl group. The σp value is, preferably, within a range from 0.2 to 2.0 and, more preferably, from 0.4 to 1.0. Particularly, preferred electron attracting groups are carbamoyl group, alkoxycarbonyl group, alkylsulfonyl group, and alkylphosphoryl group, with carbamoyl group being most preferred among them. X is preferably an electron attracting group and, more preferably, a halogen atom, aliphatic aryl or heterocyclic sulfouyl group aliphatic aryl or heterocyclic acyl group, aliphatic aryl or heterocyclic oxycarbonyl group, carbamoyl group, and sulfamoyl group, with the halogen atom being particularly preferred. Among the halogen atoms, preferred are chlorine atom, bromine atom and iodine atom, and further preferred are chlorine atom and bromine atom, with the bromine atom being particularly preferred.

Y represents, preferably, —C(═O)—, —SO— or —$SO_2$— and, more preferably, —C(═O)—, and —$SO_2$— and, particularly preferably, —$SO_2$—. N represents 0 or 1 and, preferably, 1.

Specific examples of the compounds of the general formula (H) of the present invention are shown below.

(H-1)

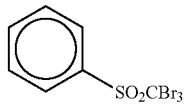

(H-2)

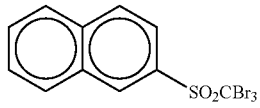

(H-3)

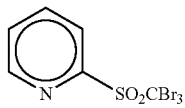

(H-4)

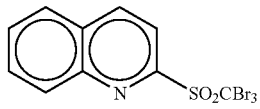

(H-5)

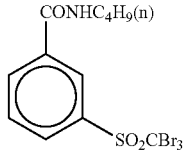

-continued (H-6)

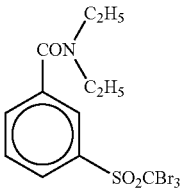

(H-7)

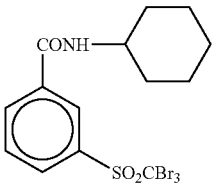

(H-8)

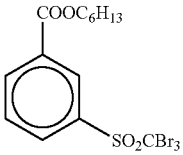

(H-9)

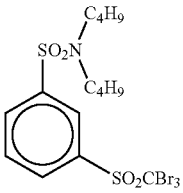

(H-10)

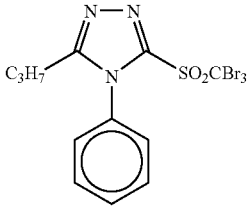

(H-11)

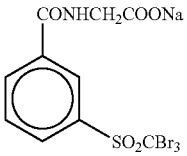

(H-12)

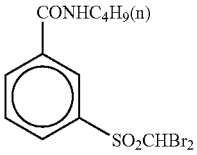

(H-13)

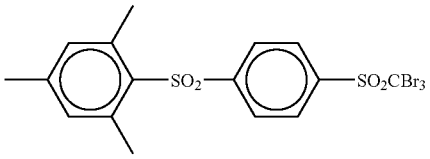

(H-14)

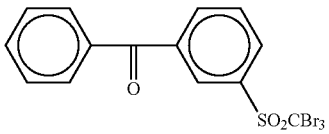

-continued (H-15)

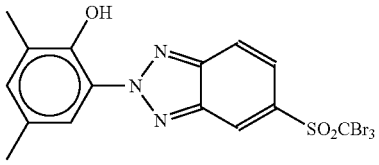

Preferred polyhalogen compound in the present invention other than those described above can include those compounds described in JP-A Nos. 2001-31644, 2001-56526, and 2001-209145.

The compound represented by the general formula (H) in the present invention is used, based on 1 mol of the non-photosensitive silver salt of the image forming layer, preferably, within a range from $10^{-4}$ mol or more to 1 mol or less, more preferably, within a range from $10^{-3}$ mol or more to 0.5 mol or less and, further preferably, within a range from $1\times10^{-2}$ mol or more to 0.2 mol or less.

In the present invention, the method of incorporating the anti-foggant in the photosensitive material can include a method as described for the method of incorporating the reducing agent, and also the organic polyhalogen compound is preferably added as a fine solid particle dispersion.

<Other Anti-Foggant>

Other anti-foggants can include mercury (II) salt in column No. 0113 and benzoic acids in column No. 0114 of JP-A No. 11-65021, salicylic acid derivative in JP-A 2000-206642, a formalin scavenger compound represented by the formula (S) in JP-A No. 2000-221634, a triazine compound according to claim 9 of JP-A No. 11-352624, a compound represented by the general formula (III) of JP-A No. 6-11791, and 4-hydroxy-6-methyl-1,3,3a,7-tetrazaindene.

The photothermographic material in the present invention may also contain an azolium salt with an aim of preventing fogging. The azolium salt can include the compound represented by the general formula (XI) described in JP-A No. 59-193447, the compound described in JP-B No. 55-12581, and the compound represented by the general formula (II) described in JP-A No. 60-153039. The azolium salt may be added at any portion in the photosensitive material and it is preferably added as the addition layer to the layer of the surface having the image forming layer and, further preferably, added to the image forming layer. For the addition timing, the azolium salt may be added at any step for the preparation of the coating solution. In a case where it is added to the image forming layer, it may be added at any step from the preparation of the organic silver salt to the preparation of the coating solution, and it is preferably added in the course after the preparation of the organic silver salt to immediately before coating. The azolium salt may be added by any method such as in the form of powder, solution and fine particle dispersion. Further, it may also be added as a solution in admixture with other additives such as the sensitizing dye, reducing agent or color toning agent. In the present invention, the azolium salt may be added in any amount and it is preferably $1\times10^{-6}$ mol or more and 2 mol or less and, further preferably, $1\times10^{-3}$ mol or more and 0.5 mol or less per 1 mol of silver.

<Other Additives>

1) Mercaptos, Disulfides and Thions

A mercapto compound, a disulfide compound and a thione compound may be added to the photothermographic material of the present invention in order to suppress, accelerate or control the development, to improve the spectral sensitization efficiency, and to improve the storage stability before and after development. Examples thereof include compounds described in paragraphs 0067 to 0069 of JP-A No. 10-62899 and a compound represented by the general formula (I) in JP-A No. 10-186527, with specific example compounds thereof being described in paragraphs 0033 to 0052 of the same literature, and compounds described in page 20, lines 36 to 56 of EP-A No. 0,803,764A1. Among them, mercapto-substituted heterocyclic aromatic compounds described in JP-A Nos. 9-297367, 9-304875, 2001-100358, 2002-303954, and 2002-303951 are preferred.

2) Color Toning Agent

A color toner is preferably added to the photothermographic material of the present invention. The color toner is described in paragraphs 0054 to 0055 of JP-A No. 10-62899, page 21, lines 23 to 48 of EP-A No. 0,803,764A1, and JP-A No. 2000-356317. In particular, preferred examples thereof include a phthalazinone compound (such as phthalazinone, a phthalazinone derivative and a metallic salt thereof, e.g., 4-(1-naphthyl)phthalazinone, 6-chlorophthalazinone, 5,7-dimethoxyphthalazinone and 2,3-dihydro-1,4-phthalazinone), a combination of a phthalazinone compound and a phthalic acid compound (such as phthalic acid, 4-methylphthalic acid, 4-nitrophthalic acid, diammonium phthalate, sodium phthalate, potassium phthalate and tetrachlorophthalic anhydride), and a phthalazine compound (such as phthalazine, a phthalazine derivative and a metallic salt thereof, e.g., 4-(1-naphthylphthalazine, 6-isopropylphthalazine, 6-t-butylphthalazine, 6-chlorophthalazine, 5,7-dimethoxyphthalazine and 2,3-dihydrophthalazine), and in the case of a combination with a silver halide having a high silver iodide content, a combination of a phthalazine compound and a phthalic acid compound is particularly preferred.

3) Plasticizer, Lubricant

Examples of a plasticizer and a lubricant that can be used in the image forming layer in the present invention are described in paragraph 0117 of JP-A No. 11-65021. Examples of a lubricant are also described in paragraphs 0061 to 0064 of JP-A No. 11-84573.

4) Dye, Pigment

Various kinds of dyes and pigments may be used in the image forming layer in the present invention from the standpoint of improvement of color tone, prevention of formation of interference band upon laser exposure, and prevention of irradiation, such as C.I. Pigment Blue 60, C.I. Pigment Blue 64 and C.I. Pigment Blue 15:6). These are described in detail in WO98/36322 and JP-A Nos. 10-268465 and 11-338098.

5) Super-Hard Toner

In order to form a super hard tone image suitable for prepress purpose, a super hard toner is preferably added to the image forming layer. Examples of the super hard toner, and an addition method and an addition amount thereof can be referred in paragraph 0118 of JP-A No. 11-65021, paragraphs 0136 to 0139 of JP-A No. 11-223898 and compounds represented by formulae (H), (1) to (3), (A) and (B) in JP-A No. 2000-284399, and examples of a super hard tone accelerator can be referred in paragraph 0102 of JP-A No. 11-65012 and paragraphs 0194 to 0195 of JP-A No. 11-223898.

In the case where forminc acid or a formate salt is used as a strong fogging agent, it is preferably added on the side where the image forming layer coutaining a photosensitive silver halide is formed in an amount of 5 mmole or less, and more preferably 1 mmole or less, per 1 mole of silver.

In the case where a super hard toner is used in the photothermographic material of the present invention, it is preferred to use an acid obtained by hydrating diphosphorous pentoxide or a salt thereof in combination. Examples of the acid obtained by hydrating diphosphorous pentoxide or a salt thereof include metaphosphoric acid (or a salt thereof, pyrophosphoric acid (or a salt thereof), orthophosphoric acid (or a salt thereof, triphosphoric acid (or a salt thereof), tetraphosphoric acid (or a salt thereof) and hexametaphosphoric acid (or a salt thereof, and particularly preferred examples of the acid obtained by hydrating diphosphorous pentoxide or a salt thereof include orthophosphoric acid (or a salt thereof) and hexametaphosphoric acid (or a salt thereof). Specific examples of the salt include sodium orthophosphate, sodium dihydrogen orthophosphate, sodium hexametaphosphate and ammonium hexametaphosphate.

The using amount (a coated amount per 1 $m^2$ of the photosensitive material) of the acid obtained by hydrating diphosphorous pentoxide or a salt thereof may be a desired amount corresponding to the performance, such as sensitivity and fogging, and is preferably from 0.1 $mg/m^2$ or more to 500 $mg/m^2$ or less, and more preferably from 0.5 $mg/m^2$ or more to 100 $mg/m^2$ or less.

The reducing agent, the hydrogen bonding compound, the development accelerator and the polyhalogen compound in the present invention are preferably used as solid dispersion, and a preferred method of preparing the solid dispersions is described in JP-A No. 2002-55405.

<Preparation and Coating of Coating Solution>

The preparation temperature of the coating composition for forming the image forming layer in the present invention is preferably from 30 to 65° C., more preferably 35° C. or more and less than 60° C., and further preferably from 35 to 55° C. The temperature of the coating composition for forming the image forming layer immediately after adding the polymer latex is preferably maintained at a temperature of from 30 to 65° C.

<Other Layer Constitution and Constituent Ingredient>

1) Anti-Halation Layer

In the photothermographic material of the present invention, an anti-halation layer may be provided on the side far from an exposure light source with respect to the image forming layer. The anti-halation layer is described, for example, in paragraphs 0123 to 0124 of JP-A No. 11-65021, and JP-A Nos. 11-223898, 9-230531, 10-36695, 10-104779, 11-231457, 11-352625 and 11-352626.

The anti-halation layer contains an anti-halation dye that has absorption at the exposure wavelength. In the case where the exposure wavelength is in an infrared region, an infrared ray absorbing dye can be used, and in this case, such a dye that does not have absorption in a visible range is preferred.

In the case where halation is prevented by using a dye having absorption in a visible range, it is preferred that the color of the dye does not remain after forming an image. In this case, such a measure is preferably employed that is decolored through heat of thermal development, and it is particularly preferred that a heat decoloring dye and a base precursor are added to a non-photosensitive layer to function as an anti-halation layer. The techniques are described in JP-A No. 11-231457.

The addition amount of the decoloring dye is determined depending on the purpose of the dye. In general, it is used in such an amount that provides an optical density (light absorbance) measured at the objective wavelength exceeding 0.1, preferably from 0.15 to 2, more preferably from 0.2 to 1. The using amount of the dye for providing the optical density is generally about from 0.001 to 1 g/m$^2$.

The optical density after thermal development can be decreased to 0.1 or less by decoloring the dye. Two or more kinds of decoloring dye may be used in combination in a thermal decoloring recording material or a photothermographic material. Similarly, two or more kinds of base precursors may be used in combination.

In the thermal decoloring system using a decoloring dye and a base precursor, it is preferred to use such a substance that decreases the melting point of the base precursor by 3° C. or more upon mixing therewith (such as diphenylsulfone and 4-chlorophenyl(phenyl)sulfone), from the standpoint of thermal decoloring property.

2) Back Layer

The back layer that can be used in the present invention is described in paragraphs 0128 to 0130 of JP-A No. 11-65021.

In the present invention, a coloring agent having an absorption maximum at a wavelength of from 300 to 450 nm may be added to improve the silver color tone and the time-lapse stability of an image. The coloring agent is described in JP-A Nos. 62-210458, 63-104046, 63-103235, 63-208846, 63-306436, 63-314535, 1-61745 and 2001-100363.

The coloring agent is generally added in an amount of from 0.1 to 1 g/m$^2$, and a layer, to which the coloring agent is added, is preferably a back layer provided on the side opposite to the image forming layer.

Further, for controlling the basic tone, it is preferred to use a dye having an absorption peak at 580 to 680 nm. As the dye for this purpose, azomethine type oil soluble dye with small absorption intensity on the side of short wavelength described in JP-A Nos. 04-359967 and 04-359968, and phthalocyanine type water soluble dyes are preferred. The dye for this purpose may be added to any layer and it is more preferred to be added to the non-light sensitive layer on the emulsion surface or back surface.

3) Film Surface pH

The photothermographic material of the present invention preferably has a film surface pH before thermal development of 7.0 or less, and more preferably 6.6 or less. The lower limit thereof is not particularly limited and is generally about 3. The film surface pH is most preferably in a range of from 4 to 6.2.

Adjustment of the film surface pH is preferably attained by using an organic acid, such as a phthalic acid derivative, a non-volatile acid, such as sulfuric acid, or a volatile base, such as ammonia, from the standpoint of reduction of the film surface pH. In particular, ammonia is preferred since it is liable to vaporize and thus can be removed before coating or thermal development to attain a low film surface pH.

It is also preferred that a non-volatile base, such as sodium hydroxide, potassium hydroxide and lithium hydroxide, is used in combination with ammonia. The measurement method of the film surface pH is described in paragraph 0123 of JP-A No. 2000-2843997.

4) Film Hardener

A film hardener may be used in various layers in the present invention, such as the image forming layer, the protective layer and the back layer.

Examples of the film hardener include methods described in T. H. James, The Theory of The Photographic Process, Fourth Edition, (published by Macmillan Publishing Co., Inc. on 1977), p. 77 to 78, and in addition to chrome alum, 2,4-dichloro-6-hydroxy-s-triazine sodium salt, N,N-ethylenebis(vinylsulfoneacetamide) and N,N-propylenebis(vinylsulfoneacetamide), polyvalent metallic ions described on page 78 of the aforementioned literature, polyisocyanate compounds described in U.S. Pat. No. 4,281,060 and JP-A No. 6-208193, an epoxy compound described in U.S. Pat. No. 4,791,042, and a vinylsulfone compound described in JP-A No. 62-89048 are preferably used.

The film hardener is added in the form of a solution, and the addition of the solution to the coating composition for the protective layer may be attained from 180 minutes before coating to immediately before coating, and preferably from 60 minutes before coating to 10 second before coating, but the mixing method and the mixing conditions are not particularly limited as far as the effect of the present invention is sufficiently exerted.

Specific examples of the mixing method include a method for mixing in a tank, in which the average residence time calculated from the addition flow amount and the liquid delivery amount to a coater is adjusted to a desired value, and a method using a static mixer described in N. Harnby, M. F. Edwards and A. W. Neinow, translation by K. Takahashi, Ekitai Kongo Gijutu (Liquid Mixing Technologies), chapter 8, (published by Nikkan Kogyo Shimbun, Ltd. on 1989).

5) Surface Active Agent

The surface active agent applicable in the present invention is described in JP-A No. 11-65021, in column No. 0132. The solvent is described in column No. 0133, the support is described in column No. 0134, the anti-static or conductive layer is described in column No. 0135, the method of obtaining the color image is described in column No. 0136, and the slipping agent is described in JP-A No. 11-84573, column Nos. 0061–0064.

In the present invention, a fluoro surface active agent is used preferably. The fluoro compound described above is particularly preferred.

In the present invention, the fluoro surface active agent can be used either to the image forming layer surface or to the back surface and it is preferred to use the surface active agent for both surfaces.

6) Anti-Static Agent

In the present invention, it is preferred to provide a conductive layer containing metal oxides or conductive polymers. The anti-static layer may be used also as a undercoating layer, back layer surface protection layer or the like, or it may be disposed separately. As a conductive material in the anti-static layer, metal oxides whose conductivity is improved by introducing oxygen vacancies or heterogeneous metal atoms into metal oxides are preferred. As examples of the metal oxides, ZnO, $TiO_2$, and $SnO_2$ are preferred. It is preferred to add Al or In for ZnO, add Sb, Nb, P or halogen element for $SnO_2$, and Nb or Ta for $TiO_2$. Particularly, $SnO_2$ with addition of Sb is preferred. The addition amount of the hetero atom is within a range, preferably, from 0.01% by mole or more to 30% by mole or less, and, more preferably, within a range from 0.1% by mole or more to 10% by mole or less. The shape of the metal oxide may be any of spherical, needle-like or plate-like shape, and a needle-like particle with the major axis/minor axis ratio of 2.0 or more, preferably, from 3.0 to 50 is preferred with a view point of providing the conductivity.

The amount of the metal oxide to be used is, preferably, within a range from 1 mg/m$^2$ or more to 1000 mg/m$^2$ or less, more preferably, within a range from 10 mg/m$^2$ or more to 500 mg/m$^2$ or less and, further preferably, within a range from 20 mg/m$^2$ or more to 200 mg/m$^2$ or less. The anti-static layer of the present invention may be disposed either on the side of the emulsion surface or on the side of the back surface, and it is preferably disposed between the support and the back layer. specific examples of the anti-static layer in the present invention are described in JP-A No. 11-65021, in column No 0135, JP-A Nos. 56-143430, 56-143431, 58-62646, 56-120519, 11-84573, in column Nos. 0040–0051, U.S. Pat. No. 5,575,957, and JP-A No. 11-223898 in column Nos. 0078–0084.

7) Support

As a transparent support, a polyester having been subjected to a heat treatment at a temperature of from 130 to 185° C., particularly polyethylene terephthalate, is preferably used in order to relax the internal stress remaining in the film upon biaxial stretching to reduce distortion due to thermal shrinkage occurring upon thermal development processing. In the case of a photothermographic material for medical use, the transparent support may be colored with a blue dye (for example, Dye-1 described in Example of JP-A No. 8-240877) or may not be colored. An undercoating technique, such as a water soluble polyester described in JP-A No. 11-84574, a styrene-butadiene copolymer described in JP-A No. 10-186565, and a vinylidene chloride copolymer described in JP-A No. 2000-39684, is preferably applied to the support. The water content of the support is preferably 0.5 masst % or less when the image forming layer or the back layer is coated on the support.

8) Other Additives

The photothermographic material may further contain an antioxidant, a stabilizing agent, a plasticizer, an UV absorbent and a coating aid. The additives are added to the image forming layer or the non-photosensitive layer. These can be referred in WO98/36322, EP-A No. 803,764A1, and JP-A Nos. 10-186567 and 10-18568.

9) Coating Method

The photothermographic material may be formed by coating by any method. Specific examples of the coating method include various kinds of coating operations, such as extrusion coating, slide coating, curtain coating, dip coating, knife coating, flow coating, and extrusion coating using a hopper described in U.S. Pat. No. 2,681,294, and extrusion coating described in Stephen F. Kistler and Petert M. Schweizer, Liquid Film Coating, (published by Chapman & Hall, Inc. (1997)), p. 399 to 536, and slide coating are preferably employed, with slide coating being particularly preferably used. Examples of the shape of the slide coater used in slide coating are shown in p. 427, FIG. 11*b*.1 of the aforementioned literature. Two or more layers may be simultaneously coated according to methods described in p. 399 to 536 of the aforementioned literature, U.S. Pat. No. 2,761,791 and British Patent No. 837,095. Particularly, preferred coating methods in the present invention are described in JP-A Nos. 2001-194748, 2002-153808, 2002-153803, and 2002-182333.

The image forming layer coating solution in the present invention is preferably a so-called thixotropic fluid. For the technique, JP-A No. 11-52509 can be referred to. The image forming layer coating solution in the present invention has a viscosity of, preferably, 400 mPa·s or more and 100,000 mPa·s or less, more preferably, 500 mPa·s or more and 20,000 mPa·s or less at a shearing speed of 0.1 S$^{-1}$. It is, preferably 1 mPa·s or more and 200 mPa·s or less and, more preferably, 5 mPa·s or more and 80 mPa·s or less at a shearing speed of 1000 S$^{-1}$.

When two kinds of solutions are mixed in a case of preparing a coating solution of the present invention, known inline mixer and implant mixer are used preferably. A preferred inline mixer for the present invention is described in JP-A No. 2002-85948 and implant mixer is described in JP-A No. 2002-90940.

A defoaming treatment is applied preferably for the coating solution in the present invention in order to keep the state of the coated surface favorable. A preferred defoaming method in the present invention is described in JP-A No. 2002-66431.

When the coating solution of the present invention is coated, charge elimination is applied preferably in order to prevent deposition of dusts and darts caused by charging to the support. An example of a preferred charge elimination method in the present invention is described in JP-A No. 2002-143747.

In the present invention, it is important to accurately control a drying blow and a drying temperature for drying a image forming layer coating solution. A preferred drying method in the present invention is described specifically in JP-A Nos. 2001-194749 and 2002-139814.

For improving the film-forming property of the photothermographic material of the present invention, a heating treatment is applied preferably just after coating and drying. The temperature for the heat treatment is preferably within a range from 60° C. to 100° C. as the film surface temperature, and the heating time is preferably within a range from 1 sec to 60 sec. More preferred range comprises 70 to 90° C. for the film surface temperature and 2 to 10 sec for the heating time. The preferred heat treatment method in the present invention is described in JP-A No. 2002-107872.

Further, for continuously producing the photothermographic material of the present invention stably, a production method described in JP-A Nos. 2002-156728 or 2002-182333 is used preferably.

The photothermographic material is preferably a monosheet type (type capable of forming images on a photothermographic material without using other sheet such as an image receiving material).

10) Packaging Material

The photothermographic material of the present invention is preferably hermetically packed with a packaging material that is low in oxygen permeability and/or water permeability in order to prevent deterioration in photographic performance during storage before use, and to prevent curling due to winding in the case of a rolled product. The oxygen permeability at 25° C. is preferably 50 mL/atm/m$^2$·day or less, more preferably 10 mL/atm/m$^2$·day or less, and further preferably 1.0 mL/atm/m$^2$·day or less. The water permeability is preferably 10 g/atm/m$^2$·day or less, more preferably 5 g/atm/m$^2$·day or less, and further preferably 1 g/atm/m$^2$·day or less. Specific examples of a packaging material that is low in oxygen permeability and/or water permeability include those described in JP-A Nos. 8-254793 and 2000-206653.

14) Other Usable Techniques

The techniques that can be used for the photothermographic material of the present invention can also include those described in, EP No. 803764A1, EP No. 883022A1, WO98/36322, JP-A Nos. 56-62648, 58-62644, 09-43766, 09-281637, 09-297367, 09-304869, 09-311405, 09-329865, 10-10669, 10-62899, 10-69023, 10-186568, 10-90823, 10-171063, 10-186565, 10-186567, 10~186569, 10-186572, 10-197974, 10-197982, 10-197983, 10-197985~10-197987, 10-207001, 10-207004, 10-221807, 10-282601, 10-288823, 10-288824, 10-307365, 10-312038, 10-339934, 11-7100, 11-15105, 11-24200, 11-24201, 11-30832, 11-84574, 11-65021, 11-109547, 11-125880, 11-129629, 11-133536, 11-133539, 11-133542, 11-133543, 11-223898, 11-352627, 11-305377, 11-305378, 11-305384, 11-305380, 11-316435, 11-327076, 11-338096, 11-338098, 11-338099, 11-343420, JP-A Nos. 2000-187298, 2000-10229, 2000-47345, 2000-206642, 2000-98530, 2000-98531, 2000-112059, 2000-112060, 2000-112104, 2000-112064, and 2000-171936.

In the case of the multi-color photothermographic material, the respective emulsion layers are generally maintained separately from each other with a functional or non-functional barrier layer intervening therebetween as described in U.S. Pat. No. 4,460,681.

The constitution of the multi-color photothermographic material may contain a combination of the two layers for the respective colors, or in alternative, all the components may be contained in one layer as described in U.S. Pat. No. 4,708,928.

3. Image Forming Method

1) Exposure

He—Ne laser emitting red-infrared light, a red semiconductor laser or $Ar^+$, He—Ne, He—Cd laser emitting blue-green light, and a blue semiconductor laser are used. The red to infrared semiconductor laser is preferred. The peak wavelength of the laser light is 600 nm to 900 nm and, preferably, 620 nm to 850 nm.

On the other hand, in recent years, a module formed by integrating an SHG (second harmonic generation) element and a semiconductor laser, and a blue semiconductor laser have been developed, and thus a laser output device in a short wavelength range is receiving attention. The blue semiconductor laser is expected to show increasing demand since it can attain high-definition image recordation, increased recording density, and stable output with prolonged service life. The peak wavelength of the blue laser light is, preferably, 300 nm to 500 nm and, particularly, 400 nm to 500 nm.

Laser light that exhibits vertical multiple vibration by high frequency convolution can be preferably used.

2) Heat Development

The photothermographic material of the present invention may be developed by any method and, usually, a photothermographic material exposed imagewise is developed by temperature elevation. A preferred developing temperature is within a range from 100° C. to 140° C. and, more preferably, from 110° C. to 130° C. The developing time is, preferably, 18 sec or less, more preferably, from 6 sec to 16 sec and, further preferably, from 8 sec to 14 sec. As a combination of the developing temperature and the developing time, 100° C. to 140° C. and 18 sec or less are preferred and, 110° C. to 130° C. and 8 sec to 14 sec are more preferred.

As the heat developing system, either a drum type heater or a plate type heater may be used, and the plate heater method is more preferred. As the thermal development method using a plate heater system, a method described in JP-A No. 11-133572 is preferred, which is a thermal development device for obtaining a visible image by contacting a photothermographic material having a latent image formed thereon with a heating means at a thermal development part. In the thermal development device, the heating means contains a plate heater and plural holding rollers disposed opposed to and along one surface of the plate heater, and the photothermographic material is passed between the holding rollers and the plate heater to effect thermal development. It is preferred that the plate heater is divided into two to six stages, and the temperature of the top end thereof is decreased by 1 to 10° C. For example, 4 sets of plate heaters which can be temperature-controlled independently are used and they are controlled to 112° C., 119° C., 121° C. and 120° C., respectively. The aforementioned method is also described in JP-A No. 54-30032, by which water and an organic solvent contained in the photothermographic material can be removed to the exterior of the system, and change of the shape of the support due to rapid heating of the photothermographic material can be suppressed.

In the present invention, it is preferred that the transportation rollers in the thermal development station is formed of rubber or resin at the surface. Among them, rubber is more preferred and silicon rubber or fluoro rubber is particularly preferred with a view point of heat resistance and chemical resistance.

For reducing the size of the heat developing machine and shortening the heat developing time, it is preferred that the heater can be controlled more stably and it is also desirable that exposure is started from the leading part of one light sensitive material sheet and thermal development is started before completion of the exposure as far as the trailing end. An imager capable of preferred rapid processing for the present invention is described, for example, in JPA Nos. 2002-289804 and 2002-287668. By the use of the imager, a heat developing treatment can be applied, for example, in 14 sec by a three stage plate type heaters controlled to 107° C.–121° C.—121° C. to shorten the output time for the first sheet to about 60 sec.

FIG. 1 shows a preferred heat development machine in the present invention. In the present invention, the linear developing speed is preferably 18 mm/sec or higher. In the present invention, the linear developing speed is a passing speed of the photothermographic material between the retainer roller and the plate heater. A more preferred linear developing speed is 23 mm/sec or higher and 46 mm/sec or lower.

3) System

A laser imager for medical use having an exposure station and a thermal development station can include Fuji Medical Dry Imager FM-DP L, and DRYPIX 7000. FM-DPL is described in Fuji Medical Review No. 8, page 39–55 and the techniques thereof can be utilized as the laser imager for the photothermographic material of the present invention. Further, it is also applicable as the photothermographic material for the laser imager in "AD network" proposed by Fuji Film Medical Co. as a network system adaptable to DICOM Standards.

<Application Use of the Present Invention>

The photothermographic material of the present invention forms black and white images by silver images and can be used as photothermographic material for use in medical diagnosis, photothermographic material for use in industrial photography, photothermographic material for use in printing, and photothermographic material for use in COM.

EXAMPLES

The present invention is to be descried specifically by way of examples but the present invention is not restricted to them.

Example 1

(Preparation of PET Support)

1) Film Preparation

PET having an intrinsic viscosity of 0.66 (measured in phenol/tetrachloroethane=6/4 (weight ratio) at 25° C.) was obtained by using terephthalic acid and ethylene glycol according to an ordinary method. The resulting PET was pelletized and dried at 130° C. for 4 hours, and after melting, it was then extruded from a T-die at 300° C. to produce a non-stretched film having such a thickness that provided a thickness of 175 μm after thermal fixation.

The film was stretched in the machine direction by 3.3 times by using rolls having different peripheral velocities, and then stretched in the transversal direction by 4.5 times by using a tenter. The temperatures upon stretching were 110° C. and 130° C., respectively. Thereafter, the film was thermally fixed at 240° C. for 20 seconds and then relaxed at the same temperature by 4% in the transversal direction. The parts chacked by the tenter were slit, and the both ends thereof were knurled, followed by winding at 4 kg/cm$^2$, to obtain a roll of a film having a thickness of 175 μm.

2) Surface Corona Discharge Treatment

Both surfaces of the support was treated by using a solid state corona discharge treating device 6 kVA Model, produced by Pillat Technologies, Inc., at 20 m/min. It was found from the read values of electric current and voltage that a treatment of 0.375 kV·A·min/m$^2$ was applied to the support. The treatment frequency was 9.6 kHz, and the gap clearance between the electrode and the dielectric material roll was 1.6 mm 3) Undercoating 1) Preparation of Undercoating Layer Coating Solution

| Formulation (1) (undercoating on image forming layer side) | |
|---|---|
| PESRESIN A-520 (30% by mass solution, produced by Takamatsu Oil & Fat Co., Ltd.) | 59 g |
| Polyethylene glycol monononylphenyl ether (average number of ethylene oxide units: 8.5, 10% by mass solution) | 5.4 g |
| MP-1000 (polymer fine particles, average particle diameter: 0.4 μm, produced by Soken Chemical Co., Ltd.) | 0.91 g |
| Distilled water | 935 mL |
| Formulation (2) (first layer on back surface) | |
| Styrene-butadiene copolymer latex (solid content: 40% by mass, styrene/butadiene weight ratio: 68/32) | 158 g |
| 2,4-Dichloro-6-hydroxy-S-triazine sodium salt 8% by mass aqueous solution | 20 g |
| Sodium laurylbenzenesulfonate 1% by mass aqueous solution | 10 mL |
| Distilled water | 854 mL |
| Formulation (3) (second layer on back surface) | |
| $SnO_2$/SbO (9/1 by weight, average particle diameter: 0.038 μm, 17% by mass dispersion) | 84 g |
| Gelatin (10% by mass aqueous solution) | 89.2 g |
| METLOSE TC-5 (2% by weight aqueous solution, produced by Shin-Etsu Chemical Co., Ltd.) | 8.6 g |
| MP-1000 (produced by Soken Chemical Co., Ltd.) | 0.01 g |
| Sodium dodecylbenzenesulfonate 1% by mass aqueous solution | 10 mL |

-continued

| | |
|---|---|
| NaOH (1% by mass) | 6 mL |
| PROXEL (produced by ICI Japan Ltd.) | 1 mL |
| Distilled water | 805 mL |

2) Undercoat

The formulation (1) of the coating composition for an undercoating layer was coated on both surfaces of the biaxially stretched polyethylene terephthalate support with a thickness of 175 μm having been subjected to the corona discharge treatment with a wire bar to a wet coated amount of 6.6 mL/m$^2$ (per one surface) and dried at 180° C. for 5 minutes. The formulation (2) of the coating composition for an undercoating layer was coated on the back surface with a wire bar to a wet coated amount of 5.7 mL/m$^2$ and dried at 180° C. for 5 minutes. The formulation (3) of the coating composition for an undercoating layer was further coated on the back surface with a wire bar to a wet coated amount of 7.7 mL/m$^2$ and dried at 180° C. for 6 minutes, so as to produced an undercoated support.

(Back Layer)

1) Preparation of Back Layer Coating Solution (Preparation of Fine Solid Particle Liquid Dispersion (a) of a Base Precursor)

2.5 kg of a base precursor compound 1, 300 g of a surface active agent (DEMOL N; trade name of products from Kao Co), 800 g of diphenylsulfone, 1.0 g of sodium benzothiazolinone and distilled water were added and mixed so as to be 8.0 kg in total, and a liquid mixture was put to beads dispersion by a horizontal sand mill (UVM-2; manufactured by IMEX Co.). As the dispersion method, the liquid mixture was fed by a diaphragm pump to UVM-2 filled with zirconia beads of an average diameter of 0.5 mm and dispersed till a desired average particle size was obtained in a state of an internal pressure at 50 hPa or higher.

The dispersion was dispersed till the ratio between absorption at 450 nm and absorption at 650 nm (D450/650) in the spectral absorption of the dispersant reached 3.0 as a result of spectral absorptiometry. The obtained dispersion was diluted with distilled water such that the concentration of the base precursor was 25% by mass and filtered for removing dusts (through polyprolylene filter with an average pore size of 3 μm) for practical use.

2) Preparation of Fine Solid Dye Particle Liquid Dispersion 6.0 kg of a cyanine dye compound-1, 3.0 kg of sodium p-dodecylbenzene sulfonate, 0.6 kg of a surface active agent DEMOL SNB (manufactured by Kao Co.) and 0.15 kg of a defoaming agent (SURFINOL 104E, trade name of products manufactured by Nisshin Kagaku Co.) were mixed with distilled water to make up the total liquid amount to 60 kg. The liquid mixture was dispersed with zirconia beads of 0.5 mm by using a horizontal sand mill (UVM-2: manufactured by IMEX Co.).

The dispersion was dispersed till the ratio between absorption at 650 nm and absorption at 750 nm (D650/750) in the spectral absorption of the dispersant reached 5.0 or more as a result of spectral absorptiometry. The obtained dispersion was diluted with distilled water such that the concentration of the cyanine dye was 6% by mass and filtered for removing dusts (average pore size: 1 μm) for practical use.

(3) Preparation of Anti-Halation Layer Coating Solution

The vessel was kept at 40° C., in which 40 g of gelatin, 20 g of monodispersed fine polymethyl methacrylate particles (average particle diameter: 8 μm, standard deviation of particle diameter: 0.4), 0.1 g of benzoisothiazolinone and 490 ml of water were added to dissolve gelatin. Further, 2.3 ml of an aqueous solution of 1 mol/L sodium hydroxide, 40 g of the fine solid dye particle liquid dispersion, 90 g of fine solid particle liquid dispersion of the base precursor (a), 12 ml of 3% by mass aqueous solution of sodium polystyrene sulfonate and 180 g of 10% by mass SBR latex solution were mixed. 80 ml of 4% by mass aqueous solution of N,N-ethylene bis(vinylsulfone acetoamide) was mixed just before coating to prepare an anti-halation coating solution.

4) Preparation of Slipping Agent Emulsion (Preparation of Slipping Agent Emulsion (Comparative Compound))

2.4 liter of water, 30 ml of phen oxyethanol, 10 g of methyl-p-hydroxybenzonate and 1.0 kg of gelatin were stirred and mixed with 1.0 kg of a comparative compound (R-1) at 50° C. for 20 min. 250 ml of an aqueous 10% by mass solution of sodium oleoyl methyl taurine was added and stirred by a dissolver at 5000 rpm for 60 min to conduct emulsifying dispersion. Water at 40° C. was 0.2μ when added to the obtained dispersion into 10 kg of a finished amount. When the average grain size of the obtained dispersion was measured by a light scattering particle size measuring instrument LA-920 manufactured by Horiba.

(Preparation of Slipping Agent Emulsion (Compound of the Present Invention))

The slipping agent emulsion according to the present invention is emulsion-dispersed quite in the same method as for the comparative compound except for replacing the comparative compound with an identical weight of the compound of the present invention. The average grain size was within a range from 0.18 μm to 0.26 μm. The slipping agent used is shown in Table 1.

5) Preparation of Coating Solution for Back Surface Protection Layer

A vessel was kept at 40° C. in which 40 g of gelatin, 35 mg of benzoisothiazolinone and 840 ml of water were added to dissolve gelatin. Further, 5.8 ml of an aqueous solution of 1 mol/L sodium hydroxide, 15 g of a slipping agent emulsion of the comparative or invented compound, 10 ml of 5% by mass aqueous solution of sodium salt of di(2-ethylhexyl) sulfo succinate, 20 ml of 3% by mass aqueous solution of sodium polystyrene sulfonate, 2.4 ml of 2% by mass solution of fluoric surface active agent (F-1), 2.4 ml of 2% by mass solution of a fluoric surface active agent (F-2), and 32 g of 19% by mass solution of methyl methacrylate/styrene/butylacrylate/hydroxyethyl methacrylate/acrylic acid copolymer (copolymer weight ratio: 57/8/28/5/2) latex were mixed. Just before coating, 25 ml of 4% by mass aqueous solution of N,N-ethylene bis(vinylsulfone acetamide) was mixed to prepare a coating solution for protecting layer of the back surface.

6) Coating of Back Layer

On the back surface of the undercoated support, were coated an anti-halation layer coating solution such that the gelatin coating amount was 0.52 g/m$^2$, and a coating solution for protecting layer on the back surface such that the gelatin coating amount was 1.7 g/m$^2$, simultaneously, by double layer coating and dried to prepare a back layer.

(Image Forming Layer, Intermediate Layer and Surface Protection Layer)

1. Preparation of Coating Material

1) Silver Halide Emulsion

<<Preparation of Silver Halide Emulsion 1>>

A solution formed by adding 3.1 ml of 1% by mass potassium bromide solution to 1421 ml of distilled water and further adding 3.5 ml of sulfuric acid at 0.5 mol/l concentration and 31.7 g of gelatin phthalide was kept in a stainless steel reaction pot at a liquid temperature of 30° C. while stirring. Then, a solution A formed by adding distilled water to 22.22 g of silver nitrate to be diluted to 95.4 ml and a solution B formed by adding distilled water to 15.3 g of potassium bromide and 0.8 g of potassium iodide to be diluted to 97.4 ml volume were added entirely at a constant flow rate for 45 sec. Then, 10 ml of an aqueous 3.5% by mass solution of hydrogen peroxide was added and, further, 10.8 ml of aqueous 10% by mass solution of benzoimidazole was added. Further, a solution C formed by adding distilled water to 51.86 g of silver nitrate to be diluted to 317.5 ml and a solution D formed by adding distilled water to 44.2 g of potassium bromide and 2.2 g of potassium iodide to be diluted to 400 ml were added by adding the solution C by an entire amount at a constant flow rate for 20 min while adding the solution D by a controlled bubble jet method while keeping pAg at 8.1. Potassium hexachloro iridate (III) was added so as to be $1\times10^{-4}$ mol per one mol of silver by the entire amount 10 min after the start of addition of the solution C and the solution D. Further, an aqueous solution of potassium hexacyano ferrate (II) was added by $3\times10^{-4}$ mol per one mol of silver by the entire amount 5 sec after the completion of addition of the solution C. pH was adjusted to 3.8 using sulfuric acid at 0.5 mol/L concentration, stirring was stopped and settling/desalting/water washing step was conducted. pH was adjusted to 5.9 using sodium hydroxide at 1 mol/L concentration to prepare a silver halide dispersion at pAg of 8.0.

The silver halide dispersion was kept at 38° C. while stirring, 5 ml of 0.34% by mass methanol solution of 1,2-benzoisothiazoline-3-one was added and, 40 min after, temperature was elevated to 47° C. 20 min after the temperature elevation, sodium benzenethiosulfonate in a methanol solution was added by $7.6\times10^{-5}$ mol to one mol of silver and, further 5 min after, a tellurium sensitizer C was added in a methanol solution by $2.9\times10^{-4}$ mol per one mol of silver and aged for 91 min. Then, a methanol solution of spectral sensitizing dye A and a sensitizing dye B at a molar ratio of 3:1 was added by $1.2\times10^{-3}$ mol as a total for the sensitizing dyes A and B based on one mol of silver. One min after, 1.3 ml of 0.8% by mass methanol solution of N,N'-dihydroxy-N"-diethylmelamine was added and, further 4 min after, 5-methyl-2-mercaptobenzoimidazole in a methanol solution was added by 4.8×10-3 mol based on one mol of silver and 1-phenyl-2-heptyl-5-mercapto-1,3,4-triazole in a methanol solution was added by $5.4\times10^{-3}$ mol based on one mol of silver and sodium salt of 1-(3-methylureido-5-mercaptotetrazole in an aqueous solution was added by $8.5\times10^{-3}$ mol per one mol of silver to prepare silver halide emulsion 1.

The particles in the silver halide emulsion thus prepared were silver iodide particles homogeneously containing 3.5% by mole of iodide with an average sphere equivalent diameter of 0.042 μm and a fluctuation coefficient of sphere equivalent diameter of 20%. The particle size and the like were determined from the average for the particles by the number of 1000 using an electron microscope. The [100] face ratio of the particle was determined as 80% by using the Kubelka-Munk method.

<<Preparation of Silver Halide Emulsion 2>>

A silver halide emulsion 2 was prepared in the same manner as in the preparation of silver halide emulsion 1 except for changing the liquid temperature upon particle formation from 30° C. to 47° C., changing dilution for the solution B to that for 15.9 g of potassium bromide with distilled water to 97.4 ml volume, and changing dilution for the solution D to that for 45.8 g of potassium bromide with distilled water to 400 ml volume, and changing the addition time of the solution C to 30 min and removing potassium hexacyano ferrate (II). Precipitation/desalting/water washing/dispersion were conducted in the same manner as for the silver halide emulsion 1. Spectral sensitization, chemical sensitization and addition of 5-methyl-2-mercaptobenzoimidazole and 1-phenyl-2-heptyl-5-mercapto-1,3,4-triazole were conducted in the same manner as in the emulsion 1 except for changing the addition amount of the tellurium sensitizer C to $1.1\times10^{-4}$ mol per one mol of silver, and the addition amount of the methanol solution of the spectral sensitizing dye A and the spectral sensitizing dye B at a 3:1 molar ratio to $7.0\times10^{-4}$ mol as the sum for the sensitizing dye A and sensitizing B per one mol of silver, and addition of 1-phenyl-2-heptyl-5-mercapto-1,3,4-triazole to $3.3\times10^{-3}$ mol per one mol of silver and addition of sodium salt of 1-(3-methylureido)-5-mercaptotetrazole to $4.7\times10^{-3}$ mol per one mol of silver, to obtain a silver halide emulsion 2. The emulsion particles of the silver halide emulsion 2 were pure silver bromide cuboidal particles with an average sphere equivalent diameter of 0.080 μm and a fluctuation coefficient of the sphere-equivalent diameter of 20%.

<<Preparation of Silver Halide Emulsion 3>>

A silver halide emulsion 3 was prepared in the same manner as in the preparation of the silver halide emulsion 1 except for changing the liquid temperature upon particle formation from 30° C. to 27° C. Precipitation/desalting/water washing/dispersion were conducted in the same manner as for the silver halide emulsion 1. A silver halide emulsion 3 was obtained in the same manner as in the emulsion 1 except for changing the addition amount of the spectral sensitizing dye A and the spectral sensitizing dye B at a molar ratio of 1:1 as a solid dispersion (gelatin aqueous solution) to $6\times10^{-3}$ mol for the sum of the sensitizing dye A and sensitizing dye B per one mol of silver, changing the addition amount of tellurium sensitizing agent C to $5.2\times10^{-4}$ mol per one mol of silver and adding $5\times10^{-4}$ mol of bromoauric acid per one mol of silver and $2\times10^{-3}$ mol of potassium thiocyanate per one mol of silver 3 min after the addition of the tellurium sensitizing agent. The emulsion particles of the silver halide emulsion 3 were silver iodide particles containing 3.5% by mole of iodide homogeneously with an average sphere equivalent diameter of 0.034 μm and with a fluctuation coefficient of sphere equivalent diameter of 20%.

<<Preparation of Mixed Emulsion A for Coating Solution>>

70% by mass of the silver halide emulsion 1, 15% by mass of the silver halide emulsion 2 and 15% by mass of the silver halide emulsion 3 were dissolved, to which benzothiazolium iodide in 1% by mass aqueous solution was added by $7\times10^{-3}$ mol per one mol of silver. Further, water was added such that the content of the silver halide per 1 kg of the mixed emulsion for coating solution was 38.2 g as silver, and 1-(3-methylureido)-5-mercaptotetrazole was added so as to be 0.34 g per 1 kg of the mixed emulsion for coating solution.

2) Preparation of Silver Fatty Acid Dispersion

<<Preparation of Silver Fatty Acid Salt Dispersion A>>

87.6 kg of behenic acid manufactured by Henkel Co. (trade name of product: Edenor C 22-85R), 423 L of distilled water, 49.2 L of an aqueous NaOH solution at 5 mol/L concentration and 120 L of t-butyl alcohol were mixed and reacted under stirring at 75° C. for one hour to obtain a sodium behenate solution A. Separately, 206.2 L of an aqueous solution of 40.4 kg of silver nitrate (pH 4.0) was provided and kept at a temperature of 10° C. A reaction vessel containing 635 L of distilled water and 30 L of t-butyl alcohol was kept at a temperature of 30° C., and the entire amount of the sodium behenate solution A and the entire amount of the aqueous solution of the silver nitrate were added under sufficient stirring at constant flow rate for 93 min and 15 sec and 90 min, respectively. In this case, only the aqueous solution of silver nitrate was added for 11 min after starting the addition of the aqueous solution of silver nitrate, then addition of sodium behenate solution A was started subsequently, and only the sodium behenate solution A was added for 14 min and 15 sec after the end of the addition of the aqueous solution of silver nitrate. In this case, the temperature inside the reaction vessel was kept at 30° C. and the external temperature control was conducted such that the liquid temperature was constant. Further, pipelines for the addition system of the sodium behenate solution A was kept warm by circulating warm water to the outside of a double-pipe and controlled such that the liquid temperature at the exit of the addition nozzle top was 75° C. Further, the temperature of the pipelines for the addition system of the aqueous solution of the silver nitrate was kept by circulating cold water to the outside of the double-pipe. The addition position for the sodium behenate solution and the addition position for the aqueous solution of silver nitrate were arranged symmetrically with respect to the stirring axis as a center and adjusted to such a height as not in contact with the reaction solution.

After the completion for addition of the sodium behenate solution A, it was stirred and left for 20 min at the temperature as it was and then the temperature was elevated to 35° C. for 30 min and then aging was conducted for 210 min. Just after the completion of the aging, solid contents were separated by centrifugal filtration and the solids were water-washed such that the conductivity of the filtered water was 30 μS/cm. Thus, a silver fatty acid salt was obtained. The obtained solids were stored as wet cakes without drying.

When the form of the obtained silver behenate particles was evaluated by electron microscopic photography, they were flaky crystals with a=0.14 μm, b=0.4 μm, c=0.6 μm in an average value, an average aspect ratio of 5.2, an average sphere equivalent diameter of 0.52 μm and a variation coefficient of a sphere-equivalent diameter of 15% (a, b, c as defined in the specification).

19.3 kg of polyvinyl alcohol (trade name of products: PVA-217) and water were added to wet cakes corresponding to 260 kg of dry solids to make the entire amount to 1,000 kg, which were then slurrified by dissolver blades and, further, preliminarily dispersed by a pipeline mixer (Model PM-10 manufactured by Mizuho Industry Co.).

Then, a stock solution after the preliminary dispersion was treated for three times while controlling the pressure of a dispersing machine (trade name; Micro Fluidizer M-610, manufactured by MicroFluidex International Corp., using Z-type interaction chamber) to 1260 kg/cm$^2$, to obtain a silver behenate dispersion. For the cooling operation, bellows type heat exchangers were mounted before and after the interaction chamber, respectively, and the dispersion temperature was set at 18° C. by controlling the temperature of a coolant.

<<Preparation of the Silver Fatty Acid Salt Dispersion B>>

<Preparation of Recrystallized Behenic Acid>

100 kg of behenic acid manufactured by Henkel Co. (trade name of product; Edenor C 22-85R) was mixed in 1200 kg of isopropyl alcohol, dissolved at 50° C., filtered through a 10 μm filter, and then cooled to 30° C. to conduct recrystallization. The cooling rate upon recrystallization was controlled to 3° C./hr. The resultant crystals were centrifugally filtered, scrubbed with 100 kg of isopropyl alcohol and then dried. When the obtained crystals were esterified and measured by GC-FID, behenic content was 96% by mole, and, in addition, 2% by mole of lignoceric acid, 2% by mole of archidic acid and 0.001% by mole of erucic acid were contained.

<Preparation of Silver Fatty Acid Salt Dispersion B>

88 kg of recrystallized behenic acid, 422 L of distilled water, 49.2 L of an aqueous NaOH solution at 5 mol/L concentration and 120 L of t-butyl alcohol were mixed and reacted under stirring at 75° C. for one hour to obtain a sodium behenate solution B. Separately, 206.2 L of an aqueous solution of 40.4 kg of silver nitrate (pH 4.0) was provided and kept at a temperature of 10° C. A reaction vessel containing 635 L of distilled water and 30 L of t-butyl alcohol was kept at a temperature of 30° C., and the entire amount of the sodium behenate solution B and the entire amount of the aqueous solution of the silver nitrate were added under sufficient stirring at constant flow rate for 93 min and 15 sec and 90 min, respectively. In this case, only the aqueous solution of silver nitrate was added for 11 min after starting the addition of the aqueous solution of silver nitrate, addition of sodium behenate solution B was started subsequently, and only the sodium behenate solution B was added for 14 min and 15 sec after the completion of the addition of the aqueous solution of silver nitrate. In this case, the temperature inside the reaction vessel was kept at 30° C. and the external temperature control was conducted such that the liquid temperature was constant. Further, pipelines for the addition system of the sodium behenate solution B was kept warm by circulating warm water to the outside of a double-pipe and controlled such that the liquid temperature at the exit of the addition nozzle top was 75° C. Further, the temperature of the pipelines for the addition system of the aqueous solution of the silver nitrate was kept by circulating cold water to the outside of the double-pipe. The addition position for the sodium behenate solution B and the addition position for the aqueous solution of silver nitrate were arranged symmetrically with respect to the stirring axis as a center and adjusted to such a height as not in contact with the reaction solution.

After the completion for addition of the sodium behenate solution B, it was stirred and left for 20 min at the temperature as it was and then the temperature was elevated to 35° C. for 30 min and then aging was conducted for 210 min. Just after the completion of the aging, solid contents were separated by centrifugal filtration and the solids were water-washed such that the conductivity of the filtered water was 30 μS/cm. Thus, a silver fatty acid salt was obtained. The obtained solids were stored as wet cakes without drying.

When the form of the obtained silver behenate particles was evaluated by electron microscopic photography, they were crystals with a=0.21 μm, b=0.4 μm, c=0.4 μm in an average value, an average aspect ratio 2.1, and a variation coefficient of a sphere-equivalent diameter of 11% (a, b, c as defined in the specification).

19.3 kg of polyvinyl alcohol (trade name of products: PVA-217) and water were added to wet cakes corresponding to 260 kg of dry solids to make the entire amount to 1,000 kg, which were then slurrified by dissolver blades and, further, preliminarily dispersed by a pipeline mixer (Model PM-10 manufactured by Mizuho Industry Co.).

Then, a stock solution after the preliminary dispersion was treated for three times while controlling the pressure of a dispersing machine (trade name; Micro Fluidizer M-610, manufactured by MicroFluidex International Corp., using Z-type interaction chamber) to 1150 kg/cm$^2$, to obtain a silver behenate dispersion. For the cooling operation, bellows type heat exchangers were mounted before and after the interaction chamber, respectively, and the dispersion temperature was set at 18° C. by controlling the temperature of a coolant.

3) Preparation of Reducing Agent Dispersion

<<Preparation of Reducing Agent-1 Dispersion>>

10 kg of water was added to 10 kg of reducing agent 1 (2,2'-methylenebis(4-ethyl-6-tert-butylphenol)) and 16 kg of a 10% by mass modified polyvinyl alcohol (Poval MP203, produced by Kuraray Co., Ltd.) aqueous solution, and well mixed to form a slurry. The resulting slurry was delivered with a diaphragm pump and dispersed with a transverse sand mill (UVM-2, produced by Imex Co., Ltd.) charged with zirconia beads having an average particle diameter of 0.5 mm for 3 hours, and 0.2 g of banzoisothiazolinone sodium salt and water were added to make the concentration of the reducing agent being 25% by mass. The resulting dispersion was heat-treated at 60° C. for 5 hours to obtain a reducing agent dispersion 1. The reducing agent particles contained in the reducing agent dispersion had a median diameter of 0.40 μm and a maximum particle diameter of 1.4 μm or less. The resulting reducing agent dispersion was filtrated with a polypropylene filter having a pore size of 3.0 μm to remove foreign matters, such as dusts, and then housed.

<<Preparation of Reducing Agent-2 Dispersion>>

10 kg of water was added to 10 kg of reducing agent 2 (6,6'-di-t-butyl-4,4'-dimethyl-2,2'-butylidenediphenol) and 16 kg of a 10% by mass modified polyvinyl alcohol (Poval MP203, produced by Kuraray Co., Ltd.) aqueous solution, and well mixed to form a slurry. The resulting slurry was delivered with a diaphragm pump and dispersed with a transverse sand mill (UVM-2, produced by Imex Co., Ltd.) charged with zirconia beads having an average particle diameter of 0.5 mm for 3 hours and 30 minutes, and 0.2 g of banzoisothiazolinone sodium salt and water were added to make the concentration of the reducing agent being 25% by mass. The resulting dispersion was heated at 40° C. for 1 hour and further heated at 80° C. for 1 hour to obtain a reducing agent dispersion 2. The reducing agent particles contained in the reducing agent dispersion had a median diameter of 0.50 μm and a maximum particle diameter of 1.6 μm or less. The resulting reducing agent dispersion was filtrated with a polypropylene filter having a pore size of 3.0 μm to remove foreign matters, such as dusts, and then housed.

4) Preparation of Hydrogen Bonding Compound-1 Dispersion 10 kg of water was added to 10 kg of hydrogen bonding compound 1 (tri(4-t-butylphenyl)phosphineoxide) and 16 kg of a 10% by mass modified polyvinyl alcohol (Poval MP203, produced by Kuraray Co., Ltd.) aqueous solution, and well mixed to form a slurry. The resulting slurry was delivered with a diaphragm pump and dispersed with a transverse sand mill (UVM-2, produced by Imex Co., Ltd.) charged with zirconia beads having an average particle diameter of 0.5 mm for 4 hours, and 0.2 g of banzoisothiazolinone sodium salt and water were added to make the concentration of the hydrogen bonding compound being 25% by mass. The resulting dispersion was heated at 40° C. for 1 hour and further heated at 80° C. for 1 hour to obtain a hydrogen bonding compound dispersion 1. The hydrogen bonding compound particles contained in the hydrogen bonding compound dispersion had a median diameter of 0.45 μm and a maximum particle diameter of 1.3 μm or less. The resulting hydrogen bonding compound dispersion was filtrated with a polypropylene filter having a pore size of 3.0 μm to remove foreign matters, such as dusts, and then housed.

5) Preparation of Development Accelerator-1 Dispersion 10 kg of water was added to 10 kg of development accelerator 1 and 20 kg of a 10% by mass modified polyvinyl alcohol (Poval MP203, produced by Kuraray Co., Ltd.) aqueous solution, and well mixed to form a slurry. The resulting slurry was delivered with a diaphragm pump and dispersed with a transverse sand mill (UVM-2, produced by Imex Co., Ltd.) charged with zirconia beads having an average particle diameter of 0.5 mm for 3 hours and 30 minutes, and 0.2 g of banzoisothiazolinone sodium salt and water were added to make the concentration of the development accelerator being 20% by mass to obtain a development accelerator dispersion 1. The development accelerator particles contained in the development accelerator dispersion had a median diameter of 0.48 μm and a maximum particle diameter of 1.4 μm or less. The resulting development accelerator dispersion was filtrated with a polypropylene filter having a pore size of 3.0 μm to remove foreign matters, such as dusts, and then housed.

Solid dispersions of development accelerator 2 and color toner 1 were dispersed in the same manner as the development accelerator 1 to obtain dispersions of 20% by mass and 15% by mass, respectively.

6) Preparation of Polyhalogen Compound Dispersion

<<Preparation of Organic Polyhalogen Compound-1 Dispersion>>

10 kg of organic polyhalogenide compound 1 (tribromomethanesulfonylbenzene), 10 kg of a 20% by mass modified polyvinyl alcohol (Poval MP203, produced by Kuraray Co., Ltd.) aqueous solution, 0.4 kg of a 20% by mass sodium triisopropylnaphthalenesulfonate aqueous solution and 14 kg of water were well mixed to form a slurry. The resulting slurry was delivered with a diaphragm pump and dispersed with a transverse sand mill (UVM-2, produced by Imex Co., Ltd.) charged with zirconia beads having an average particle diameter of 0.5 mm for 5 hours, and 0.2 g of banzoisothiazolinone sodium salt and water were added to make the concentration of the organic polyhalogenide compound being 30% by mass to obtain an organic polyhalogenide compound dispersion 1. The organic polyhalogenide compound particles contained in the organic polyhalogenide compound dispersion had a median diameter of 0.41 μm and a maximum particle diameter of 2.0 μm or less. The resulting organic polyhalogenide compound dispersion was filtrated with a polypropylene filter having a pore size of 10.0 μm to remove foreign matters, such as dusts, and then housed.

<<Preparation of Organic Polyhalogen Compound-2 Dispersion>>

10 kg of organic polyhalogenide compound 2 (N-butyl-3-tribromomethanesulfonylbenzamide), 20 kg of a 10% by mass modified polyvinyl alcohol (Poval MP203, produced by Kuraray Co., Ltd.) aqueous solution and 0.4 kg of a 20% by mass sodium triisopropylnaphthalenesulfonate aqueous solution were well mixed to form a slurry. The resulting slurry was delivered with a diaphragm pump and dispersed with a transverse sand mill (UVM-2, produced by Imex Co., Ltd.) charged with zirconia beads having an average particle diameter of 0.5 mm for 5 hours, and 0.2 g of banzoisothiazolinone sodium salt and water were added to make the concentration of the organic polyhalogenide compound being 30% by mass. The resulting dispersion was heated at 40° C. for 5 hours to obtain an organic polyhalogenide compound dispersion 2. The organic polyhalogenide compound particles contained in the organic polyhalogenide compound dispersion had a median diameter of 0.40 μm and a maximum particle diameter of 1.3 μm or less. The resulting organic polyhalogenide compound dispersion was filtrated with a polypropylene filter having a pore size of 3.0 μm to remove foreign matters, such as dusts, and then housed.

7) Preparation of Phthalazine Compound-1 Solution 8 kg of a modified polyvinyl alcohol (Poval MP203, produced by Kuraray Co., Ltd.) was dissolved in 174.57 kg of water, and 3.15 kg of a 20% by mass sodium triisopropylnaphthalenesulfonate aqueous solution and 14.28 g of a 70% by mass phthalazine compound 1 (6-isopropylphthalazine) aqueous solution were added thereto to prepare a 5% by mass phthalazine compound solution 1.

8) Preparation of Mercapto Compound

<<Preparation of Mercapto Compound-1 Aqueous Solution>>

7 g of mercapto compound 1 (1-(3-sulfophenyl)-5-mercaptotetrazole sodium salt) was dissolved in 993 g of water to prepare a 0.7% by mass aqueous solution.

<<Preparation of Mercapto Compound-2 Aqueous Solution>>

20 g of mercapto compound 1 (1-(3-methylureidophenyl)-5-mercaptotetrazole) was dissolved in 980 g of water to prepare a 2.0% by mass aqueous solution.

9) Preparation of Pigment-1 Dispersion 250 g of water was added to 64 g of C.I. Pigment Blue 60 and 6.4 g of DEMOL N, produced by Kao Corp. and well mixed to prepare a slurry. 800 g of zirconia beads having an average particle diameter of 0.5 mm were prepared and charged in a vessel along with the slurry, and they were dispersed with a dispersing device (1/4G sand grinder mill, produced by Imex Co., Ltd.) for 25 hours, to which water was added to make the concentration of the pigment being 5% by mass, so as to prepare pigment dispersion 1. The pigment particles contained in the pigment dispersion had an average particle diameter of 0.21 μm.

10) Preparation of SBR Latex Liquid (Synthesis of SBR Latex (Tg=17° C.)

An SBR latex was prepared in the following manner.

287 g of distilled water, 7.73 g of a surface active agent (PIONIN A-43-S, produced by Takemoto Oil and Fat Co., Ltd.), 14.06 mL of a 1 mole/L sodium hydroxide solution, 0.15 g of tetrasodium ethylenediamine tetraacetate, 255 g of styrene, 11.25 g of acrylic acid and 3.0 g of tert-dodecylmercaptane were charged in a gas monomer reaction device (TAS-2J, produced by Taiatsu Techno Corp.), after sealing the reaction vessel, the mixture was stirred at a stirring rate of 200 rpm. After repeating deaeration with a vacuum pump and replacement with nitrogen gas several times, 108.75 g of 1,3-butadiene was pressed therein, and the internal temperature was increased to 60° C. A solution formed by dissolving 1.875 g of ammonium persulfate in 50 mL water was added thereto, followed by stirring for 5 hours. After increasing the temperature to 90° C., the mixture was further stirred for 3 hours. After completing the reaction, the internal temperature was decreased to room temperature, and the ratio of $Na^+$ ion/$NH_4^+$ ion is adjusted to 1/5.3 (by mole) by adding a 1 mole/L sodium hydroxide solution and $NH_4OH$, followed by adjusting the pH to 8.4. Thereafter, the resulting latex was filtrated with a polypropylene filter having a pore size of 1.0 μm to remove foreign matters, such as dusts, and then housed to obtain 774.7 g of an SBR latex. The measurement of halogen ion by ion chromatography revealed that the chloride ion concentration was 3 ppm. The measurement of the concentration of the chelating agent by high-speed liquid chromatography revealed that it was 145 ppm.

The latex had an average particle diameter of 90 nm, a glass transition temperature Tg of 17° C., a solid concentration of 44% by mass, an equilibrium water content at 25° C. 60% RH of 0.6% by mass, an ionic electroconductivity of 4.80 mS/cm (the ionic electroconductivity of the latex stock dispersion (44% by mass) was measured with an electroconduction meter, CM-30S, produced by To a Dempa Kogyo Co., Ltd. at 25° C.) and pH 8.4.

2. Preparation of Coating Solution

1) Preparation of Image Forming Layer Coating Solution-1

1,000 g of the fatty acid silver salt dispersion A obtained as described above, 135 ml of water, 35 g of pigment-1 dispersion, 19 g of organic polyhalogen compound-1 dispersion, 58 g of organic polyhalogen compound-2 dispersion, 162 g of phthalazine compound-1 solution, 1060 g of SBR latex (Tg: 17° C.) solution, 75 g of reducing agent-1, 75 g of reducing agent-2 dispersion, 106 g of hydrogen bonding compound-1 dispersion, 4.8 g of development accelerator-1 dispersion, 9 mol of an aqueous solution of mercapto compound-1, and 27 ml of an aqueous solution of mercapto compound-2 were added successively, and 118 g of a silver halide emulsion mixture A was added just before coating, and mixed thoroughly to form an image forming layer coating solution, which was fed as it was to a coating dye and coated.

The viscosity of the image-forming layer coating solution at 40° C. was 25 [mPa·S] when measured by a B-type viscometer at 40° C. (No. 1 rotor, 60 rpm).

The viscosity of the coating solution at 38° C. when measured by using RhoStress RS150 manufactured by Haake Co. was 32, 35, 33, 26, 27 [mPa·S], respectively, at shearing rate of 0.1, 1, 10, 100, and 1000 [1/sec].

The amount of zirconium in the coating solution was 0.32 mg per one g of silver.

2) Preparation of Image Forming Layer Coating Solution-2

1,000 g of fatty acid silver salt dispersion B obtained as described above, 135 ml of water, 36 g of pigment-1 dispersion, 25 g of organic polyhalogen compound-1 dispersion, 39 g of organic polyhalogen compound-2 dispersion, 171 g of phthalazine compound-1 solution, 1060 g of SBR latex (Tg: 17° C.) solution, 153 g of reducing agent-2 dispersion, 55 g of hydrogen bonding compound-1 dispersion, 4.8 g of development accelerator-1 dispersion, 5.2 g of development accelerator-2 dispersion, 2.1 g of color toning agent-1 dispersion, 8 ml of an aqueous solution of mercapto compound-2 were added successively, and 140 g of a silver halide emulsion mixture A was added just before coating and mixed thoroughly to form an image forming layer coating solution, which were fed as they were to a coating dye and coated.

The viscosity of the image forming layer coating solution at 40° C. was 40 [mPa·S] when measured by a B-type viscometer, manufactured by Tokyo Keiki (No. 1 rotor, 60 rpm).

The viscosity of the coating solution at 38° C. when measured by using RheoStress RS150 manufactured by Haake Co. was 30, 43, 41, 28, 20 [mPa·S], respectively, at shearing rate of 0.1, 1, 10, 100, and 1000 [1/sec].

The amount of zirconium in the coating solution was 0.30 mg per one g of silver.

3) Preparation of Intermediate Layer Coating Solution

To 1,000 g of polyvinyl alcohol PVA-205, produced by Kuraray Co., Ltd., 163 g of the pigment dispersion 1, 33 g of an aqueous solution of blue dye compound-1 (kayafectotercoids RN liquid 150, manufactured by Nippon Kayaku co.), 27 ml of an aqueous 5% by mass solution of sodium di(2-ethylhexyl) sulfosuccinate, and 4200 ml of 19% by mass solution of methylmethacrylate/styrene/butyl acrylate/hydroxyethyl methacrylate/acrylic acid copolymer (copolymerization weight ratio 57/8/28/5/2) latex, 27 mL of a 5% by mass AEROSOL OT (produced by American Cyanamid Company) aqueous solution, 135 mL of a 20% by mass diammonium phthalate aqueous solution and water were added to make 10,000 g in total, and the pH was adjusted with sodium hydroxide to 7.5 to prepare a coating composition for an intermediate layer, which was then delivered to a coating die to a coated amount of 8.9 mL/$m^2$.

The viscosity of the coating composition measured with a B-type viscometer, with No. 1 rotor at 60 rpm, was 20 mPa·s at 40° C.

4) Preparation of a Surface Protection First Layer Coating Solution 100 g of inert gelatin and 10 mg of benzoisothiazolinone were dissolved in 840 ml of water, and 180 g of a 19% by mass solution of methyl methacrylate/styrene/butyl acrylate/hydroxyethyl methacrylate/acrylic acid copolymer (copolymerization weight ratio 57/8/28/5/2) latex, 46 ml of a 15% by mass methanol solution of phthalic acid, 5.4 ml of an aqueous 5% by mass solution of sodium di(2-ethylhexyl) sulfosuccinate were added and mixed, and 40 ml of 4% by mass chrome alum was mixed just before coating by a static mixer, which was fed to a coating dye so as to provide a coating solution amount of 26.1 ml/$m^2$.

The viscosity of the coating composition measured with a B-type viscometer, with No. 1 rotor at 60 rpm, was 20 mPa·s at 40° C.

5) Preparation of a Surface Protection Second Layer Coating Solution 100 g of inert gelatin, 30 g of a slipping agent emulsion of the comparative or invented compound, and 10 mg of benzoisothazolinone were dissolved in 800 ml of water, and 180 g of a 19% by mass solution of methyl methacrylate/styrene/butyl acrylate/hydroxyethyl methacrylate/acrylic acid copolymer (copolymerization weight ratio 57/8/28/5/2) latex, 40 ml of a 15% by mass methanol solution of phthalic acid, 5.5 ml of a 1% by mass solution of a fluoro surface active agent (F-1), 5.5 ml of an aqueous 1% by mass solution of a fluoro surface active agent (F-2), 28 ml of an aqueous 5% by mass solution of sodium di(2-ethylhexyl)sulfosuccinate, 4 g of fine polymethyl methacrylate particles (average particle size of 0.7 μm), 21 g of fine polymethyl methacrylate particles (average particle size of 4.5 μm) were mixed as a surface protection layer coating solution, which was fed to a coating die so as to be 8.3 ml/m$^2$.

The viscosity of the coating composition measured with a B-type viscometer, with No. 1 rotor at 60 rpm, was 19 mPa·s at 40° C.

3. Preparation of Photothermographic Materials 1–2

1) Preparation of Photothermographic Material 1

An image forming layer, an intermediate layer, a surface protection first layer, and a surface protection second layer were coated in this order on the surface of the support opposite to the back surface by simultaneous double-layer coating by slide bead coating method to produce a sample of a photothermographic material. The temperature of the coating solution was controlled at 35° C. for the image forming layer and the intermediate layer, at 36° C. for the surface protection first layer, and at 37° C. for the surface protection second layer.

The coating amount (g/m$^2$) for each of the compounds in the image forming layer is as described below.

| | |
|---|---|
| Silver behenate | 5.42 |
| Pigment (C. I. Pigment Blue 60) | 0.036 |
| Polyhalogen compound-1 | 0.12 |
| Polyhalogen compound-2 | 0.25 |
| Phthalazine compound-1 | 0.18 |
| SBR latex | 9.70 |
| Reducing agent-1 | 0.40 |
| Reducing agent-2 | 0.40 |
| Hydrogen bonding compound-1 | 0.58 |
| Development accelerator-1 | 0.02 |
| Mercapto compound-1 | 0.002 |
| Mercapto compound-2 | 0.012 |
| Silver halide (as AG) | 0.10 |

The coating and drying conditions were as follows.

The support was destaticized with an ion stream before coating, and the coating was carried out at 160 m/min. The coating and drying conditions were adjusted within the following ranges depending on the respective samples to select such conditions that provided the most stable surface property.

The distance between the tip of the coating die and the support was from 0.10 to 0.30 mm, and the pressure of the decompression chamber was lower than the atmospheric pressure by 196 to 882 Pa. The support was destaticized with an ion stream before coating. After the coating composition was cooled with air blow at a dry-bulb temperature of from 10 to 20° C. in the subsequent chilling zone, the support was conveyed by a non-contact conveying system and dried with air blow at a dry-bulb temperature of from 23 to 45° C. and a wet-bulb temperature of from 15 to 21° C. in a helical type contactless drying apparatus. After drying, the coated support was adjusted in humidity to 40 to 60% RH at 25° C. and then heated to 70 to 90° C. on the coated film surface. After heating, the coated film surface was cooled to 25° C.

The photothermographic material thus produced had a mat degree in terms of Beck's smoothness of 550 seconds on the image forming layer side and 130 seconds on the back surface. The pH on the film surface on the image forming layer side was 6.0.

2) Preparation of Photothermographic Material-2

Photothermographic material-2 was prepared in the same manner as for the photothermographic material-1 except for changing the image forming layer coating solution-1 to the image forming layer coating solution-2 for the photothermographic material-1.

The coating amount (g/m$^2$) for each of the compounds in the image forming layer is as described below.

| | |
|---|---|
| Silver behenate | 5.27 |
| Pigment (C. I. Pigment Blue 60) | 0.036 |
| Polyhalogen compound-1 | 0.14 |
| Polyhalogen compound-2 | 0.28 |
| Phthalazine compound-1 | 0.18 |
| SBR latex | 9.43 |
| Reducing agent-2 | 0.77 |
| Hydrogen bonding compound-1 | 0.28 |
| Development accelerator-1 | 0.019 |
| Development accelerator-2 | 0.016 |
| Color toning agent-1 | 0.006 |
| Mercapto compound-2 | 0.003 |
| Silver halide (as Ag) | 0.13 |

3) Preparation of Photothermographic Materials 1A to 1R, and 2A to 2R

The comparative slipping agents or the slipping agents of the present invention were added as shown in Table 1 to the emulsion surface protection layer second layer and a back surface protection layer for the photothermographic materials 1 and 2 to prepare specimens 1A to 1R and 2A to 2R, respectively.

The chemical structures of the compounds used in the example of the present invention are shown below.

Spectral sensitizing dye A

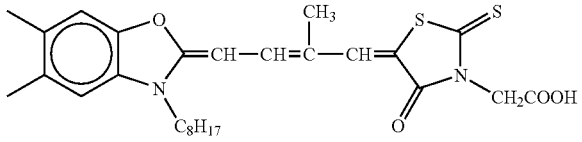

Spectral sensitizing B

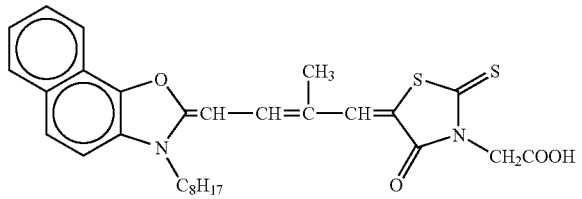

Tellurium sensitizing agent C

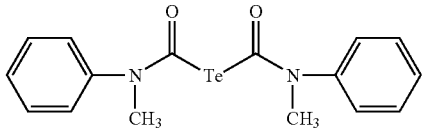

Base precursor compound-1

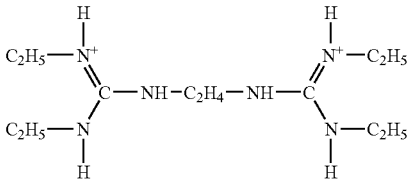

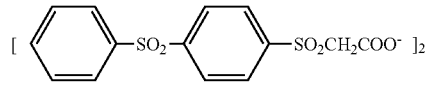

-continued
Cyanine dye compound-1
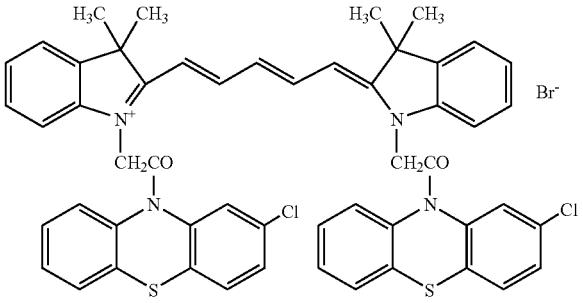
Blue dye compound-1
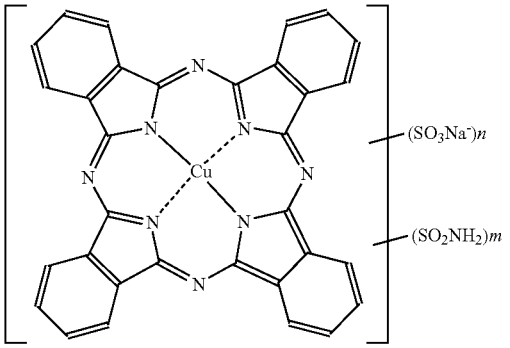
n = 0. 5 ~ 2. 0
m = 0. 5 ~ 2. 5
Yellow dye compound-1
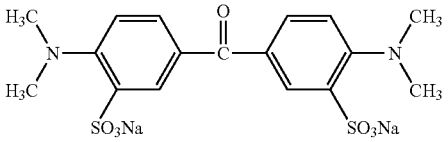
(Reducing agent-1)
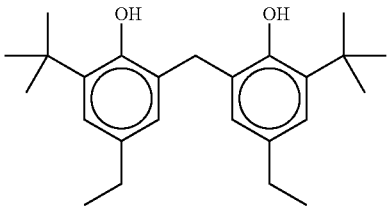
(Reducing agent-2)
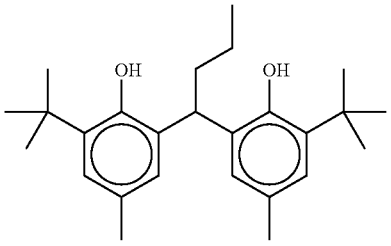
-continued
(Hydrogen bonding compound-1)
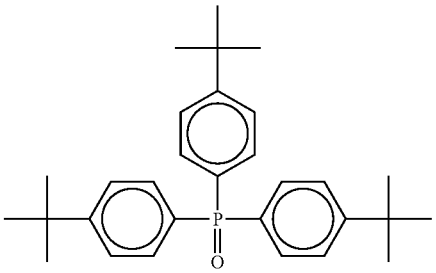
(Polyhalogen compound-1)
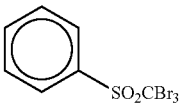
(Polyhalogen compound-2)
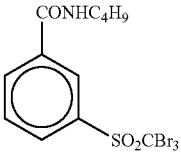
(Mercapto compound-1)
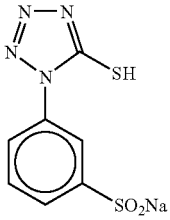
(Mercapto compound-2)
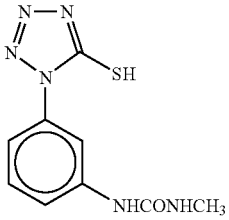
(Phthalazine compound-1)
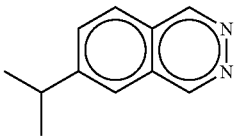
(Development accelerator-1)
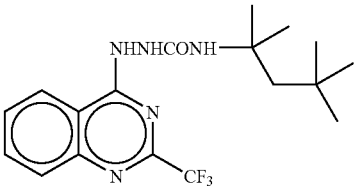

-continued (Develpoment accelerator-2)

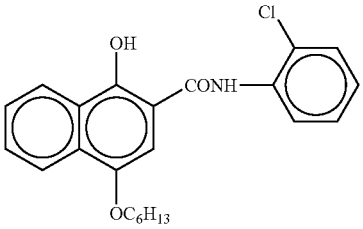

(Color toning agent-1)

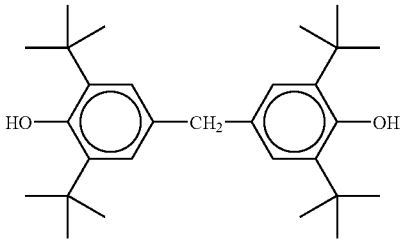

(F-1)

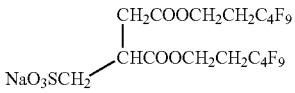

(F-2)

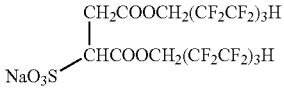

4. Evaluation for Photographic Performance

1) Preparation

The resulting sample was cut in a size of 14×17-in and packed with a packaging material under conditions of 25° C. and. The packed samples were stored at ordinary temperature for 2 weeks, and then subjected to the following evaluation.

2) Packaging Material

50 μm polyethylene containing PET 10 μm/PE 12 μm/aluminum foil 9 μm/Ny 15 μm/carbon 3% by mass.

Oxygen permeability: 0.02 ml/atm·$m^2$, 25° C.·day

Moisture permeability: 0.10 g/atm·$m^2$ 25° C.·day.

3) Exposure Development of Light Sensitive Material

The photothermographic material-1, 1A to 1R and 2, 2A to 2R were exposed and thermally developed by using a Fuji Medical dry laser imager-FM-DP L (mounting 660 nm semiconductor laser of a maximum power of 60 mW (IIIB)) (by four panel heaters set to 112° C.–119° C.–121° C.—121° C. for 24 sec in total for −1 and 1A to 1R, and for 14 sec in total for 2 and 2A to 2R), and the obtained images were evaluated by a densitometer.

4) Evaluation Method

The photothermographic materials-1, 1A to 1R and 2, 2A to 2R were exposed uniformly to a density of 1.5, they were treated in a heat developing machine in the running state each by 2000 sheets, and the number of sheets forming uneven development caused by transportation failure was counted. The result is shown in Table 1.

The volatile amounts of the compounds S-22 and S-30 of the present invention were 0.01 and 0.00% by mass, respectively.

5) Evaluation Result

The result in shown in Table 1.

TABLE 1

| Sample No. | Kind of Slipping Agent: Image Forming Layer Protection Layer | Kind of Slipping Agent: Back Surface Protection Layer | Number of Sheets of Failed Transportation | Remark |
|---|---|---|---|---|
| 1 | None | None | Frequent Jamming | Comp. Example |
| 1A | R-1 | R-1 | 20 | Comp. Example |
| 1B | None | R-1 | 26 | Comp. Example |
| 1C | S-1 | S-1 | 12 | Invention |
| 1D | S-2 | S-2 | 10 | Invention |
| 1E | S-3 | S-3 | 9 | Invention |
| 1F | S-5 | S-5 | 5 | Invention |
| 1G | S-7 | S-7 | 6 | Invention |
| 1H | S-10 | S-10 | 4 | Invention |
| 1I | S-11 | S-11 | 3 | Invention |
| 1J | S-17 | S-17 | 0 | Invention |
| 1K | S-19 | S-19 | 2 | Invention |
| 1L | S-22 | S-22 | 0 | Invention |
| 1M | S-30 | S-30 | 0 | Invention |
| 1N | None | S-30 | 3 | Invention |
| 1O | R-1 | S-30 | 2 | Invention |
| 1P | S-5 | S-30 | 0 | Invention |
| 1Q | S-30 | S-5 | 2 | Invention |
| 1R | S-30 | R-1 | 4 | Invention |
| 2 | None | None | Frequent Jamming | Comp. Example |
| 2A | R-1 | R-1 | 18 | Comp. Example |
| 2B | None | R-1 | 27 | Comp. Example |
| 2C | S-1 | S-1 | 11 | Invention |
| 2D | S-2 | S-2 | 9 | Invention |
| 2E | S-3 | S-3 | 7 | Invention |
| 2F | S-5 | S-5 | 4 | Invention |
| 2G | S-7 | S-7 | 5 | Invention |
| 2H | S-10 | S-10 | 2 | Invention |
| 2I | S-11 | S-11 | 2 | Invention |
| 2J | S-17 | S-17 | 0 | Invention |
| 2K | S-19 | S-19 | 1 | Invention |
| 2L | S-22 | S-22 | 0 | Invention |
| 2M | S-30 | S-30 | 0 | Invention |
| 2N | None | S-30 | 3 | Invention |
| 2O | R-1 | S-30 | 1 | Invention |
| 2P | S-5 | S-30 | 0 | invention |
| 2Q | S-30 | S-5 | 2 | Invention |
| 2R | S-30 | R-1 | 5 | Invention |

Specimens were prepared by changing the addition amount of the slipping agent of the present invention or comparative compounds as shown in Table 2 for the photothermographic material-2A and they were evaluated in the same manner. The addition amounts are shown in Table 2 by relative values based on the photothermographic material-2A.

TABLE 2

| Sample No. | Kind and Addition Amount of Slipping Agent: Image forming Layer Protection Layer | | Back Surface Protection Layer | | Number of Sheets of failed Transportation | Remark |
|---|---|---|---|---|---|---|
| 2A | R-1 | x1 | R-1 | x1 | 19 | Com. Example |
| 2A-1 | R-1 | x0.5 | R-1 | x1 | 22 | Com. Example |

TABLE 2-continued

| Sample No. | Kind and Addition Amount of Slipping Agent: Image forming Layer Protection Layer | | Back Surface Protection Layer | | Number of Sheets of failed Transportation | Remark |
|---|---|---|---|---|---|---|
| 2A-2 | R-1 | x2 | R-1 | x1 | 18 | Com. Example |
| 2A-3 | R-1 | x1 | R-1 | x0.5 | 35 | Com. Example |
| 2A-4 | R-1 | x1 | R-1 | x2 | 16 | Com. Example |
| 2T | S-15 | x1 | S-15 | x1 | 0 | Invention |
| 2T-1 | S-15 | x0.2 | S-15 | x1 | 2 | Invention |
| 2T-2 | S-15 | x0.3 | S-15 | x1 | 1 | Invention |
| 2T-3 | S-15 | x0.5 | S-15 | x1 | 0 | Invention |
| 2T-4 | S-15 | x2 | S-15 | x1 | 0 | Invention |
| 2T-5 | S-15 | x1 | S-15 | x0.2 | 7 | Invention |
| 2T-6 | S-15 | x1 | S-15 | x0.3 | 3 | Invention |
| 2T-7 | S-15 | x1 | S-15 | x0.5 | 1 | Invention |
| 2T-8 | S-15 | x1 | S-15 | x2 | 0 | Invention |
| 2T-9 | S-15 | x0.3 | S-15 | x0.7 | 0 | Invention |
| 2T-10 | S-15 | x0.2 | S-15 | x0.5 | 3 | Invention |
| 2T-11 | S-15 | x0.5 | S-5 | x1 | 0 | Invention |
| 2T-12 | S-5 | x1 | S-15 | x0.5 | 1 | Invention |

In Table 2, 'x2' means twice and 'x0.5' represents 0.5 times based on the amount of slipping agent of sample No. 2A.

Further, specimens were prepared by adding comparative compounds or compounds of the present invention as shown in Table 3 for the photothermographic material-1. Commercially available photothermographic materials DI-AL were processed by 20,000 sheets in Dry Imager FM-DPL manufactured by Fuji Photo Film Co., Ltd. to provide a running state. Then, the soft ware for the heat development machine was changed and the thermal developing time was changed from 24 sec to 18 sec by changing the transportation speed. Using the apparatus, exposure was conducted to provide 1.5 density like in Example 1 and thermal development was conducted for 18 sec. Also in this case, 2000 sheets were treated continuously to examine the number of occurrence for uneven density caused by transportation failure. The result is shown in Table 3.

TABLE 3

| Sample No. | Emulsion Surface Protection Layer | Back Surface Protection Layer | Number of Sheets of Failed Transportation | Remark |
|---|---|---|---|---|
| A | R-1 | R-1 | 7 | Comp. Example |
| B | S-4 | S-4 | 3 | Invention |
| C | S-7 | S-7 | 2 | Invention |
| D | S-9 | S-9 | 0 | Invention |
| E | S-10 | S-10 | 0 | Invention |
| F | S-11 | S-11 | 1 | Invention |
| G | S-14 | S-14 | 2 | Invention |
| H | S-15 | S-15 | 0 | Invention |
| I | S-19 | S-19 | 2 | Invention |
| J | S-20 | S-20 | 1 | Invention |
| K | S-24 | S-24 | 0 | Invention |
| L | S-27 | S-27 | 0 | Invention |
| M | S-30 | S-30 | 0 | Invention |
| N | S-32 | S-32 | 0 | Invention |
| I | S-33 | S-33 | 0 | Invention |

Further, specimens prepared in the same manner as the photosensitive materials in Table 3 were evaluated by DRY PIX7000 manufactured by Fuji Photo Film Co., Ltd. set to the running state by the same method as described above. Also in this case, the same result as in Table 3 was obtained.

From the foregoing results, it can be seen that when the slipping agent of the present invention is added to the emulsion surface protection layer second layer or the back surface protection layer, transportation performance during heat development can be improved remarkably to remarkably suppress the unevenness in the thermal development caused by transportation failure.

Particularly, the improving effect is remarkable in the compounds represented by the general formulae (S-I), (S-II) and (S-III).

Example 2

In the sample 2A, the slipping agent was replaced by ½ weight with the slipping agent S-22 of the present invention and further replacing the fluoro surface active agents F-1 and F-2 as shown in Table 4, and identical evaluation was conducted by the heat development machine shown in FIG. 1. The result is shown in Table 4.

TABLE 4

| Sample No. | Kind of Surface active agent: Emulsion Surface Protection Layer | Back Surface Protection Layer | Number of Sheets of Failed Transportation | Remark |
|---|---|---|---|---|
| A | F-1, F-2 | F-1, F-2 | 5 | Invention |
| B | FF-1 | FF-1 | 3 | Invention |
| C | FF-2 | FF-2 | 3 | Invention |
| D | FF-3 | FF-3 | 4 | Invention |
| E | F-17 | F-17 | 0 | Invention |
| F | F-26 | F-26 | 0 | Invention |
| G | F-29 | F-29 | 0 | Invention |
| H | F-50 | F-50 | 0 | Invention |
| I | FS-17 | FS-17 | 1 | Invention |
| J | FN-1 | FN-1 | 2 | Invention |

FF-1 $C_8F_{17}SO_2N(C_3H_7)CH_2COOK$

FF-2 $C_8F_{17}CH_2CH_2SCH_2CH_2SO_3Li$

FF-3

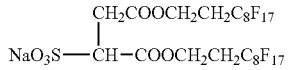

By the use of the fluoro surface active agent used preferably in the present invention, the number of sheets suffering from transportation failure could be decreased. It was particularly preferred in a case of using the surface active agents of F-17, F-26, F-29 and F-50.

Example 3

1) Preparation of Second Slipping Agent (Liquid at Normal Temperature) Emulsion

The second slipping agent (liquid at ordinary temperature) emulsion according to the present invention was dispersed by emulsification by the same method as in Example 1 except for replacing the comparative compounds prepared as the slipping agent emulsion (comparative compounds)

therein with the slipping agent shown in Table 5 by the an identical weight. The average grain size was within a range from 0.18 μm to 0.26 μm.

2) Preparation of Second Slipping Agent (Melting Point 40 to 80° C.) Emulsion (Compound of the Present Invention)

The slipping agent (liquid at a ordinary temperature) emulsion according to the present invention was dispersed by emulsification by the same method as in Example 1 except for replacing the comparative compounds prepared as the slipping agent emulsion (comparative compounds) therein with the slipping agent shown in Table 5 by an identical weight, and setting the emulsifying temperature to a temperature higher by 10° C. than the melting point of the slipping agent according to the present invention. However, for the melting point of higher than 70° C., the emulsifying temperature was set to a temperature higher by 5° C. than the melting point. The average grain size was within a range from 0.19 μm to 0.35 μm.

3) Preparation of Photothermographic Materials 101–112 and 201 to 216

For the photothermographic materials 1 and 2 of Example 1, the second slipping agent was added to the emulsion surface protection layer second layer and the back surface protection layer as shown in Table 5 to prepare specimens 101 to 112 and 201 to 216, respectively.

4) Exposure Development of Light Sensitive Material

The photosensitive materials-1, 101 to 112 and 2, 201 to 216 were exposed and thermally developed by using the Fuji Medical dry laser imager-FM-DP L (mounting 660 nm semiconductor laser of a maximum power of 60 mW (IIIB)) (by four panel heaters set to 112° C.–119° C.–121° C.—121° C. for 24 sec in total for photothermographic materials-1 and 201 to 216, while the photothermographic materials-2 and 201 to 216 were subjected to the standard processing with Fuji Medical Laser Imager DRYPIX 7000 and obtained images were measured by a densitometer. KSI-6000 manufactured by Kensetsu Rubber Co. was used for the material of the roller 62 shown in FIG. 1. Further, an average clearance between 62, and 64*a, b, c* where the photothermographic material was not being passed was set to 0.1 mm.

5) Evaluation Method and Result

The photothermographic materials-1, 101 to 112 and 2, 201 to 216 were exposed uniformly by the heat developing machine shown in FIG. 1 so as to provide 1.5 density, and they were treated each by 2,000 sheets by the heat development machine in the running state, and the number of sheets suffering from plane-like failure caused by deposition of stains was counted.

6) Evaluation Result

The result is shown in Table 5

TABLE 5

| Sample No. | Kind of Slipping Agent: Emulsion Surface Protection Layer | Kind of Slipping Agent: Back Surface Protection Layer | Number of Sheets in Plane-like Failure | Remark |
|---|---|---|---|---|
| 1 | None | None | Frequent Failure | Comp. Example |
| 101 | R-1 | R-1 | 21 | Comp. Example |
| 102 | None | R-1 | 29 | Comp. Example |
| 103 | S-10 | S-10 | 2 | Invention |
| 104 | None | S-10 | 3 | Invention |
| 105 | S-11 | S-11 | 1 | Invention |
| 106 | None | S-11 | 3 | Invention |
| 107 | S-15 | S-15 | 0 | Invention |
| 108 | None | S-15 | 1 | Invention |
| 109 | S-16 | S-16 | 1 | Invention |
| 110 | None | S-16 | 2 | Invention |
| 111 | S-15 x2 | S-15 x2 | 0 | Invention |
| 112 | None | S-15 x2 | 0 | Invention |
| 2 | None | None | Frequent Failure | Comp. Example |
| 201 | R-1 | R-1 | 18 | Comp. Example |
| 202 | None | R-1 | 22 | Comp. Example |
| 203 | S-10 | S-10 | 1 | Invention |
| 204 | None | S-10 | 3 | Invention |
| 205 | S-11 | S-11 | 0 | Invention |
| 206 | None | S-11 | 3 | Invention |
| 207 | S-15 | S-15 | 0 | Invention |
| 208 | None | S-15 | 0 | Invention |
| 209 | S-16 | S-16 | 1 | Invention |
| 210 | None | S-16 | 1 | Invention |
| 211 | S-15 x2 | S-15 x2 | 0 | Invention |
| 212 | None | S-15 x2 | 0 | Invention |
| 213 | None | S-35 | 2 | Invention |
| 214 | S-35 | S-35 | 1 | Invention |
| 215 | None | S-49 | 2 | Invention |
| 216 | S-49 | S-49 | 1 | Invention |

"x2" means that the slipping agent is added twice.

From the foregoing result, it can be seen that occurrence of plane-like failure during thermal development can be suppressed remarkably by adding the second slipping agent to the emulsion surface protection layer second layer, or the back surface protection layer.

The improving effect is particularly remarkable in the compound of the general formulae (S-I), (S-II) and (S-III).

What is claimed is:

1. A photothermographic material comprising, on a support, an image forming layer containing a photosensitive silver halide, a non-photosensitive organic silver salt, a reducing agent and a binder, and a non-photosensitive layer, wherein:

the non-photosensitive layer contains a slipping agent which is a liquid at 25° C.; and a volatile rate of the slipping agent at 120° C. for one hour is 0.5% by mass or less as measured by a thermobalance.

2. A photothermographic material according to claim 1, wherein the slipping agent is at least one selected from the group consisting of paraffin, isoparaffin, naphthene, fatty acid ester and silicone based oil.

3. A photothermographic material according to claim 2, wherein the slipping agent is at least one selected from the group consisting, of liquid paraffin, a monovalent fatty acid ester of polyhydric alcohols and a polyvalent fatty acid ester of monohydric alcohols.

4. A photothermographic material used in a heat development system having transportation rollers, the photothermographic material comprising, on a support, an image forming layer containing a photosensitive silver halide, a non-photosensitive organic silver salt, a reducing agent and a binder, and a non-photosensitive layer, wherein:

the non-photosensitive layer contains a slipping agent; and a permeating rate of the slipping agent to the transportation rollers, when the transportation rollers are immersed in the slipping agent at 120° C. for 2 hours, is 6% by mass or less.

5. A photothermographic material according to claim 4, wherein the slipping agent contains at least one selected from the group consisting of paraffin, isoparaffin, naphthene, fatty acid ester and silicone based oil.

6. A photothermographic material according to claim 5, wherein the paraffin is liquid paraffin.

7. A photothermographic material according to claim 4, wherein the slipping agent is a liquid at 25° C.

8. A photothermographic material according to claim 4, wherein the melting point of the slipping agent is from 40° C. or higher to 80° C. or lower.

9. A photothermographic material according to claim 4, wherein a surface material of the roller contains at least one of rubber and resin.

10. A photothermographic material according to claim 4, wherein a surface material of the roller contains at least one of silicone rubber and fluoro rubber.

11. A photothermographic material according to claim 1, wherein the slipping agent is at least one selected from the group consisting of compounds represented by the following general formulae (S-I), (S-II), and (S-III):

General formula (S-I)

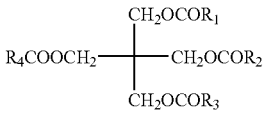

General formula (S-II)

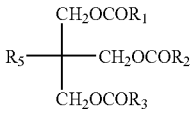

General formula (S-III)

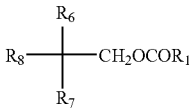

wherein $R_1$, $R_2$, and $R_3$ each independently represent an alkyl group, alkenyl group, alkynyl group, cycloalkyl group or aryl group having 6 to 30 carbon atoms; $R_5$ represents an alkyl group having 1 to 30 carbon atoms, and $R_6$, $R_7$, and $R_8$ each independently represent a methylol group or an alkyl group having 1 to 30 carbon atoms.

12. A photothermographic material according to claim 4, wherein the slipping agent is at least one selected from the group consisting of compounds represented by the following general formulae (S-I), (S-II), and (S-III):

General formula (S-I)

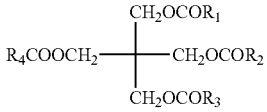

General formula (S-II)

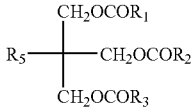

General formula (S-III)

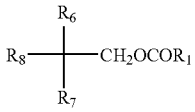

wherein $R_1$, $R_2$, and $R_3$ each independently represent an alkyl group, alkenyl group, alkynyl group, cycloalkyl group or aryl group having 6 to 30 carbon atoms; $R_5$ represents an alkyl group having 1 to 30 carbon atoms, and $R_6$, $R_7$, and $R_8$ each independently represent a methylol group or an alkyl group having I to 30 carbon atoms.

13. A photothermographic material according to claim 1, further containing a fluoro compound having a fluoro alkyl group having at least 2 carbon atoms and no more than 13 fluorine atoms.

14. A photothermographic material according to claim 1, further containing a fluoro compound having a fluoro alkyl group having at least 2 carbon atoms and no more than 12 fluorine atoms.

15. A phototherniographic material according to claim 14, wherein the fluoro compound has a fluoro alkyl group represented by the following general formula (A):

-Rc-Re—W General formula (A)

wherein Rc represents an alkylene group having 1 to 4 carbon atoms;

Re represents a perfluoro alkylene group having 2 to 6 carbon atoms;

and W represents a hydrogen atom, fluorine atom or alkyl group.

16. A photothermographic material according to claim 15, wherein the fluoro compound has two or more fluoro alkyl groups represented by general formula (A) in one molecule.

17. A photothermographic material according to claim 1, wherein the non-photosensitive layer is an outermost layer.

18. A method of forming images using the photothermographic material according to claim 1, wherein the photothermographic material is heat developed under at least one condition selected from the group consisting of the following conditions (1) and (2):

(1) at a temperature from 100° C. to 140° C. for 18 sec or less, (2) at a linear developing speed of 23 mm/s or higher.

19. A method of forming images using the photothermographic material according to claim 4, wherein the photothermographic material is heat developed under at least one condition selected from the group consisting of the following conditions (1) and (2):

(1) at a temperature from 100° C. to 140° C. for 18 sec or less, (2) at a linear developing speed of 23 mm/s or higher.

* * * * *